US010945085B2

(12) United States Patent
Gustafsson et al.

(10) Patent No.: US 10,945,085 B2
(45) Date of Patent: Mar. 9, 2021

(54) MAGNETIC RETENTION DEVICE

(71) Applicant: Cochlear Limited, Macquarie University (AU)

(72) Inventors: Johan Gustafsson, Mölnlycke (SE); Marcus Andersson, Gothenburg (SE); Charles Roger Aaron Leigh, East Ryde (AU)

(73) Assignee: Cochlear Limited, Macquarie University (AU)

( * ) Notice: Subject to any disclaimer, the term of this patent is extended or adjusted under 35 U.S.C. 154(b) by 384 days.

(21) Appl. No.: 15/192,123

(22) Filed: Jun. 24, 2016

(65) Prior Publication Data

US 2016/0381474 A1 Dec. 29, 2016

Related U.S. Application Data

(60) Provisional application No. 62/184,993, filed on Jun. 26, 2015.

(51) Int. Cl.
*H04R 25/00* (2006.01)
*H04S 7/00* (2006.01)

(52) U.S. Cl.
CPC ..... *H04R 25/606* (2013.01); *H04S 7/00* (2013.01); *H04R 2460/13* (2013.01); *H04S 2420/01* (2013.01)

(58) Field of Classification Search
CPC ..... A61N 1/36036; H04R 2460/13; H04R 25/606
See application file for complete search history.

(56) References Cited

U.S. PATENT DOCUMENTS

| | | | | |
|---|---|---|---|---|
| 5,749,912 | A | 5/1998 | Zhang et al. | |
| 7,266,208 | B2 | 9/2007 | Charvin et al. | |
| 7,532,937 | B2 | 5/2009 | Horio et al. | |
| 7,856,986 | B2 | 12/2010 | Darley | |
| 8,811,643 | B2 | 8/2014 | Crawford et al. | |
| 2007/0053536 | A1 | 3/2007 | Westerkull | |
| 2007/0179333 | A1 * | 8/2007 | Bove | A61N 2/06 600/15 |
| 2011/0224789 | A1 | 9/2011 | Griffith | |
| 2011/0264172 | A1 | 10/2011 | Zimmerling et al. | |

(Continued)

FOREIGN PATENT DOCUMENTS

| | | | |
|---|---|---|---|
| CN | 2411869 | Y | 12/2000 |
| EP | 2720480 | A2 | 4/2014 |

(Continued)

OTHER PUBLICATIONS

International Search Report and Written Opinion for PCT/IB2016/053787, dated Sep. 30, 2016.

(Continued)

*Primary Examiner* — Christine H Matthews
(74) *Attorney, Agent, or Firm* — Pilloff Passino & Cosenza LLP; Martin J. Cosenza

(57) ABSTRACT

An apparatus, including an external component of a medical device configured to generate a magnetic flux that removably retains, via a resulting magnetic retention force, the external component to a recipient thereof, wherein the external component is configured to enable the adjustment of the generated magnetic flux so as to vary the resulting magnetic retention force.

21 Claims, 43 Drawing Sheets

(56) References Cited

U.S. PATENT DOCUMENTS

| | | | | |
|---|---|---|---|---|
| 2012/0080039 | A1 | 4/2012 | Siegert | |
| 2012/0088956 | A1 | 4/2012 | Asnes et al. | |
| 2012/0172659 | A1 | 7/2012 | Ball et al. | |
| 2013/0018218 | A1 | 1/2013 | Haller et al. | |
| 2013/0046131 | A1* | 2/2013 | Ball | H04R 25/606 600/25 |
| 2013/0110198 | A1 | 5/2013 | Stoffaneller | |
| 2013/0195304 | A1* | 8/2013 | Andersson | H04R 25/606 381/326 |
| 2014/0012069 | A1 | 1/2014 | Ball | |
| 2014/0012071 | A1 | 1/2014 | Nagl et al. | |
| 2014/0121451 | A1 | 5/2014 | Kasic et al. | |
| 2014/0270297 | A1 | 9/2014 | Gustafsson et al. | |
| 2015/0382114 | A1 | 12/2015 | Andersson et al. | |

FOREIGN PATENT DOCUMENTS

| | | | |
|---|---|---|---|
| JP | 2010075394 | A | 4/2010 |
| JP | 2013232860 | A | 11/2013 |
| KR | 101297828 | B1 | 8/2016 |
| WO | 9939769 | A1 | 8/1999 |
| WO | 2014011582 | A2 | 1/2014 |

OTHER PUBLICATIONS

Extended European Search Report for EP Application No. 16813830.3, dated Jan. 29, 2019.

Office Action for CN Application No. 201680037137.1, dated Mar. 11, 2020.

* cited by examiner

MAGNETIC RETENTION DEVICE

CROSS-REFERENCE TO RELATED APPLICATIONS

This application claims priority to Provisional U.S. Patent Application No. 62/184,993, entitled MAGNETIC RETENTION DEVICE, filed on Jun. 26, 2015, naming Johan GUSTAFSSON of Sweden as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is an apparatus comprising an external component of a medical device configured to generate a magnetic flux that removably retains, via a resulting magnetic retention force, the external component to a recipient thereof, wherein the external component is configured to enable the adjustment of the generated magnetic flux so as to vary the resulting magnetic retention force.

In accordance with another exemplary embodiment, there is an apparatus, comprising a bone conduction device, including a first permanent magnet and a second permanent magnet, wherein the first permanent magnet is movable relative to the second permanent magnet so as to adjust a strength of a magnetic field resulting from the first and second permanent magnets.

In accordance with another exemplary embodiment, there is a method, comprising obtaining an external component of a medical device configured to be magnetically retained against outer skin of a recipient via a magnetic coupling between the external component and an implanted component in the recipient and adjusting an orientation of one or more magnets of the external component relative to at least one other magnet of the external component such that the resulting retention force of the magnetic retention for the recipient is varied from that which was the case prior to the adjustment.

BRIEF DESCRIPTION OF THE DRAWINGS

Some embodiments are described below with reference to the attached drawings, in which.

DETAILED DESCRIPTION

Figure 1:
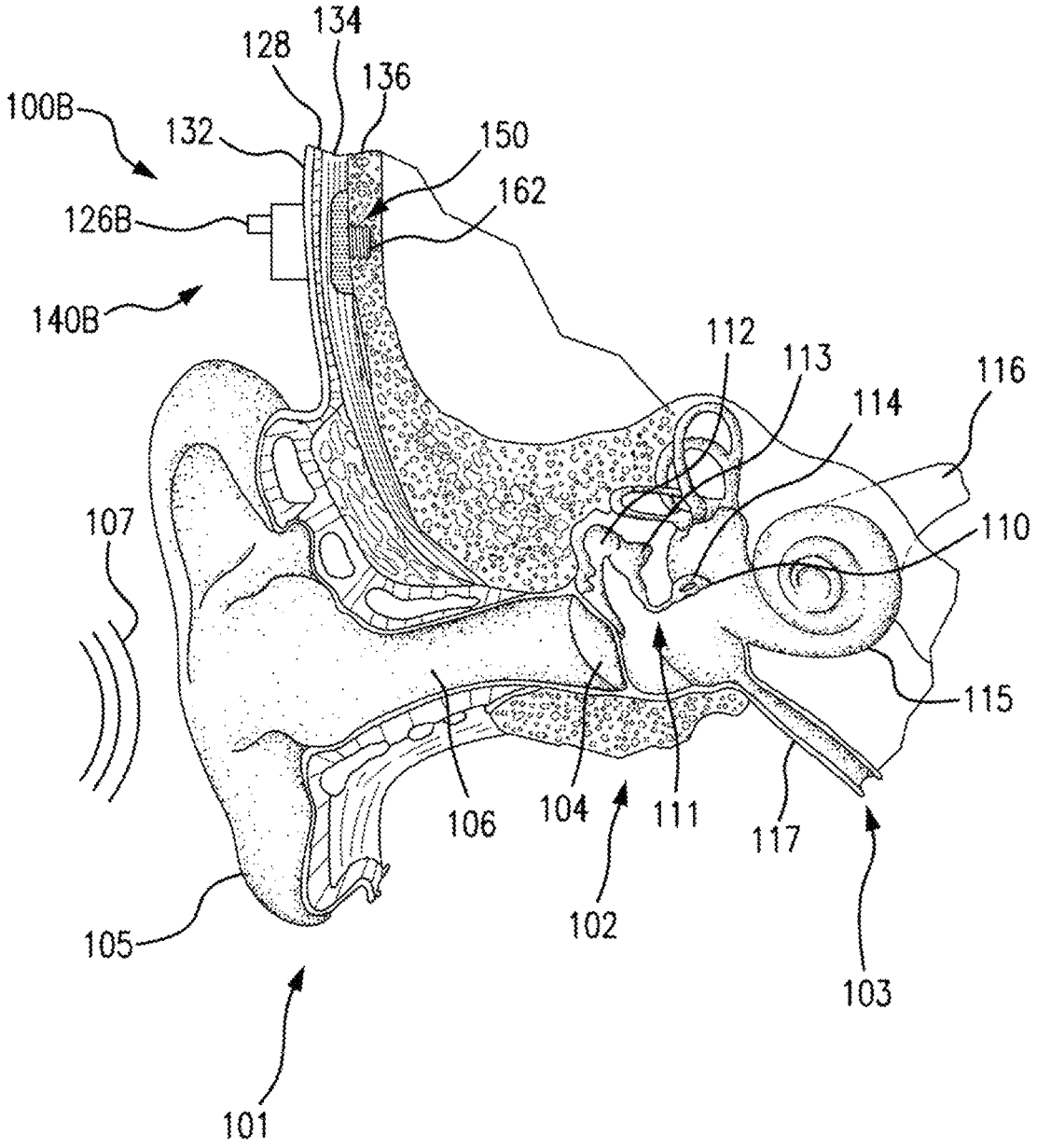
FIG. 1 is a perspective view of an exemplary bone conduction device in which at least some embodiments can be implemented.

FIG. 1 is a perspective view of a bone conduction device 100 in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element may comprise, for example, a microphone, telecoil, etc. In an exemplary embodiment, sound input element 126 may be located, for example, on or in bone conduction device 100, or on a cable extending from bone conduction device 100.

The bone conduction device 100 of FIG. 1 is a passive transcutaneous bone conduction device utilizing the electromagnetic actuators disclosed herein and variations thereof where no active component (e.g., the electromagnetic actuator) is implanted beneath the skin (it is instead located in an external device), and the implantable part is, for instance a magnetic pressure plate (a permanent magnet, ferromagnetic material, etc.). Some embodiments of the passive transcutaneous bone conduction systems are configured for use where the vibrator (located in an external device) containing the electromagnetic actuator is held in place by pressing the vibrator against the skin of the recipient. In an exemplary embodiment, the vibrator is held against the skin via a magnetic coupling (magnetic material and/or magnets being implanted in the recipient and the vibrator having a magnet and/or magnetic material that is used to complete the magnetic circuit, thereby coupling the vibrator to the recipient).

More specifically, FIG. 1 is a perspective view of a passive transcutaneous bone conduction device 100 in which embodiments can be implemented.

Bone conduction device 100 comprises an external component 140 and an implantable component 150. Bone conduction device 100 comprises a sound processor (not shown), an actuator (also not shown) and/or various other operational components. In operation, sound input device 126 converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 is a passive transcutaneous bone conduction device. In such an arrangement, the actuator is located in external component 140, and implantable component 150 includes a plate, as will be discussed in greater detail below. The plate of the implantable component 150 vibrates in response to vibrations transmitted through the skin, mechanically and/or via a magnetic field, that are generated by an external magnetic plate.

Figure 2:
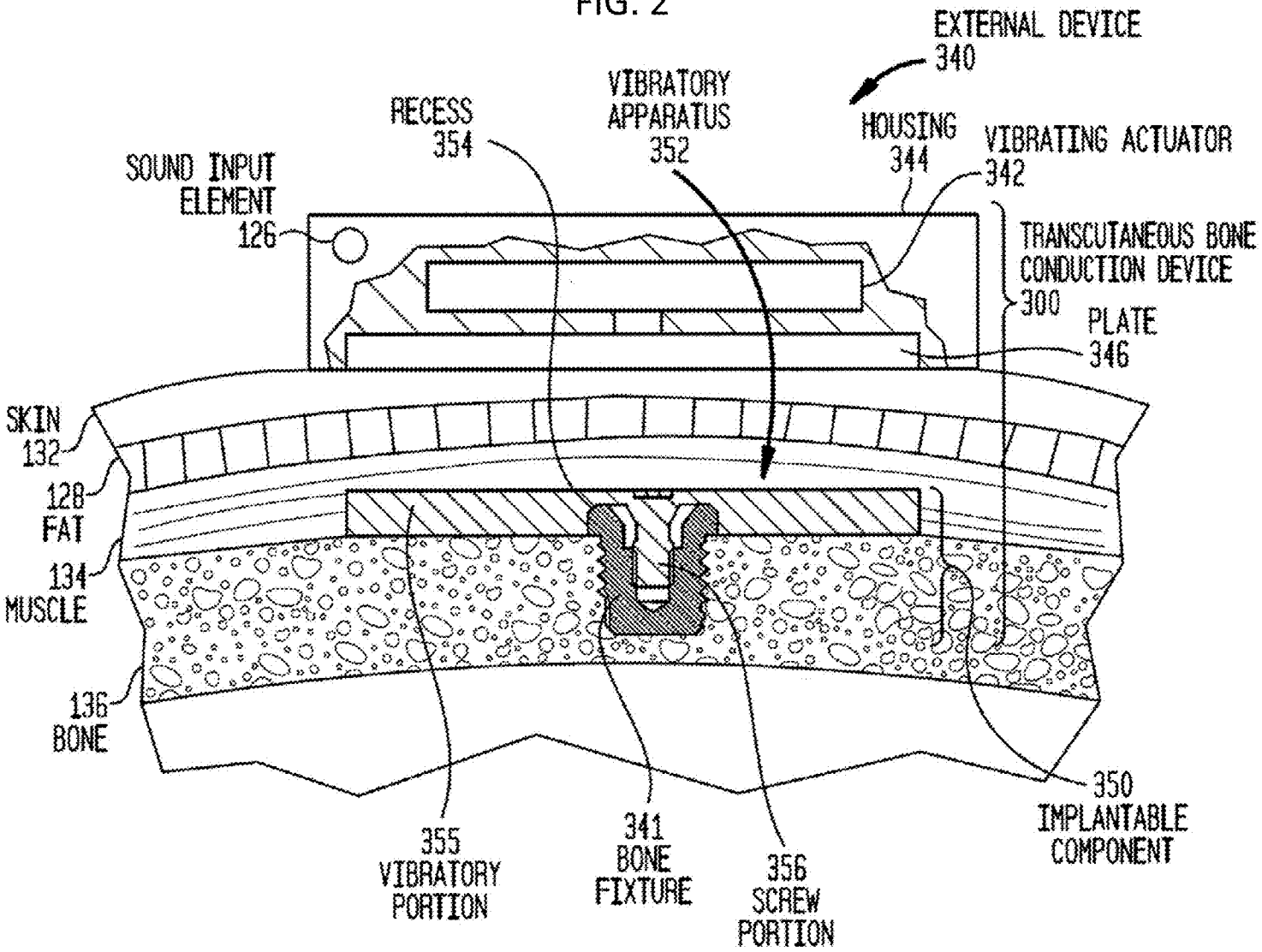
FIG. 2 is a schematic diagram conceptually illustrating a passive transcutaneous bone conduction device in accordance with at least some exemplary embodiments.

FIG. 2 depicts a functional schematic of an exemplary embodiment of a transcutaneous bone conduction device 300 according to an embodiment that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating electromagnetic actuator 342 is located in the external device 340. Vibrating electromagnetic actuator 342 is located in housing 344 of the external component, and is coupled to plate 346. In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient, as will be detailed further below. Accordingly, vibrations produced by the vibrating electromagnetic actuator 342 of the external device 340 are transferred from plate 346 across the skin to plate 355 of implanted plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3:
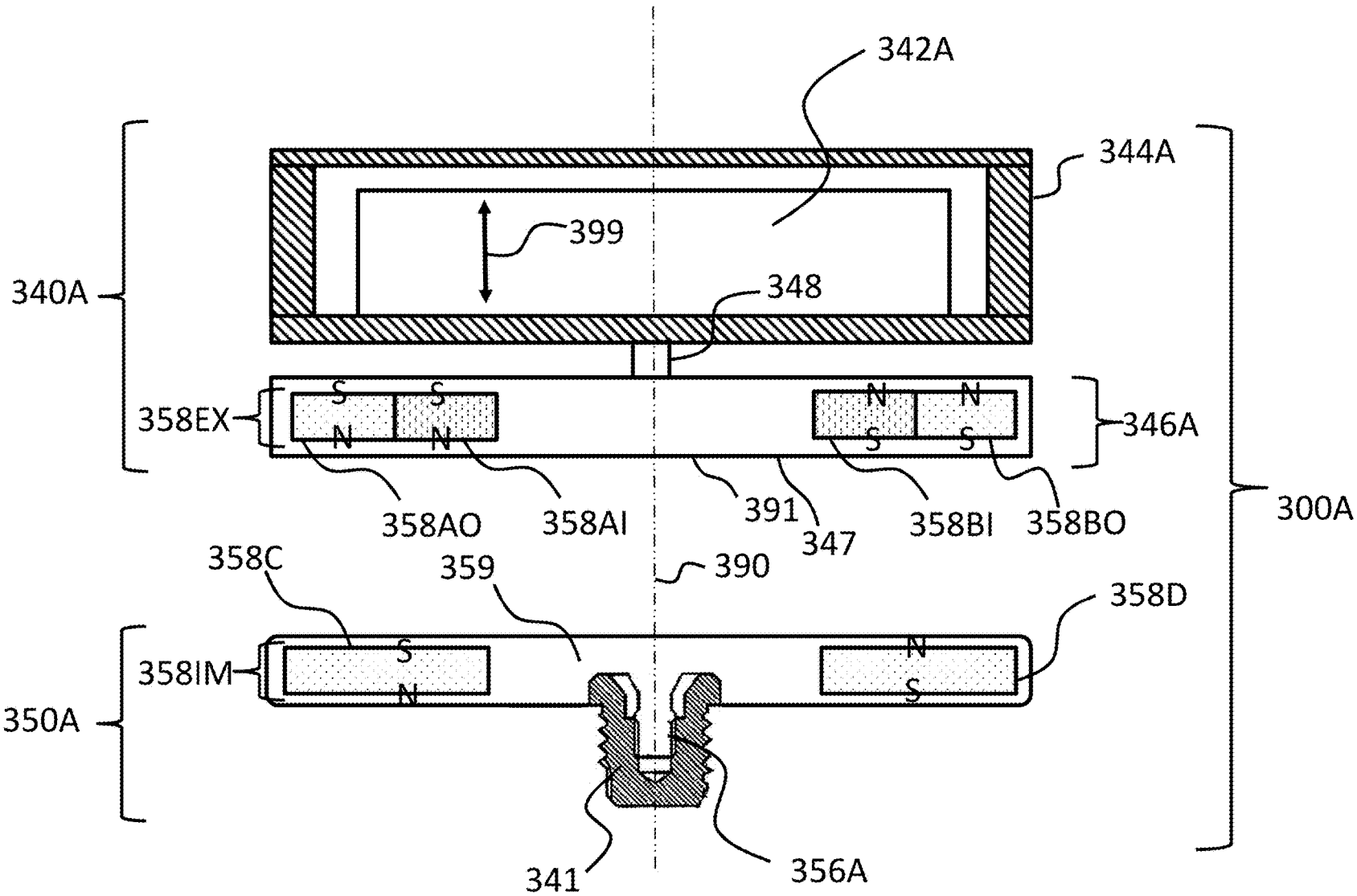
FIG. 3 is a schematic diagram illustrating additional details of the embodiment of FIG. 2.

Referring now to FIG. 3, there is depicted a schematic of an exemplary bone conduction device 300A corresponding to bone conduction device 300 of FIG. 2. The exemplary bone conduction device 300A of FIG. 3 includes an external component 340A corresponding to external component 340 of FIG. 2, and an implantable component 350A corresponding to implantable component 350 of FIG. 2.

In an exemplary embodiment, external component 340A has the functionality of a transducer/actuator, irrespective of whether it is used with implantable component 350A. That is, in some exemplary embodiments, external component 340A will vibrate whether or not the implantable component 350A is present (e.g., whether or not the static magnetic field extends to the implantable component 350A, as will be detailed below).

The external component 340A includes a vibrating actuator represented in black-box format by reference numeral 342A. In an exemplary embodiment, the vibrating actuator can be an electromagnetic actuator. Alternatively, in some alternate embodiments, the vibrating actuator 342A can be a piezoelectric actuator. Any type of an actuator that can enable the teachings detailed herein and/or variations thereof to be practiced can be utilized in at least some exemplary embodiments. That said, embodiments detailed herein will be described, by way of example only and not by way of limitation, in terms of a vibrating electromagnetic actuator that utilizes a yoke about which is wound a coil that is energized and deenergized in an alternating manner so as to produce an electromagnetic field that interacts with permanent magnets that moves a seismic mass in a reciprocating vibratory matter in a direction of arrow 399.

Still with reference to FIG. 3, the vibrating electromagnetic actuator 342A is enclosed in a housing 344A, as can be seen. In some embodiments, the housing 344A is a hermetically sealed housing, while in other embodiments, it is not hermetically sealed. In at least some exemplary embodiments, the housing 344A is configured to provide the actuator 342A protection from shock and environmental conditions, etc. Any housing that can enable the teachings detailed herein and/or variations thereof can be utilized in at least some embodiments. In this regard, as can be seen, the housing 344A is rigidly attached to skin interface portion 346A, which functionally corresponds to plate 346 of FIG. 2 detailed above, by structural component 348. In this exemplary embodiment, the structural component 348 provides a vibrational conduction path such that vibrations generated by actuator 342A are transferred from the housing to the skin interface component 346A such that those vibrations can then be transferred into the skin of the recipient to ultimately evoke a hearing percept according to the teachings detailed herein and/or variations thereof.

In at least some embodiments, skin interface portion 346A serves a dual role in that it both transfers vibrations from the external component 340A to the skin and also magnetically couples the external component 340A to the recipient. In this regard, as can be seen, skin interface portion 346A includes a housing 347 that includes an external magnet assembly 358EX. External magnetic assembly 358EX includes permanent magnets having a North-South alignment. These magnets are locationally adjustable relative to one another, as will be detailed below. However, in the configuration depicted in FIG. 3 (without adjustment, as will be detailed below), the magnets on one side of the magnetic assembly 358EX, relative to the longitudinal axis 390 of the bone conduction device 300A, all have North poles facing towards the actuator 342A (i.e., away from the skin of the recipient), and the magnets on the other side of the magnetic assembly 358EX, relative to longitudinal axis 390 of the bone conduction device, all have North poles facing away from the actuator 342A (i.e., towards the skin of the recipient). That is, the North-South alignment of one side of the external magnet assembly 358EX is opposite that of the other side of the assembly. However, exemplary embodiments of the external component 340A are configured such that the individual magnets can be moved so that the poles are different than that depicted in FIG. 3.

It is noted that the word "adjustable" as used herein excludes replacement of one magnet with another magnet, that being a reconfiguration or a modification to the device.

Additional details of external magnet assembly 358EX are presented below.

Skin interface portion 346A includes a bottom surface 391 (relative to the frame of reference of FIG. 3) that is configured to interface with the exterior skin of the recipient. In this regard, skin interface portion 346A corresponds to plate 346 of FIG. 2 as described above. It is through skin interface portion 346A that vibrations generated by the electromagnetic actuator of the external component 340A are transferred from the external component 340A to the skin of the recipient to evoke a hearing percept. In an exemplary embodiment, the housing 347 of the skin interface portion 346A is made of a non-ferromagnetic material that is compatible with skin of the recipient (or at least is coated with a material that is compatible with skin of the recipient). In this regard, in at least some exemplary embodiments, the housing 347 is configured to substantially avoid influencing the magnetic flux generated by the permanent magnets of the external magnet assembly 358EX.

FIG. 3 also depicts an implantable component 350A corresponding to implantable component 350 of FIG. 2. In some embodiments, implantable component 350 includes an implantable magnet assembly 358IM that includes at least two permanent magnets 358C and 358D. Permanent magnet 358C has a North-South alignment in a first direction relative to a longitudinal axis of the electromagnetic actuator (the vertical direction of FIG. 3). Permanent magnet 358D has a North-South alignment in a second direction relative to a longitudinal axis of the electromagnetic actuator, the second direction being opposite the first direction. In an exemplary embodiment, the permanent magnets are bar magnets (having a longitudinal direction extending normal to the plane of FIG. 3). In at least some exemplary embodiments, permanent magnets 358C and 358D are bar magnets connected to one another via the chassis 359 of the implantable component 350A. In an exemplary embodiment, the chassis 359 is a nonmagnetic material (e.g., titanium). It is noted that in alternative embodiments, other configurations of magnets can be utilized. Any configuration permanent magnet that can enable the teachings detailed herein and/or variations thereof to be practiced can be utilized in at least some embodiments.

That said, in an alternative embodiment, it is noted that the implantable component 350A does not include permanent magnets. In at least some embodiments, elements 358C and 358D are replaced with other types of ferromagnetic material (e.g., soft iron (albeit encapsulated in titanium, etc.)). Also, elements 358C and 358D can be replaced with a single, monolithic component. Any configuration of ferromagnetic material of the implantable component 350A that will enable the permanent magnets of the external component 340A to establish a magnetic coupling with the implantable component 350A that will enable the external component 340A to be adhered to the surface of the skin, as detailed herein, can be utilized in at least some embodiments.

As can be seen, implantable component 350A includes screw component 356A configured to screw into bone fixture 341 and thus secure the chassis 359 to the bone fixture 341, and thus to the recipient.

Referring back to the external component 340A, and, more particularly, to the external magnetic assembly 358EX of the skin interface portion 346A, it can be seen that the external magnetic assembly 358EX comprises four (4) different magnets arrayed about the longitudinal axis 390 in two sets. The first set includes outer permanent magnet 358AO and inner permanent magnet 358AI. The second set includes outer permanent magnet 358BO and inner permanent magnet 358BI. As will be detailed more thoroughly below, the inner permanent magnets of these sets are configured to be moved relative to the outer permanent magnets of the sets, and/or visa-versa, so as to vary the magnetic flux generated by the external magnetic assembly 358EX as a result of magnetic flux addition and cancellation. In this regard, in at least some exemplary embodiments, during operational use of the bone conduction device 300A, the magnets of the external magnet assembly 358EX are aligned with the magnets of the implantable magnet assembly 358IM such that the poles of the permanent magnets 358AO, 358AI and 358C have a North-South alignment in the same direction and the poles of the permanent magnets 358BO, 359BI and 358D have a North-South alignment in the same direction (but opposite of that of magnets 358AO, 358AI and 358C), in a scenario where maximum attractive force between the external component 340A and the implantable component 350A is desired. Conversely, in at least some exemplary embodiments, during operational use of the bone conduction device 300A, the magnets of the external magnet assembly 358EX are aligned with the magnets of the implantable magnet assembly 358IM such that the poles of the permanent magnets 358AO and/or 358AI are aligned in a different direction than that of magnet 358C, not because the external component 340A has been rotated relative to the implantable component 350A (or, alternatively, not entirely because the external component 340A has been rotated relative to the implantable component 350A), but because of the adjustability of the relative position of the magnets 358AO and/or 358AI. Furthermore, in this exemplary embodiment, during operational use of the bone conduction device 300A, the magnets of the external magnet assembly 358EX are aligned with the magnets of the implantable magnet assembly 358IM such that the poles of the permanent magnets 358BO and/or 358BI are aligned in a different direction than that of magnet 358D, again not because the external component 340A has been rotated relative to the implantable component 350A (or, alternatively, not entirely because the external component 340A has been rotated relative to the implantable component 350A), but because of the adjustability of the relative position of the magnets 358BO and/or 358BI.

Figure 4A:
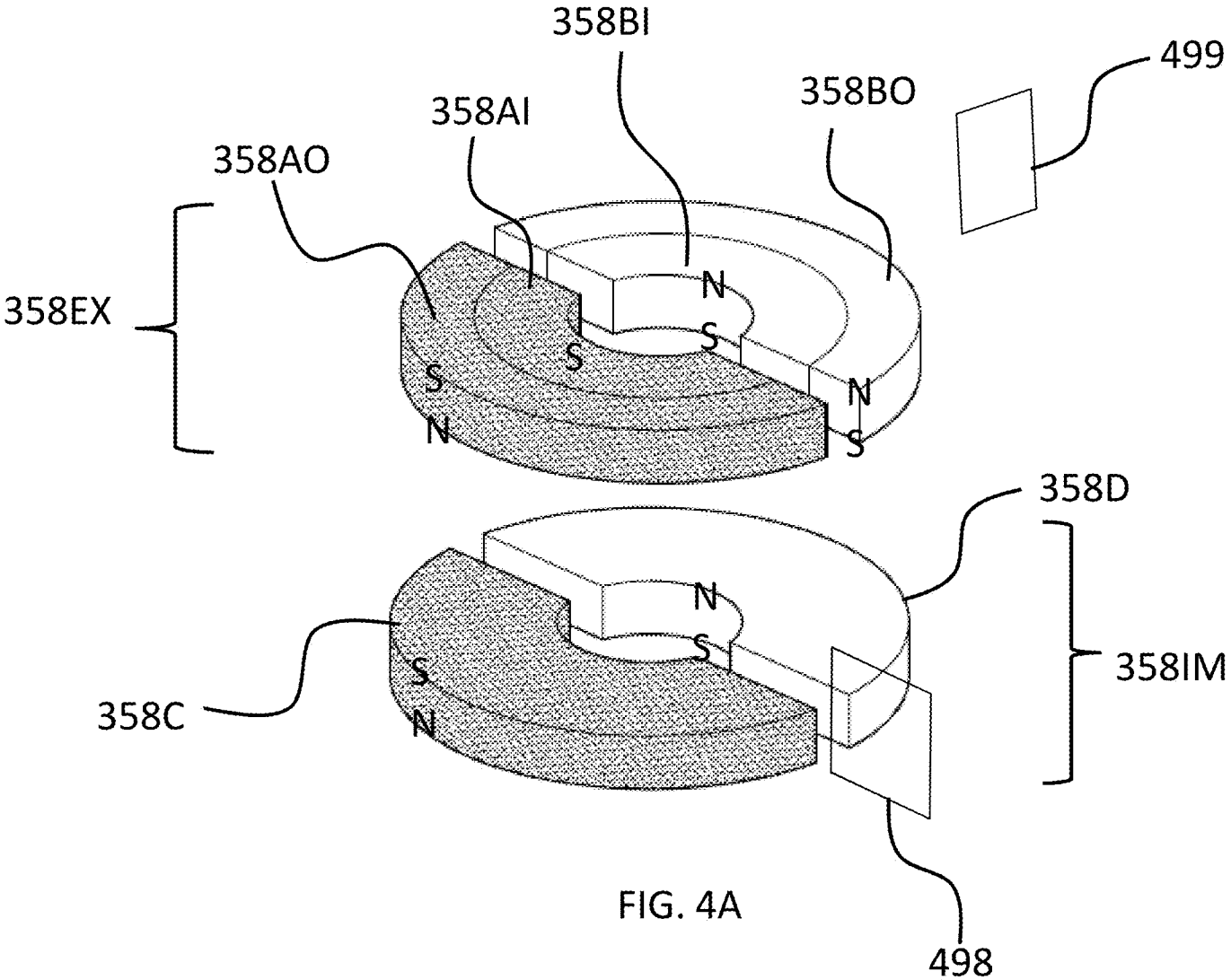
FIGS. 4A-4C are schematic diagrams illustrating adjustment of a component of the embodiment of FIG. 3.
Figure 4B:
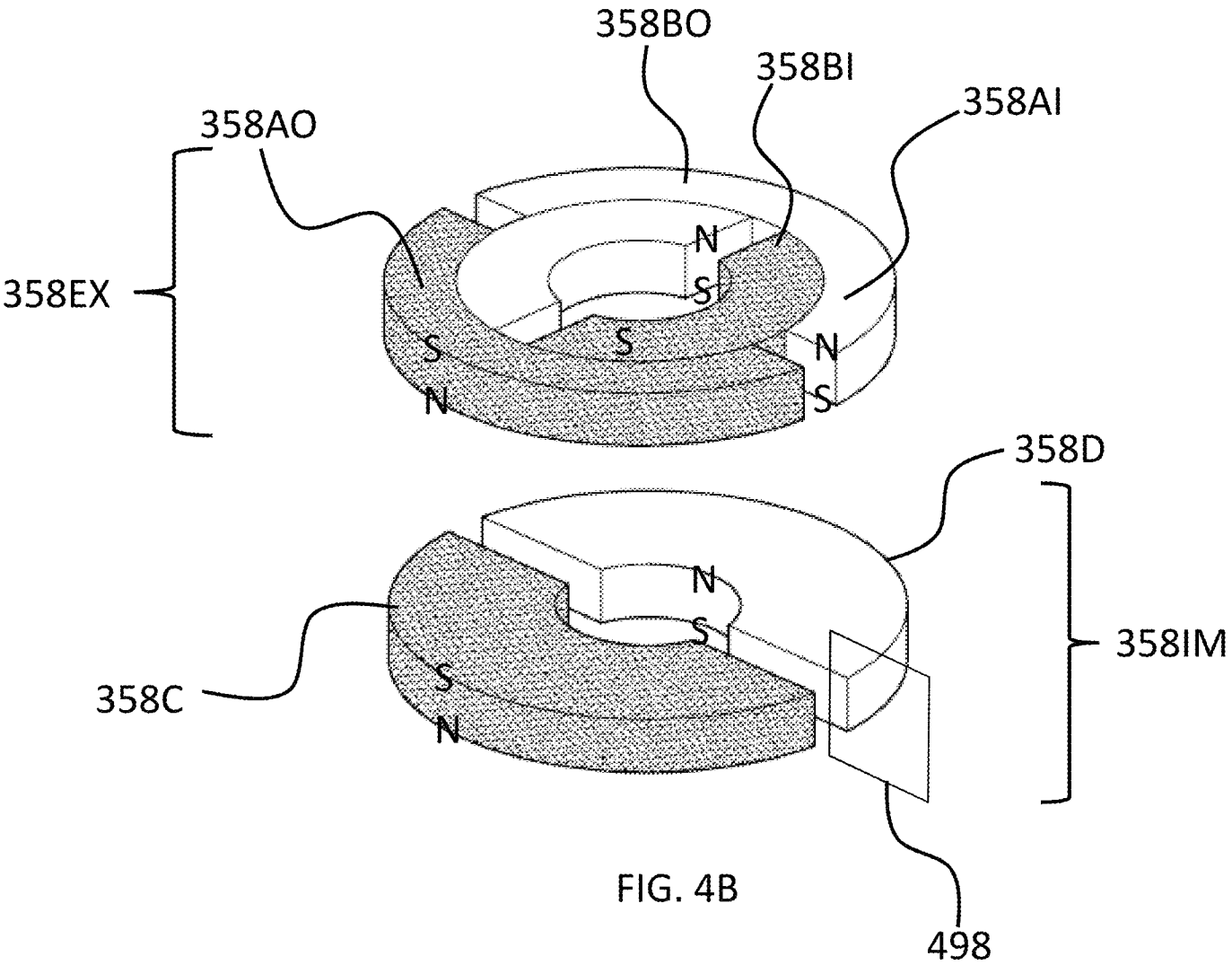
Figure 4C:
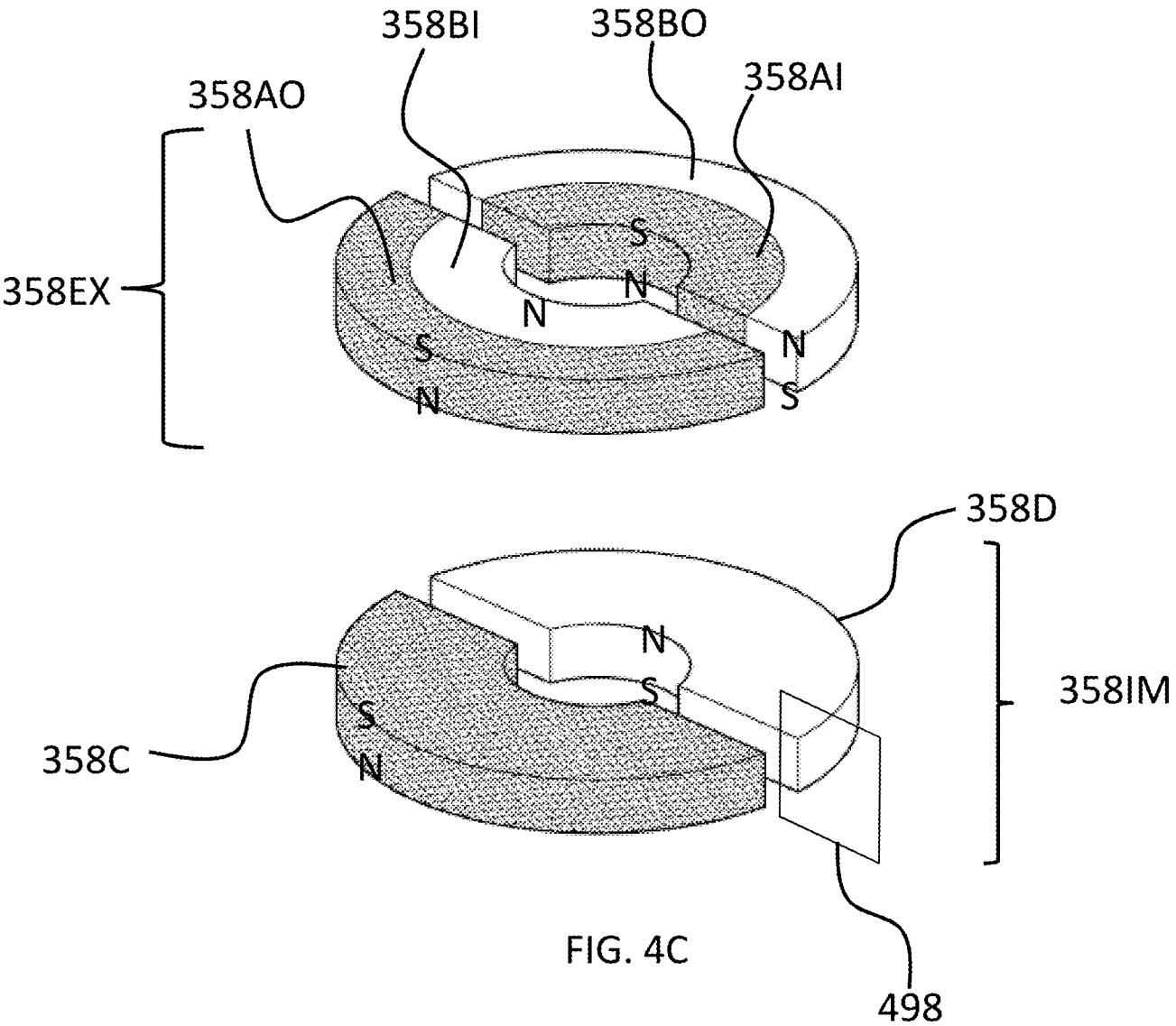

The above adjustability can be conceptually seen in FIGS. 4A-C, which conceptually depict respective isometric views of the external magnet assembly and the internal magnet assembly without any of the components of the bone conduction device 300A. More specifically, FIG. 4A depicts a configuration of the external magnet assembly 358EX such that the maximum attraction force between the external component 340A and 350A is achieved. Briefly, with respect to the frame of reference of FIGS. 4A-4C, the plane 499 corresponds to the plane of FIG. 3, wherein the plane 499 lies on the longitudinal axis 390 of the bone conduction device 300A. Plane 498 is perpendicular to plain 499, and also lies on the longitudinal axis 390 of the bone conduction device 300A. Plane 499 is in the middle of magnets 358C and 358D and in the middle of magnets 358AO and 358BO, and in the middle of magnets 358AI and 359BI, at least when all of those magnets are perfectly aligned axially and radially with respect to one another, and thus, along with longitudinal axis 390, defines the orientation of plane 499 relative to the bone conduction device 300A.

As can be seen in FIG. 4A, the magnets of the external component are segmented into 2 half-washer shaped magnets of approximately equal area. In embodiments corresponding to FIGS. 4A-4C, the external component 340A is configured such that the inner magnets 358AI and 358BI can be moved to have a different angular configuration relative to the outer magnets 358AO and 358BO. Accordingly, FIG. 4B depicts the inner magnets 358AI and 358BI shifted by an angle 90 degrees relative to the location of those magnets depicted in FIG. 4A (and thus having an angular offset of 90 degrees relative to the outer magnets 358AO and 358BO). Here, and in FIG. 4C, the locations of outer magnets 358AO and 358BO are the same as that of FIG. 4A. Also, the locations of outer magnets 358AO and 358BO, relative to the magnets of the implantable magnet assembly 358IM, are the same in all of FIGS. 4A-4C. It is noted that the arrangement of FIG. 4A depicts four (4) magnets in the external component (aside from any magnets that may be present in, for example, the transducer). That is, even though the poles of two of the four magnets are aligned with one another and those two magnets are contacting one another, that "set" of magnets still represents two magnets. That is, a given magnet is a discrete magnet, and while a plurality of magnets aligned with one another function as a single magnet, there are still a plurality of magnets present.

FIG. 4C depicts the inner magnets 358AI and 358BI shifted by an angle 180 degrees relative to the location of those magnets depicted in FIG. 4A (and thus having an angular offset of 180 degrees relative to the outer magnets 358AO and 358BO). In these embodiments, whereas the configuration of FIG. 4A results in the strongest attraction force (for a given air gap between the external magnet assembly 358EX and the implantable magnet assembly 358IM—more on this below) between the external component 340A and the implantable component 350A, the configuration of FIG. 4C results in the weakest attraction force (again for the given air gap) between the external component 340A and the implantable component 350, with the configuration of FIG. 4B resulting in an attraction force between that resulting from FIG. 4A and FIG. 4C.

The physical phenomenon that results in the differences between the attraction force of the different configurations will now be described, followed by some exemplary embodiments of the structure of the bone conduction device implementing some such embodiments.

Briefly, a general concept of an exemplary principle of operation here is that a net attractive force between the external component and the implanted component is needed to maintain the external component against the skin of the recipient. An attractive force of zero would result in the external component not being retained to the recipient, at least via magnetic attraction, and a negative attractive force would repel the external component from the implantable component. However, the net attractive force can be varied within a range, providing that a net attractive force still remains, and the embodiments detailed herein can enable that variation. That is, in at least some exemplary embodiments the magnets are adjusted to vary the net attractive force.

In this regard, as will be discussed in greater detail below, it is noted that even with the magnets located as positioned in FIG. 4C, there is still some net attractive force remaining between the external component and the implantable component, even though the magnets are locally oppositely arranged with respect to their poles. This is because, in this exemplary embodiment, the outer magnets dominate the inner magnets with respect to the net magnetic attraction.

That is, the outer magnets have a greater effect on the magnetic attraction than that of the inner magnets. That said, in at least some embodiments, if the inner magnets had a more dominant effect on the overall net magnetic attraction, the movements of the magnets could possibly result in a net repulsive force (or if the outer magnets were the magnets that were adjusted). In at least most embodiments, there is utilitarian value with respect to maintaining an overall net magnetic attraction, at least in scenarios where a zeroed out net magnetic attraction and/or a net repulsive attraction would not result in the external component being maintained in position against the skin of the recipient.

Accordingly, there can be utilitarian value with respect to the teachings detailed herein and variations thereof in also taking into account the local effect of a given magnet (i.e., the effect of a magnet on the overall system). In this regard, some magnets can generate a magnetic field that is stronger than other magnets, and also the positioning of magnets (including the distance of magnets of the external component to the implantable component) can influence the overall effect of the magnets with respect to the net attractive force between the external component and the implantable component.

Figure 5A:
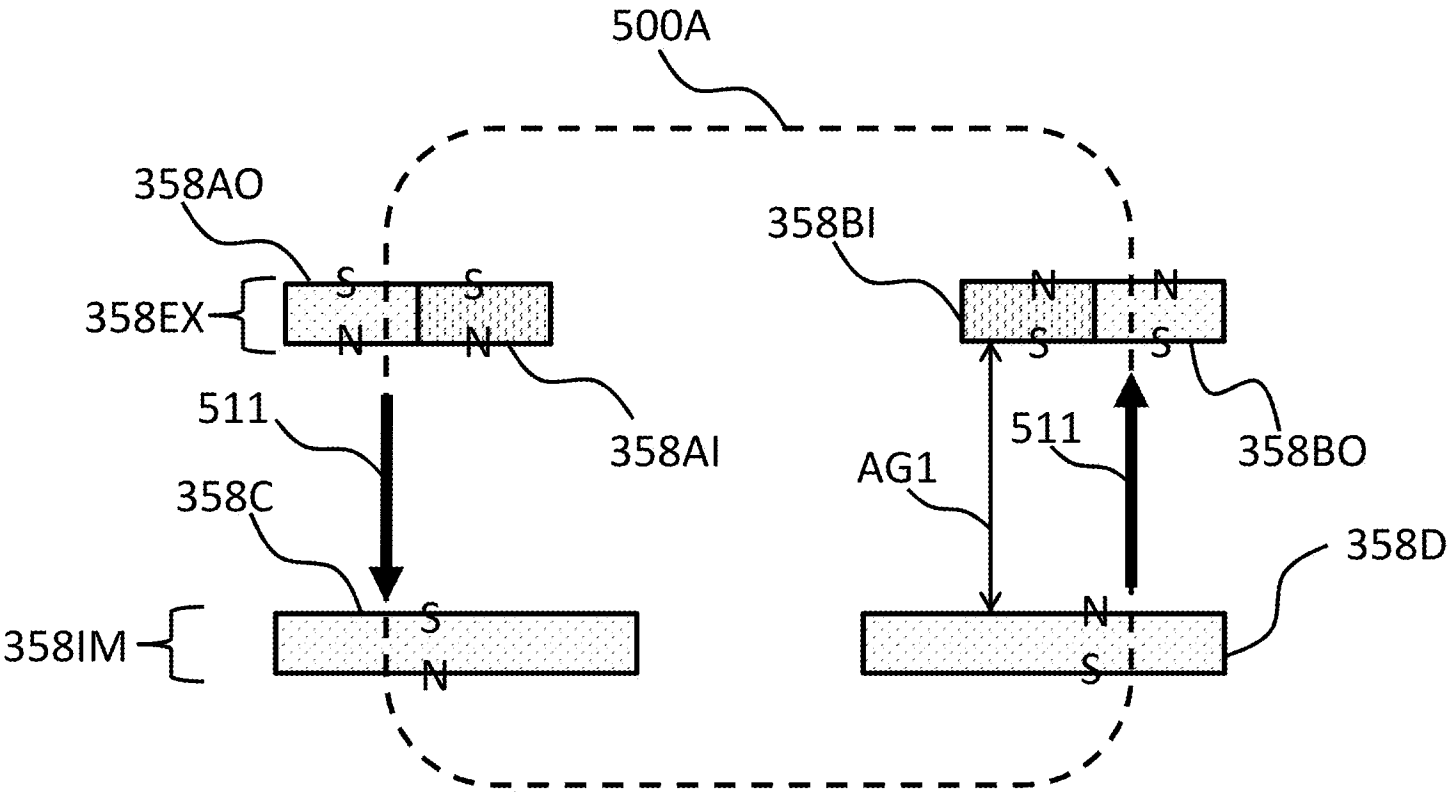
FIGS. 5A-5B are schematic diagrams illustrating exemplary magnetic flux paths of the embodiment of FIG. 3.

FIG. 5A depicts a quasi-functional diagram of a cross-section of the external and implantable magnet assemblies taken through plane 499 (the plane of FIG. 3) with the magnets in the arrangement as presented in FIG. 4A, with the magnetic flux following a magnetic flux path 500A. FIG. 5A depicts an air gap AG1, representing the space between the external magnet assembly 358EX and the implantable magnet assembly 358IM. It is noted that the phrase "air gap" refers to locations along the magnetic flux path in which little to no material having substantial magnetic aspects is located but the magnetic flux still flows through the gap. The air gap closes the magnetic field. Accordingly, an air gap is not limited to a gap that is filled by air. Indeed, in at least some embodiments, there is always some form of solid and/or liquid matter located between the opposing faces of the external and internal magnet assemblies (skin, fat, body fluids, the material of the chassis 359, material of the housing 347, etc.).

As can be seen, in an exemplary embodiment, the magnetic flux path 500A travels in a circuit through all of the magnets of the external magnet assembly and the implantable magnet assembly. Arrows 511 depict the relative localized strength of the magnetic flux and the direction thereof in between the magnets of the external magnet assembly 358EX and the implantable magnet assembly 358IM (the strength and direction of the magnetic flux at those local locations within the air gap AG1). With respect to the cross-sectional view of FIG. 5A, the magnetic flux travels in a counterclockwise direction, as is represented by arrows 511, consistent with the fact that the poles of all the magnets are aligned. That said, if the view of FIG. 5A was presented from the opposite side of the longitudinal axis 390, the direction of the magnetic flux would be clockwise. Alternatively, if all of the magnetic poles were reversed from that seen in the figures, the magnetic flux would be in the opposite direction. Any direction of magnetic flux that will enable the teachings detailed herein and/or variations thereof to be practiced can be utilized in at least some embodiments.

Figure 5B:
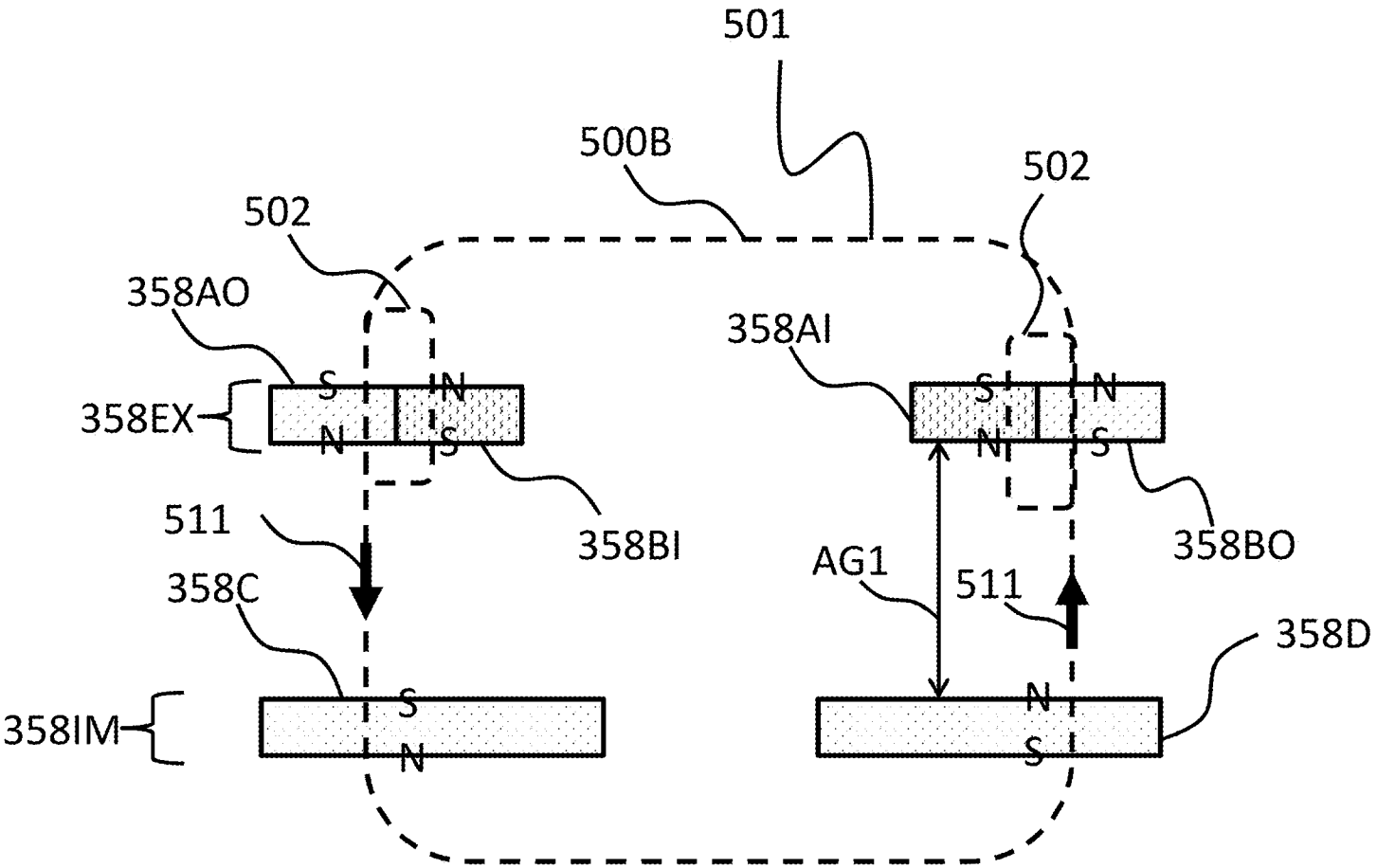

Conversely, FIG. 5B depicts a quasi-functional diagram of a cross-section of the external and implantable magnet assemblies also taken through plane 499 (the plane of FIG. 3) with the magnets in the arrangement as presented in FIG. 4C, with the magnetic flux path 500B superimposed thereon. FIG. 5B depicts an air gap AG1, representing the space between the external magnet assembly 358EX and the implantable magnet assembly 358IM. The air gap AG1 is the same distance as that of FIG. 5A in this exemplary embodiment.

As can be seen, in an exemplary embodiment the magnetic flux has a magnetic flux path 500B that includes multiple components. First, a flux path 501 that travels in a circuit through all of the magnets of the external magnet assembly and the implantable magnet assembly, at least generally concomitant with the flux path 500A of FIG. 5A vis-à-vis directionality. However, as can be seen, the magnetic flux path 500B also includes flux paths 502 that travel in a circuit only through the local magnets on either side of the longitudinal axis 390 of the bone conduction device 300A. That is, as can be seen, there is a magnetic flux path 502 that travels in a localized circuit between magnets 358AO and 358BI, owing to the fact that the directionality of the poles of these magnets are opposite relative to the longitudinal axis 390. The same is the case with respect to magnets 358BO and 358AI. Generally speaking, the magnetic flux paths 502 represent a short circuit in the magnetic flux path 500A of FIG. 5A that limits that magnetic interaction between the magnets of the external magnet assembly 358EX and the magnets of the implantable magnet assembly 358IM relative to that which would be the case in the absence of the short-circuiting. In at least some embodiments, because of these localized magnetic flux paths 502, the strength of the magnetic flux between the magnets of the external magnet assembly 358EX and the implantable magnet assembly 358IM (the strength within the air gap AG1) is lower relative to that of FIG. 5A. This is functionally represented by arrows 511 in FIG. 5B, which are smaller than those of FIG. 5A. Accordingly, the resulting retention force holding the external component 350A against the skin of the recipient is lower than the resulting retention force of the magnetic flux of FIG. 5A.

Accordingly, in at least some exemplary embodiments, the bone conduction device 300A is configured such that the strength of the magnetic field generated (at least in part) by the external component can be varied for a given air gap AG1 and a given orientation of the external component 340A relative to the implantable component 350A, by establishing a short-circuit of the magnetic flux and controlling the magnitude of that short-circuit. That is, by way of example only and not by way of limitation, holding all other variables constant, the magnetic flux that retains the external component 340A to the implantable component 350A can be varied such that the resulting retention force that holds the external component 340A to the skin of the recipient is also varied by adjusting the orientation of at least one permanent magnet of the external component 340A relative to another permanent magnet of the external component 340A, and thereby creating and/or adjusting the short-circuit in the magnetic flux.

Thus, in view of the above, in an exemplary embodiment, there is an apparatus, comprising an external component of a medical device, such as, by way of example only and not by way of limitation, external component 340 of FIG. 3, configured to generate a magnetic flux (e.g., via permanent magnets, which generation is thus passive) that removably retains, via a resulting magnetic retention force, the external component (e.g., 340A) to the recipient thereof. In this exemplary embodiment, the external component is configured to enable the adjustment of the generated magnetic flux so as to vary the resulting magnetic retention force. In this regard, as seen from the above, at least some exemplary embodiments accomplish this by moving the permanent magnets relative to one another. In this regard, in at least some exemplary embodiments, the external component is configured to enable the adjustment of the generated magnetic flux without varying a total magnetic density of permanent magnets of the external component generating the magnetic flux. That said, in at least some alternate embodiments, as will be detailed below, permanent magnets can be added and/or removed from the external component of the bone conduction device so as to vary the generated magnetic flux, and thus vary the force retaining the external component to the recipient.

Still further, as will be understood from the embodiment of FIG. 3, in at least some exemplary embodiments, the external component is configured to enable the adjustment of the generated magnetic flux entirely due to the generation of passive magnetic flux (e.g., the magnetic flux generated by permanent magnets, as contrasted to that generated by the application of electric current to a coil, etc.). As just-detailed, this can be accomplished without varying a total magnetic density of permanent magnets of the external component generating the magnetic flux.

Still further, as will be understood from the above, in an exemplary embodiment of this exemplary embodiment, the external component is configured to enable the adjustment of the generated magnetic flux via at least one of additive or subtractive interaction of local magnetic flux (e.g., by creating and/or varying the short-circuit in the magnetic flux, by, for example, altering/adjusting the relative locations of one or more of the permanent magnets that generate the magnetic field).

In at least some specific exemplary embodiments, the external component 340A includes at least a first permanent magnet and a second permanent magnet (e.g., 358BI and 358BO, respectively), and the external component is configured to enable the adjustment of the generated magnetic flux via movement of the first permanent magnet relative to the second permanent magnet (or visa-versa, or by movement of both the first permanent magnet and the second permanent magnet). As seen above with respect to FIGS. 4A-4C, the movement of the first permanent magnet relative to the second permanent magnet is movement within a single plane (e.g., the plane normal to the longitudinal axis 390 of the bone conduction device 300A). Still further, as seen above with respect to FIGS. 4A-4C, a first permanent magnet relative to the second permanent magnet is a rotational movement within that plane. That said, in alternative embodiments, as will be detailed below, the movement need not necessarily be rotational.

Before proceeding further to some of the performance features of at least some exemplary embodiments, it is briefly noted that in at least some exemplary embodiments, the external component 340A includes a sound processor. In at least some embodiments, at least one of the magnets (e.g., 358AI and/or 358BI) of the external component 340A is movable relative to the sound processor.

Figure 6:
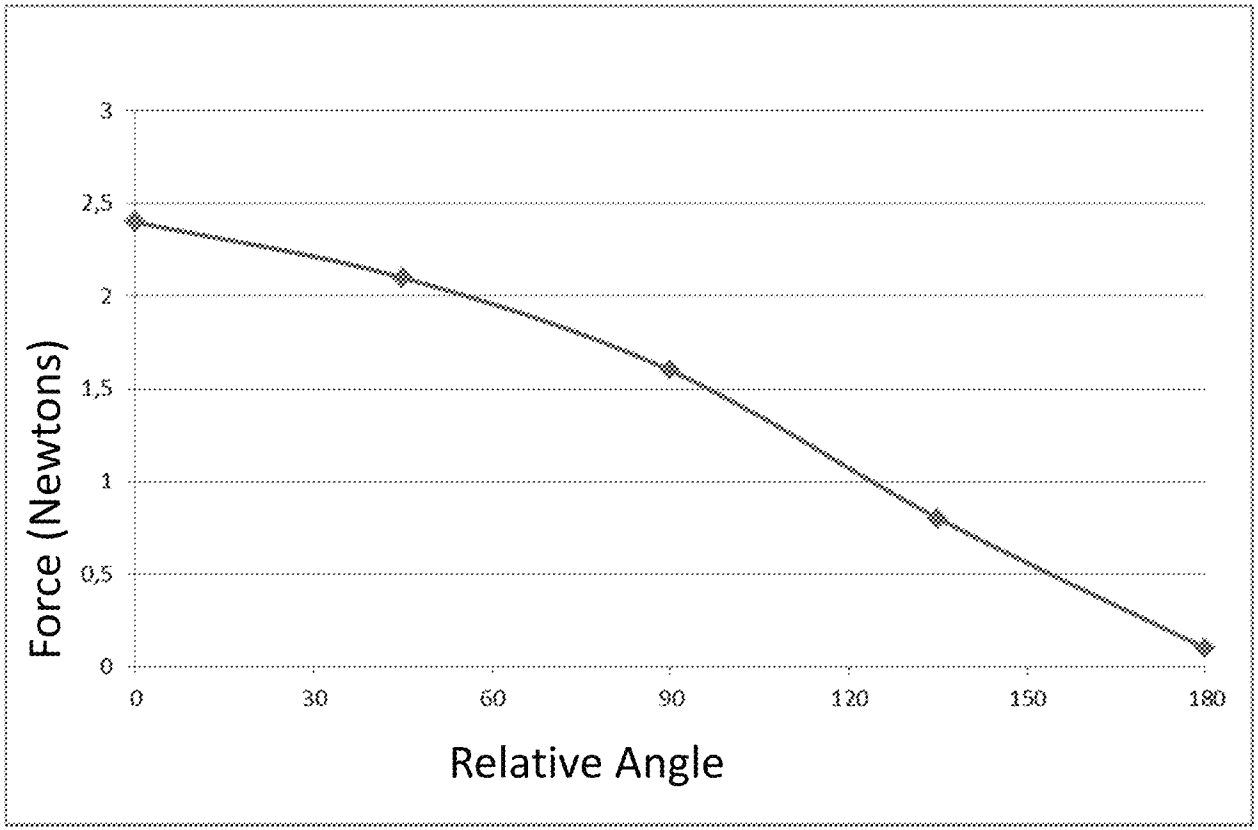
FIG. 6 is an exemplary chart presenting a graph representing how attraction force between the external component and the implantable component changes with relative angle change of magnets of the external component.

FIG. 6 presents a chart that depicts an exemplary graph of attraction force in Newtons between the external components 340A and the implantable component 350A for relative angle adjustment between the magnets of the external magnet assembly 358EX, where zero degrees corresponds to the orientation of the magnets seen in FIG. 4A, 90 degrees corresponds to the orientation of the magnets seen in FIG. 4B, and 180 degrees corresponds to the orientation of the magnets seen in FIG. 4C, where all variables other than angular orientation of the permanent magnets of the external component 340A relative to one another are held constant. Further, it is noted that the exemplary forces depicted in FIG. 6 are for a given magnet configuration. Stronger magnets and/or larger magnets, etc., would result in different force values for the relative angles. Accordingly, the data depicted in FIG. 6 is exemplary to illustrate a general concept for some embodiments. That said, the data is accurate for other embodiments.

As can be seen from the graph of FIG. 6, in at least some embodiments, the external magnet assembly 358EX is configured such that the attraction force between the external component 340A and the implantable component 350A can be varied such that the attraction force can be reduced to approximately 10% of the maximum attraction force (i.e., the force at the zero angle of alignment). It is noted that in at least some embodiments, the external magnet assembly 358EX is configured such that the attraction force between the external component 340A and the implantable component 350A can be varied such that the attraction force can be reduced to approximately 75%, 70%, 65%, 60%, 55%, 50%, 45%, 40%, 35%, 30%, 25%, 20%, 15%, 10% or less of the maximum attraction force or about any value there between in about 1% increments (e.g., about 64%, about 17%, etc.).

Thus, in view of the above, in an exemplary embodiment, the external component 340A (or any other external component detailed herein and/or variations thereof or others based thereon, that can enable the teachings detailed herein and/or variations thereof) is configured to enable the adjustment of a generated magnetic flux generated at least in part by the external component, so as to vary the resulting magnetic retention force between the external component and the implantable component, solely due to the adjustment of the generated magnetic flux, from a maximum retention force (all other variables held constant) to a retention force that is less than any of about 75%, 70%, 65%, 60%, 55%, 50%, 45%, 40%, 35%, 30%, 25%, 20%, 15% or about 10% of the maximum force, or any value there between as detailed above.

Any force and any relative angle and any relationship there between that can enable the teachings detailed herein to be practiced (e.g., retaining an external component of a bone conduction device to a recipient to evoke a hearing percept) can be utilized in at least some embodiments.

As noted above, in at least some embodiments, the inner magnets of the external magnet assembly 358EX (magnets 358AI and 358BI) are moved relative to the outer magnets and to the other components of the external component 340A of the bone conduction device 300A. Conversely, in alternative embodiments, it is the outer magnets of the external magnet assembly 358EX (magnets 358AO and 358BO) that are moved relative to the inner magnets and to the other components of the external component 340A of the bone conduction device 300A. Still further, in some other alternate embodiments, both the outer and inner magnets are moved relative to the other components of the external component 340A of the bone conduction device 300A. Any scenario of movement of any magnet that will enable the teachings detailed herein and/or variations thereof to be practiced can be utilized in at least some embodiments.

With regard to movement of the magnets, any configuration that will enable the movement of the magnets and/or any method that will enable the movement of the magnets that will enable the teachings detailed herein and/or variations thereof to be practiced can be utilized in at least some embodiments. In at least one exemplary embodiment, a mechanical arrangement is utilized to move the magnets relative to one another. In an exemplary embodiment, a worm gear is utilized to rotate the inner magnets relative to the outer magnets and/or vice-versa. To this end, in an exemplary embodiment, the inner magnets of the external magnet assembly 358EX are arrayed in/on a structure such that the inner magnets are connected to one another (the magnets can be connected to a circular plate of non-magnetic material, the magnets can be embedded in a casting of nonmagnetic material in the form of a ring, etc.). The structure can include or otherwise be connected to a rotary gear that interfaces with a worm gear. The external component 340A is configured such that a torque can be applied to the worm gear such that the torque turns the worm gear, which in turn turns the rotary gear included/connected to the structure in which/on which the inner magnets are arrayed, thereby changing the angular relationship between the inner magnets and the outer magnets. In an alternative embodiment, the outer magnets can be located in/on the structure to which the rotary gear is connected, and thus torque applied to the worm gear results in the rotation of the outer magnets, thereby changing the angular relationship between the outer magnets and the inner magnets. In still other alternate embodiments, the external component 340A of the bone conduction device 300A is configured such that a single worm gear rotates both the outer magnets and the inner magnets to change the angular orientation of the respective magnets.

In at least some exemplary embodiments, the external component 340A of the bone conduction device can be configured to permit a compact power tool to be connected to the external component such that the worm gear (or any other gearing system that is utilized) can be turned at a higher speed than that which can be achieved by turning the worm gear by hand. In this regard, the gearing system of at least some exemplary embodiments can be configured such that the gearing system converts a high-speed input to a low speed and high torque output.

In at least some embodiments, precise angular positioning of the outer magnets relative to the inner magnets and/or vice versa can have utilitarian value. In at least some embodiments, the external component 340A of the bone conduction device is configured such that the angular orientation of the magnets relative to one another can be changed in increments of 0.5°, 1°, 2°, 3°, 4°, 5°, 6°, 7°, 8°, 9°, 10°, 15°, 20°, 30°, 45° or more or any value or range of values there between in 0.1° increments (e.g, 0.7° increments, 1.5° increments, etc.). Accordingly, in an exemplary embodiment, a high degree of precision with respect to force adjustment can be achieved, because the angular relationship between the magnets can be adjusted to such a fine and precise degree that very fine and precise changes in the attraction force can be obtained.

Other mechanical configurations can be utilized to change the angular orientations of the magnets. In an exemplary embodiment, the outer magnets and/or the inner magnets are connected to one another by structure such that a torque applied to the structure will change the angular orientation of the magnets relative to one another. In an exemplary embodiment, the outer magnets and/or the inner magnets can be located on a flat plate and/or be embedded in a structure, analogous to the structures detailed above with respect to the gearing system, and a torque application point can be provided on that structure. In an exemplary embodiment, the torque application point can be a hex head receptacle that will interface with an Allen wrench or the like. The external component 340A of the bone conduction device is configured such that application of a torque to the torque point utilizing the Allen wrench can change the angular orientation of the magnets.

In an alternative embodiment, there is a method of changing the angular orientation of the magnets relative to one another by utilizing an external fixture that generates an external magnetic field that has sufficient strength such that it repositions the magnets relative to one another. In an exemplary embodiment, this can be utilized in embodiments where the magnets of the external magnet assembly 358EX are completely enclosed within the housing 347 (e.g., hermetically sealed therein) and there is no adjustment mechanism built into the external component 340A. By way of example only and not by way of limitation, the outer magnets 358AO and 358BO can be fixed to the housing 347, and the inner magnets 358AI and 358BI can be arranged such that the magnets can move when the magnetic field is applied thereto. Alternatively, the inner magnets can be fixed to the housing 347, and the outer magnets can be configured to move when the magnetic field is applied thereto.

Of course, in at least some embodiments, the relative angle of the magnets can be adjusted by hand. By way of example only and not by way of limitation, the outer magnets and/or the inner magnets can be located in or on any of the structure(s) detailed above, and those structure(s) can be connected to a component that is accessible from the outside of the housing 347. In an exemplary embodiment, this component can be a ring that has a knurled surface that extends about the outer circumference of the housing 347 and is movable relative thereto. In an exemplary embodiment, a recipient or a healthcare professional or technician, or anyone suitable to practice at least some of the teachings detailed herein, rotates the knurled ring relative to the housing 347. Because the ring is connected to the structure supporting the movable magnets, the pertinent magnets are moved with the ring.

Still further, in at least some embodiments, the external component 340A can simply be taken apart to gain access to some or all of the magnets of the external magnet assembly 358EX, and the pertinent magnets can be adjusted by hand to the desired angular orientation.

Any device, system, and/or method that will enable the angular orientation of one or more of the permanent magnets of the external magnet assembly 358EX to be adjusted that will enable the teachings detailed herein and or variations thereof to be practiced can be utilized in at least some embodiments.

At least some embodiments also include a structural arrangement that will enable the magnets to be secured in place after the desired adjustment is achieved. Any configuration that will enable the magnets to be retained at a desired angular orientation/"locked in place" after movement can be utilized in at least some embodiments. By way of example only and not by way of limitation, a lock screw can be utilized to prevent the magnets from rotating relative to one another after angular adjustment. In an exemplary embodiment, the outer magnets 358AO and 358BO of the external magnet assembly 358EX and/or the inner magnets 358AI and 358BI of the external magnet assembly 358EX can be supported on/in any of the structures detailed above. For example, the magnets can be located within rings of non-magnetic material, such that an outer ring containing the outer magnets is arrayed about an inner ring (or disk) containing the inner magnets. A lock screw can extend through the outer ring to the inner ring. Friction force between the tip of the lock screw and the outer surface of the inner ring can be used to hold the inner ring in place such that its angular orientation relative to the outer ring will not change. Alternatively and/or in addition to this, the lock screw can extend in a direction parallel to the longitudinal axis 390, thus bypassing the outer ring.

While friction force between the tip of the lock screw and a given ring is utilized to hold the magnets in position in some embodiments, dimpled sections can be utilized to receive a portion of the tip of the lock screw in alternative embodiments, the dimpled portions can be arrayed about the outer circumference of the outer ring in discrete intervals such that discrete angular orientations of the inner magnets relative to the outer magnets can be maintained.

It is noted that while the above embodiments focus on rotating the inner magnets relative to the outer magnets, in an alternate embodiment, it is the outer magnets that are rotated. Accordingly, in an exemplary embodiment, the lock screw need not extend to the inner magnets/the ring supporting the inner magnets. Instead, the lock screw would, in at least some embodiments, extend only to the outer magnets/the ring supporting the outer magnets.

That said, in at least some embodiments, friction forces are utilized to hold the magnets in place, if not lock the magnets in place. In an exemplary embodiment, the magnets will not move unless a sufficient torque or force is applied thereto to overcome the friction. Alternatively and/or in addition to this, the external component may be configured such that the magnets are always free to move relative to one another, but a significant amount of input must be provided to move the magnets relative to one another. By way of example only and not by way limitation, in an embodiment that utilizes gearing, the external component can be configured such that many, many turns must be applied to the input to rotate the magnet just one degree. Thus, even if a limited number of turns are ultimately applied to the input, the magnet will not move a significant amount.

Figure 7A:
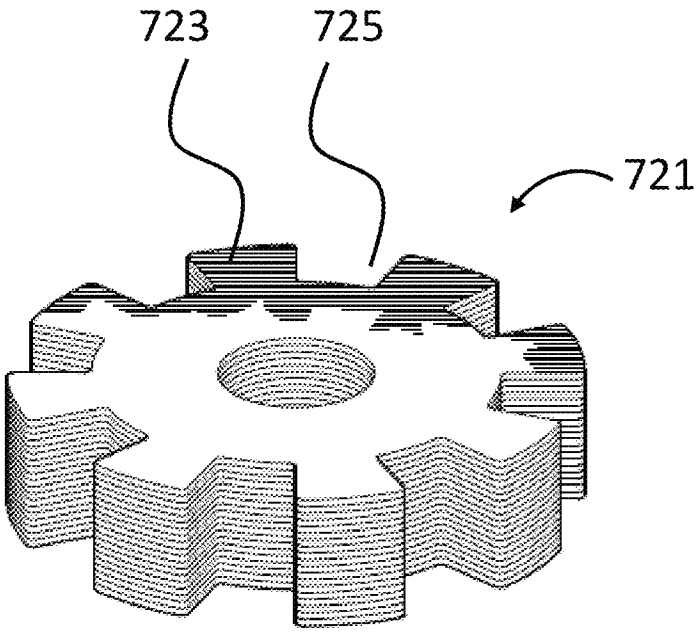
FIGS. 7A and 7B present an exemplary embodiment depicting how magnet orientation can be locked and limited to certain orientations.
Figure 7B:
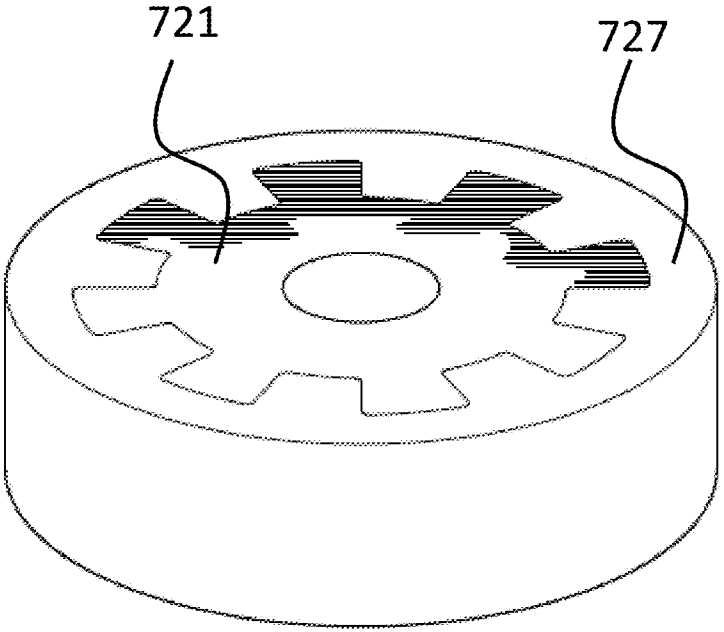

An exemplary embodiment can utilize a tongue and recess system to maintain a desired angular orientation between the magnets. Referring now to FIG. 7A, there is an exemplary casting 721 of a plastic material containing the inner magnets (not shown). As can be seen, the casting 721 includes eight (8) tongues 723 and eight (8) recesses 725. The casting 721 is sized and dimensioned to fit into a casting 727 having the opposite configuration, as can be seen in FIG. 7B. In an exemplary embodiment, this casting 727 includes the outer magnets (not shown). As can be seen, there are eight (8) combinations of angular orientations of the casting 721 relative to casting 727, and thus the inner magnets relative to the outer magnets. That said, in at least some embodiments, there are only three different resulting force profiles in at least some of these embodiments, because the resulting force values of orientations of the magnets after the 180° relative orientations can be duplicative of those before the 180° orientation. Accordingly, in an exemplary embodiment, the embodiment of FIGS. 7A and 7B enables the relative orientation of the outer magnets to the inner magnets to be changed in 45° increments (i.e., the angular orientation of the magnets can be set to 0°, 45° degrees, 90° degrees, 135° degrees, 180°, and so on until the 0° orientation is again obtained). In at least some embodiments, the embodiments of FIGS. 7A and 7B can have utilitarian value in that a very precise angular orientation of the magnets can be maintained with very high reliability (e.g., in at least some embodiments, the only way for an orientation to change after adjustment of the magnets would be if the housing 347 of the external component 340A was purposely taken apart and/or the housing 347 was damaged).

Any device, system, and/or method that will permit the orientations of the outer and/or inner magnets to be maintained after a desired adjustment that will enable the teachings detailed herein and/or variations thereof to be practiced can be utilized in at least some embodiments.

Figure 8:
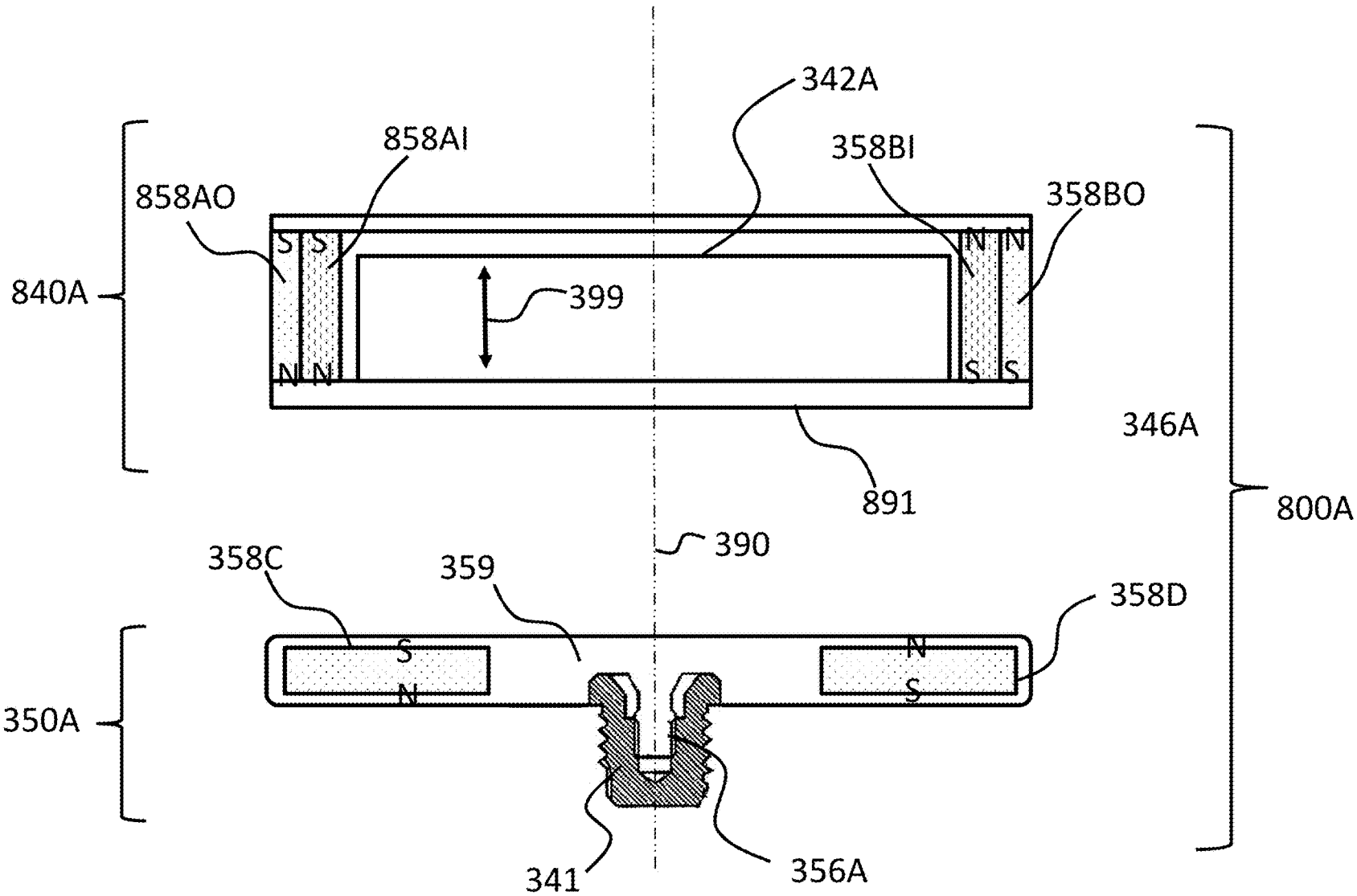
FIG. 8 depicts another exemplary embodiment.
Figure 9A:
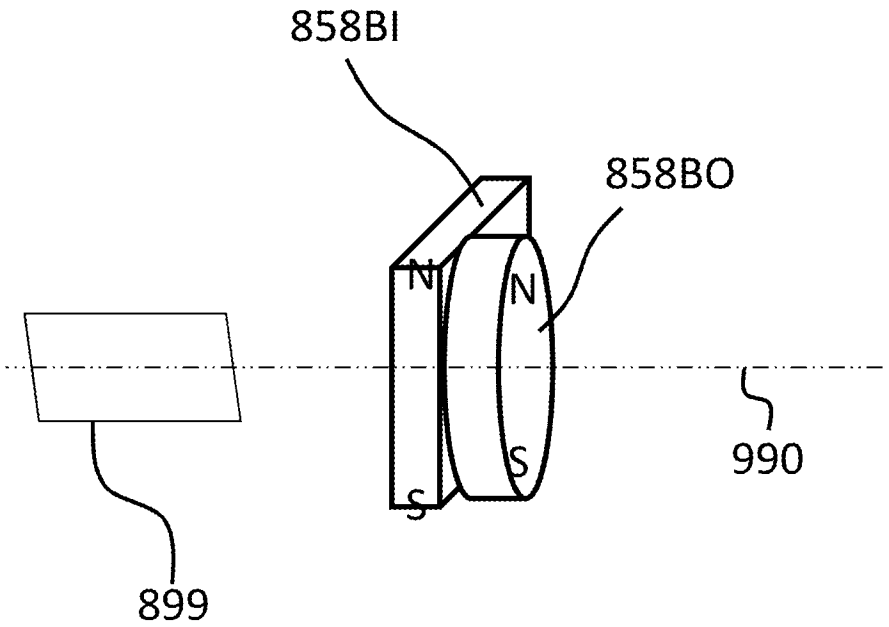
FIGS. 9A-9C are schematic diagrams illustrating adjustment of a component of the embodiment of FIG. 8.
Figure 9B:
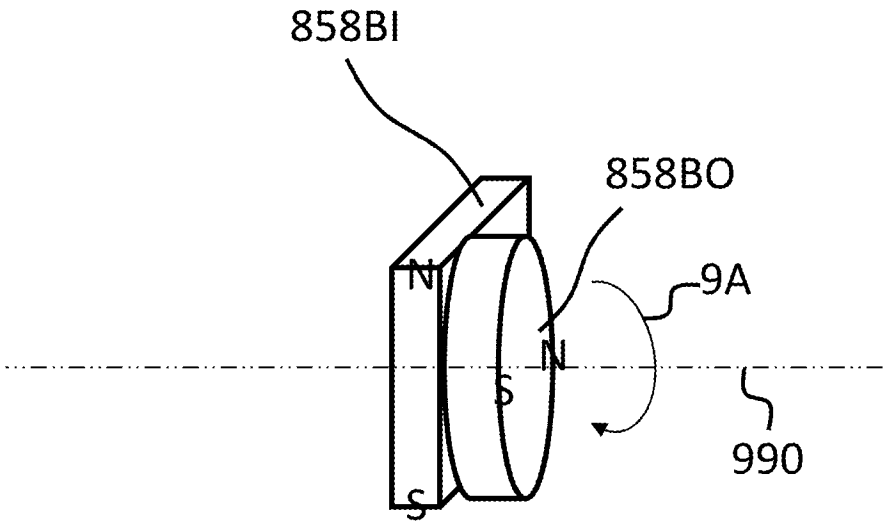
Figure 9C:
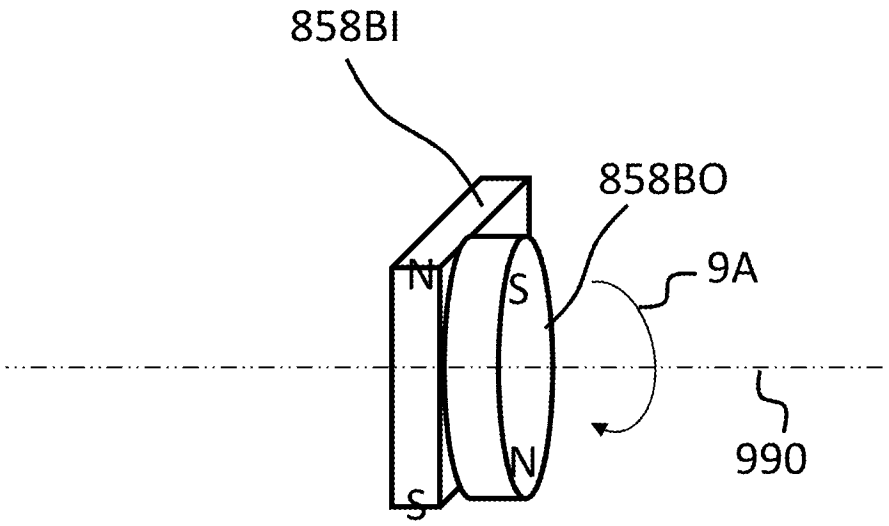

It is noted that while the embodiments described above utilize rotation of magnets relative to one another to alter the strength of the magnetic field between the magnets of the external magnet assembly and the implantable magnet assembly, other modes of moving the magnets relative to one another to vary the strength of the magnetic field can be utilized. By way of example only and not by way of limitation, the sliding movement/translational movement of the magnets relative to one another can be utilized, providing that such will result in the varying of the strength of the magnetic field (e.g. by creating and or varying the magnetic flux short circuit, etc.). That said, there are other embodiments that can utilize rotation and/or other movement of magnets relative to one another. In this regard, FIG. 8 depicts a schematic of an exemplary bone conduction device 800A corresponding to bone conduction device 300 of FIG. 2. In this exemplary embodiment, the implantable component 350A of bone conduction device 800A is the same as that of the bone conduction device 300A. Conversely, the external component 840A has a different configuration than that of external component 340A. Briefly, the permanent magnets that generate, at least in part, the magnetic flux that is utilized to retain the external component 840A to the recipient are located to the sides of transducer 342A, as opposed to between the transducer 342A and the skin of the recipient/skin interface surface 891 of the external component 840A. In an exemplary embodiment of this exemplary embodiment, at least some of the magnets are rotated in a plane parallel with the axis of the attraction force, to vary the attraction force. Instead of the external component 840A being configured such that at least some of the magnets rotate about the longitudinal axis 390 of the bone conduction device 800A, at least some of the magnets are adjustable/rotatable about an axis (990 as seen in FIGS. 9A-9C, discussed below) that is perpendicular to the longitudinal axis 390 and extends through the magnets of the external magnet assembly. That is, instead of the magnets being adjustable globally relative to the external component 840A of the bone conduction device (the magnets can be moved from one side of the external component 340A to the other), the magnets are adjustable locally (the magnets basically occupy the exact same space within the external component 840A, but their orientation in that space can be changed). That said, it is noted that other embodiments can utilize both a global change and a local change of orientation of at least some magnets. Any movement or adjustment of the location of magnets that will enable the teachings detailed herein and/or variations thereof to be practiced can be utilized in at least some embodiments.

In an exemplary embodiment, external component 840A has the functionality of a transducer/actuator, irrespective of whether it is used with implantable component 350A. The external component 340A includes a vibrating actuator represented in black-box format by reference numeral 342A. Any type of an actuator that can enable the teachings detailed herein and/or variations thereof to be practiced can be utilized in at least some exemplary embodiments.

External component 840A includes an external magnet assembly that includes permanent magnets having a North-South alignment. These magnets are locationally adjustable relative to one another, as will be detailed below. However, in the configuration depicted in FIG. 8 (without adjustment as will be detailed below), the magnets on one side of the magnetic assembly, relative to the longitudinal axis 390 of the bone conduction device 300A, all have North poles facing away from the skin of the recipient, and the magnets on the other side of the magnetic assembly relative to longitudinal axis 390 of the bone conduction device all have North poles facing towards the skin of the recipient. That is, the North-South alignment of one side of the external magnet assembly is opposite that of the other side of the assembly. However, exemplary embodiments of the external component 840A are configured such that the individual magnets can be moved so that the poles are different than that depicted in FIG. 8.

The external component 840A includes a bottom surface 891 relative to the frame of reference of FIG. 3) that is configured to interface with the exterior skin of the recipient. In this regard, the bottom of the external component 840A corresponds to plate 346 of FIG. 2 as described above. It is through surface 891 that vibrations generated by the electromagnetic actuator of the external component 840A are transferred from the external component 340A to the skin of the recipient to evoke a hearing percept.

The external magnetic assembly of external component 840A comprises four (4) different magnets arrayed on opposite sides of the longitudinal axis 390 in two sets. (It is noted that in alternative embodiments, more magnets can be used). This is also the case with respect to the embodiments detailed above and any other embodiment, providing that the teachings detailed herein and/or variations thereof can be practiced.) The first set includes outer permanent magnet 858AO and inner permanent magnet 858AI. The second set includes outer permanent magnet 858BO and inner permanent magnet 858BI. As will be detailed more thoroughly below, one or both of the outer permanent magnets of these sets are configured to move relative to the inner permanent magnets of the sets, and/or visa-versa, so as to vary the magnetic flux generated by the external magnetic assembly as a result of magnetic flux addition and cancellation. In this regard, in at least some exemplary embodiments, during operational use of the bone conduction device 800A, the magnets of the external magnet assembly are aligned with the magnets of the implantable magnet assembly such that the poles of the permanent magnets 858AO, 858AI and 358C have a North-South alignment in the same direction and the poles of the permanent magnets 858BO, 858BI and 358D have a North-South alignment in the same direction (but opposite of that of magnets 858AO, 858AI and 358C) in a scenario where maximum attractive force between the external component 840A and the implantable component 350A is desired. Conversely, in at least some exemplary embodiments, during operational use of the bone conduction device 800A, the magnets of the external magnet assembly are aligned with the magnets of the implantable magnet assembly such that the poles of the permanent magnets 858AO and/or 858AI are aligned in a different direction than that of magnet 858C due to the adjustability of the relative position of the magnets 858AO and/or 858AI. Furthermore, in this exemplary embodiment, during operational use of the bone conduction device 800A, the magnets of the external magnet assembly are aligned with the magnets of the implantable magnet assembly such that the poles of the permanent magnets 858BO and/or 858BI are aligned in a different direction than that of magnet 358D because of the adjustability of the relative position of the magnets 858BO and/or 858BI.

The above adjustability can be conceptually seen in FIG. 9A-C, which conceptually depicts isometric views of the 858BI and 858BO magnets of the bone conduction device 800A at various orientations relative to one another. More specifically, FIG. 9A depicts a configuration of the magnets of the external magnet assembly on the right side of the longitudinal axis 390 (relative to FIG. 8) such that the maximum attraction force between the external component 840A and implant component 350A is achieved. Briefly, with respect to the frame of reference of FIGS. 9A-9C, the plane 899 corresponds to the plane of FIG. 8, wherein the plane 899 lies on the longitudinal axis 390 of the bone conduction device 800A.

As can be seen in FIG. 9A, the magnets of the external component are segmented into 2 magnets, one of which is a generally box-shaped magnet 858BI, and one of which is a generally circular-shaped magnet 358BO. Briefly, it is noted that in at least some embodiments, the configurations of magnets 858AI and 858AO corresponds to that of 858BI and 858BO, respectively, except the orientation is reversed (858AO is on the outside, and the South poles of both magnets 858AI and 858AO are located on the top (facing away from the skin).

In embodiments corresponding to FIGS. 9A-9C, the external component 840A is configured such that one or more of the outer magnets 858AO and 858BO can be moved to have a different angular configuration relative to the inner magnets 858AI and 858BI (or visa-versa, or both can be moved in some other embodiments). Accordingly, FIG. 9B depicts the outer magnet 858BO shifted by an angle 90 degrees in the direction of arrow 9A relative to the location of those magnets depicted in FIG. 9A (and thus having an angular offset of 90 degrees relative to the inner magnets 858AI and 858BI). Here, and in FIG. 9C, the locations of inner magnet 858BI are the same as that of FIG. 9A. Also, the locations of the inner magnets 858AI and 358BI, relative to the magnets of the implantable magnet assembly (not shown), are the same in FIGS. 9A-9C.

FIG. 9C depicts the outer magnet 858BO shifted by an angle 180 degrees relative to the location of those magnets depicted in FIG. 9A (and thus having an angular offset of 180 degrees relative to the inner magnets 858AI and 858BI). In these embodiments, whereas the configuration of FIG. 9A results in the strongest attraction force (for a given air gap between the external magnet assembly and the implantable magnet assembly) between the external component 840A and the implantable component 350A, the configuration of FIG. 9C results in the weakest attraction force (again for the given air gap) between the external component 840A and the implantable component 350, with the configuration of FIG. 9B resulting in an attraction force between that resulting from FIG. 9A and FIG. 9C.

The physical phenomenon that results in the differences between the attraction force of the different configurations will now be described, followed by some exemplary embodiments of the structure of the bone conduction device implementing some such embodiments.

Figure 10A:
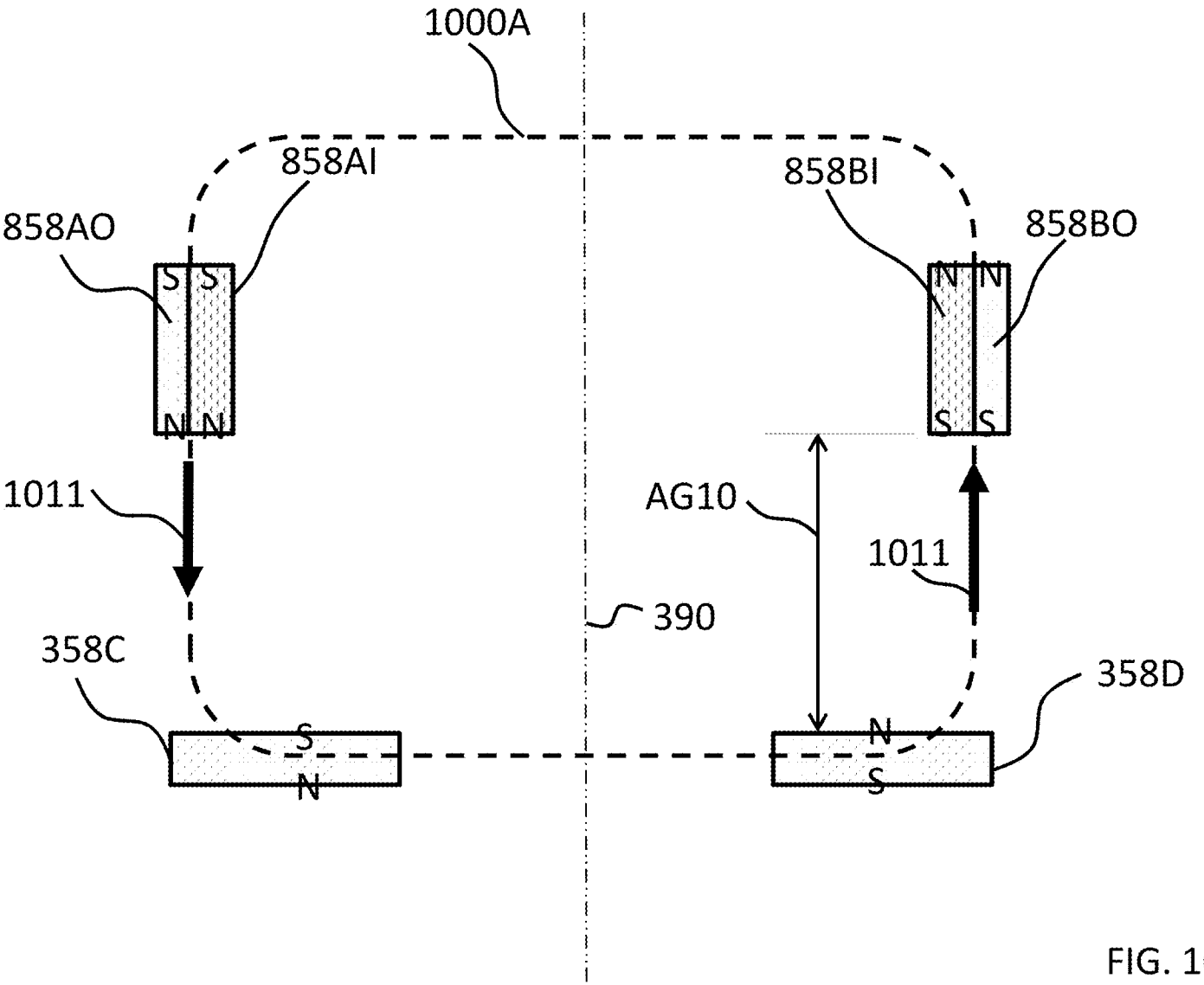
FIGS. 10A-10B are schematic diagrams illustrating exemplary magnetic flux paths of the embodiment of FIG. 3.

FIG. 10A depicts a quasi-functional diagram of a cross-section of the external and implantable magnet assemblies taken through plane 898 (the plane of FIG. 8) with the magnets in the arrangement as presented in FIG. 9A, with the magnetic flux following a magnetic flux path 1000A. FIG. 10A depicts an air gap AG10, representing the space between the external magnet assembly and the implantable magnet assembly. As can be seen, in an exemplary embodiment, the magnetic flux path 1000A travels in a circuit through all of the magnets of the external magnet assembly and the implantable magnet assembly. Arrows 1011 depict the relative localized strength of the magnetic flux and the direction thereof in between the magnets of the external magnet assembly and the implantable magnet assembly (the strength and direction of the magnetic flux at those local locations within the air gap AG10). With respect to the cross-sectional view of FIG. 10A, the magnetic flux travels in a counterclockwise direction, as is represented by arrows 1011, consistent with the fact that all of the poles of the magnets are aligned with the flux path. That said, any direction of magnetic flux that will enable the teachings detailed herein and/or variations thereof to be practiced can be utilized in at least some embodiments.

Figure 10B:
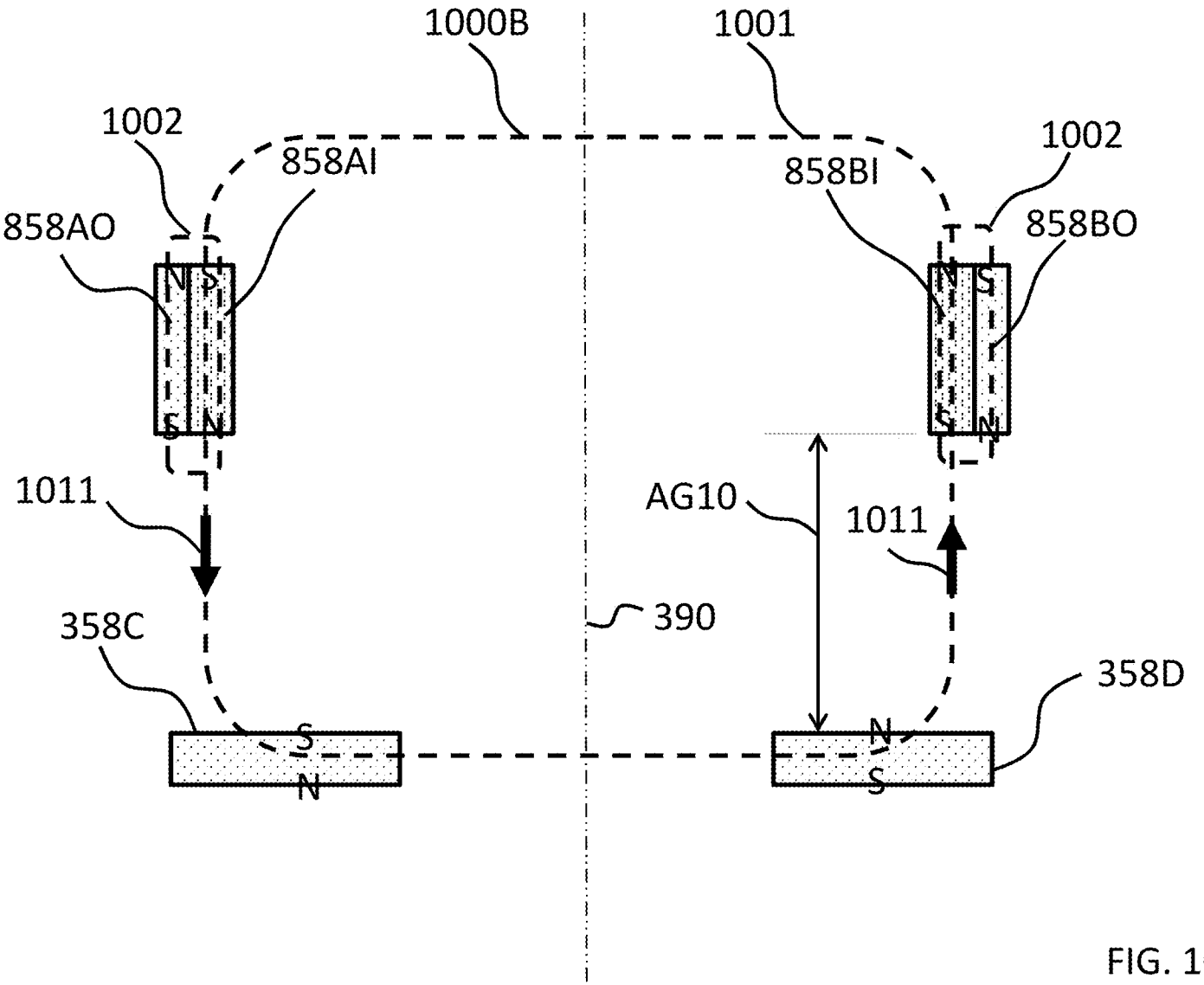

Conversely, FIG. 10B depicts a quasi-functional diagram of a cross-section of the external and implantable magnet assemblies also taken through plane 899 (the plane of FIG. 8) with the magnets in the arrangement as presented in FIG. 9C, with the magnetic flux path 1000B superimposed thereon. FIG. 10B depicts an air gap AG10, representing the space between the external magnet assembly and the implantable magnet assembly. The air gap AG10 is the same distance as that of FIG. 10A in this exemplary embodiment.

As can be seen, in an exemplary embodiment, the magnetic flux has a magnetic flux path 1000B that includes multiple components. First, a flux path 1001 that travels in a circuit through all of the magnets of the external magnet assembly and the implantable magnet assembly, at least generally concomitant with the flux path 1000A of FIG. 10A vis-à-vis directionality. However, as can be seen, the magnetic flux path 1000B also includes flux paths 1002 that travel in a circuit only through the local magnets in either side of the longitudinal axis 390 of the bone conduction device 800A. That is, as can be seen, there is a magnetic flux path 1002 that travels in a circuit between magnets 858AO and 858AI, owing to the fact that the directionality of the poles of these magnets are opposite relative to the longitudinal axis 390. The same as the case with respect to magnets 858BO and 858BI. Generally speaking, the magnetic flux paths 1002 represent a short-circuit in the magnetic flux path 1000A of FIG. 10A that limits the magnetic interaction between the magnets of the external magnet assembly and the magnets of the implantable magnet assembly relative to that which would be the case in the absence of the short-circuiting. In at least some embodiments, because of these localized magnetic flux paths 1002, the strength of the magnetic flux between the magnets of the external magnet assembly and the implantable magnet assembly (the strength within the air gap AG10) is lower relative to that of FIG. 10A. This is functionally represented by arrows 1011 in FIG. 10B, which are smaller than those of FIG. 10A. Accordingly, the resulting retention force holding the external component 350A against the skin of the recipient is lower than the resulting retention force of the magnetic flux of FIG. 10A.

Accordingly, in at least some exemplary embodiments, the bone conduction device 800A is configured such that the strength of the magnetic field generated (at least in part) by the external component can be varied for a given air gap AG10 and a given orientation of the external component 840A relative to the implantable component 350A, by establishing a short circuit of the magnetic flux and controlling the magnitude of that short-circuit. That is, by way of example only and not by way of limitation, holding all other variables constant, the combined magnetic flux that retains the external component 840A to the implantable component 350A can be varied such that the resulting retention force that holds the external component 340A to the skin of the recipient is also varied by locally (as opposed to globally, with respect to the embodiment of FIG. 3) adjusting the orientation of at least one permanent magnet of the external component 840A relative to another permanent magnet of the external component 840A, and thereby creating and or adjusting the short-circuit in the magnetic flux.

Figure 11A:
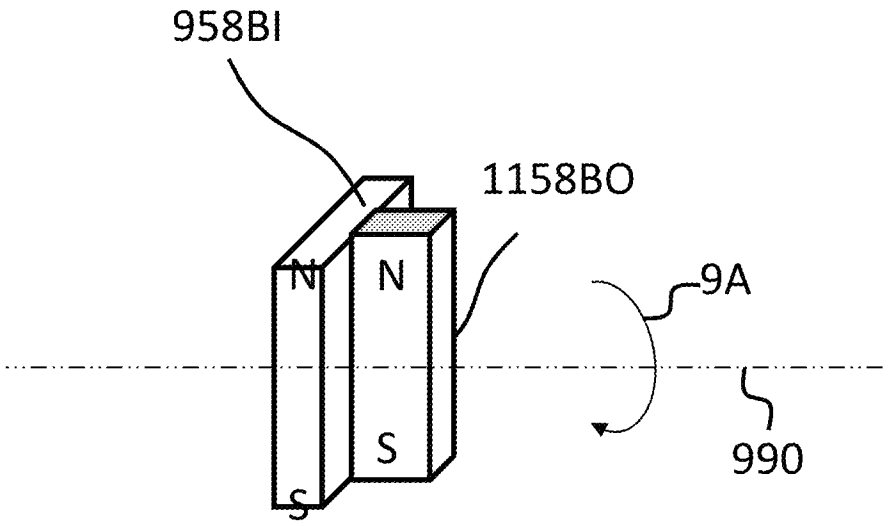
FIGS. 11A-13B are schematic diagrams illustrating adjustment of components of an exemplary embodiment.

It is noted that the embodiments detailed herein are simply exemplary. The shapes of the magnetic components and the movements thereof are simply exemplary. For example, while the embodiment of FIG. 8 utilizes a box shaped inner magnets and circular outer magnets, all of the magnets can be box shaped or all of the magnets can be circular shaped. Other shapes can be utilized, such as octagon shapes, hexagon shapes, bar shapes (see, for example, magnet 1158BO of FIG. 11A, which can stand in the place of and/or be added to magnet 858BO, which is rotatable in the direction of arrow 9A about axis 990, to adjust the magnetic flux and thus the retention force) etc. Any shape of magnet that can enable the teachings detailed herein and or variations thereof to be practiced can utilize in at least some embodiments.

Figure 11B:
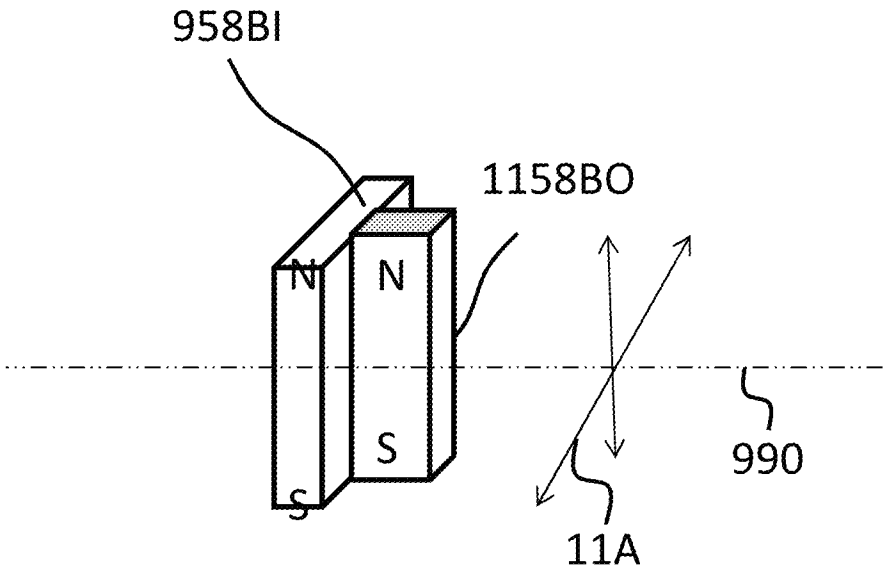

Still further by way of example, as noted above, any type of movement of magnets relative to one another, locally and or globally relative to the external component of a prosthesis, that can enable the teachings detailed herein and/or variations thereof to be practiced can be utilized in at least some embodiments. In this regard, FIG. 11B depicts an example of an arrangement where bar magnet 1158BO is movable in the directions of arrows 11A relative to magnet 958BI so as to adjust the magnetic flux and thereby vary the resulting force between the external component and the implantable component. It is noted that bar magnet 1158BO can be moved in other directions as well. In at least some embodiments, any movement of the bar magnet 1158BO that can adjust the magnetic flux (e.g., by changing the local path of the magnetic flux via the movement of the magnets in the noted directions, the magnetic flux is adjusted) that can vary the retention force can be used in some embodiments.

Figure 11C:
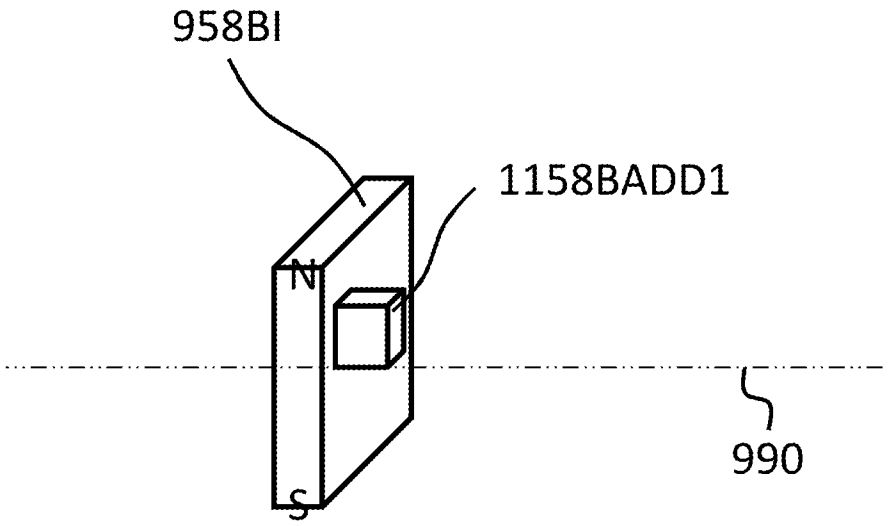
Figure 12:
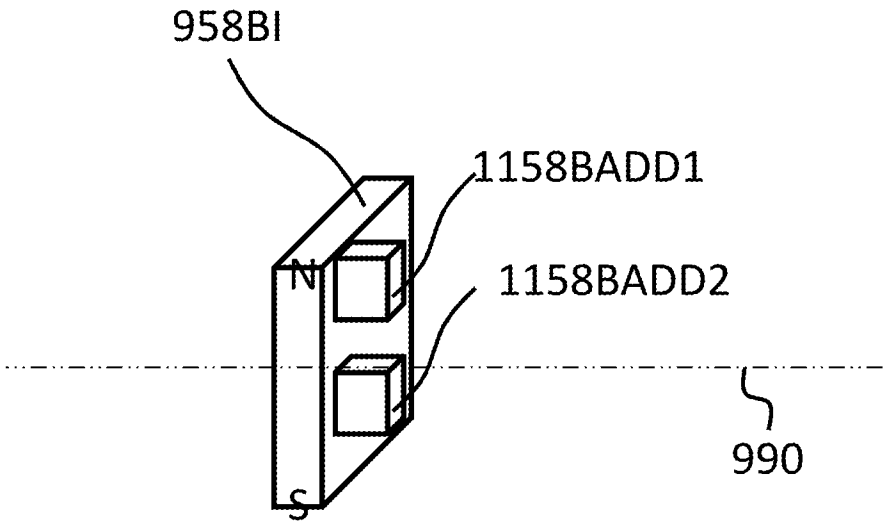

It is also noted that in alternate embodiments, magnets can be added and removed from the external magnet assembly to vary the magnetic flux, and thus the retention force between the external component and the implantable component. FIG. 11C and FIG. 12 depict such an embodiment, where FIG. 11C depicts the addition of magnet 1158BADD1, and FIG. 12 depicts the addition of two magnets, the magnet 1158BADD1 and a new magnet, 1158BADD2. The resulting magnetic flux will be different for the two configurations of FIGS. 11C and 12. Any number of magnets that can be added and/or removed to vary the flux, and thus the attraction force, can be utilized in at least some embodiments, providing that the teachings detailed herein and/or variations thereof can be practiced.

Still further, the magnets that are movable relative to other magnets can be moved in an intrusive and/or penetrative manner. By way of example only and not by way of limitation, while the embodiments detailed above have been presented in terms of the magnets being located separate from one another (albeit touching and/or not touching some instances—it is noted that the magnets do not need to touch one another in some embodiments, while in other embodiments the magnets can touch one another), some embodiments can be configured such that the movable magnet moves in and out of the fixed magnet. By tangential analogy, such arrangement can be analogous to the control rods of a nuclear reactor, where the depth of insertion and/or retraction of the control rods controls the nuclear reaction. In a similar vein, the depth of insertion and/or retraction of one magnet into another magnet can control the resulting magnetic force that retains the external component to the implantable component.

Accordingly, in an exemplary embodiment, there is an apparatus, such as a bone conduction device (e.g., any of the bone conduction devices detailed herein), having a first and second permanent magnet. In at least some exemplary embodiments, the apparatus is configured such that the first permanent magnet can be moved from a location where the first permanent magnet is within the second permanent magnet to a location at least substantially outside the second permanent magnet (including entirely outside the second permanent magnet) so as to decrease the strength of the magnetic field, and thus decrease the retention force of the external component.

Figure 13A:
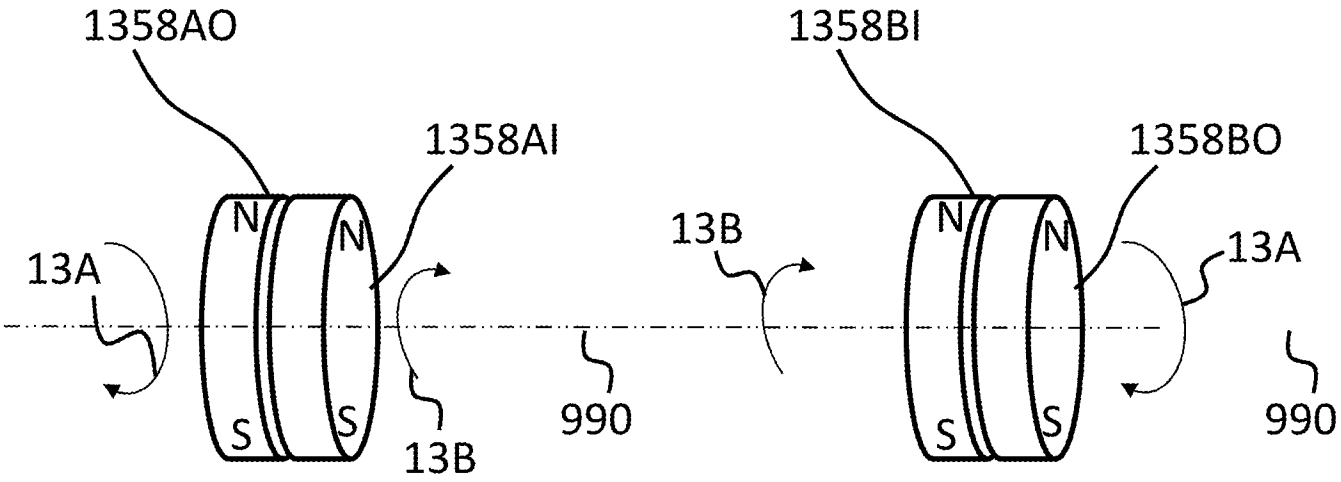

As noted above, the embodiments also include external magnet assemblies where both magnets of a set of magnets can move relative to one another. FIG. 13A functionally depicts such an exemplary embodiment, where magnets 1358BI and 1358BO take the place of magnets 858BI and 858BO of the embodiment of FIG. 8, and magnets 1358AI and 1358AO take the place of magnets 858AI and 858AO. As can be seen by comparing FIG. 13A to FIG. 13B, the magnets 1358BO and 1358AO can be rotated in the direction of arrow 13A and the magnets 1358BI and 1358AI can be rotated in the direction of arrow 13B to vary (in this exemplary embodiment, reduce) the resulting attraction force adhering the external component to the recipient. It is noted that in some embodiments, the local magnets can be linked together such that rotation of one of the magnets results in an equal and opposite rotation of the other magnet and/or the magnets can be linked together globally such that rotation of the magnet on one side results in rotation of the corresponding magnet on the other side by, in an exemplary embodiment, the same amount and in the same direction (or in a different direction and/or by a different amount in an alternate embodiment). That said, in an alternative embodiment, the magnets can be rotated independently. Still further, in at least some embodiments, the magnitude of the rotation of the one of the magnets can be different than the magnitude of the rotation of the other magnets, the magnets can be both rotated in the same direction, either by the same amount or by different amounts. Is further noted that different magnetic attraction can be used to offset, or more accurately, balance out forces resulting from gravity on the external component, by making the retention force of a magnet located at a higher elevation greater than the retention force a magnet located at a lower elevation. In this regard, in an exemplary embodiment, a torque is applied to the external component owing to gravity. The compressive force between the external component and the skin of the recipient is naturally greater at the lower elevation relative to the upper elevation owing to this torque, all things being equal. Accordingly, by increasing the magnetic force at the higher elevation, or, more accurately, making the magnetic force that is present at the higher elevations stronger than that of the lower elevation, the resulting compressive force can be made to be more uniform, including uniform, across the span of the recipient interface surface from the upper elevation to the lower elevation.

Figure 13B:
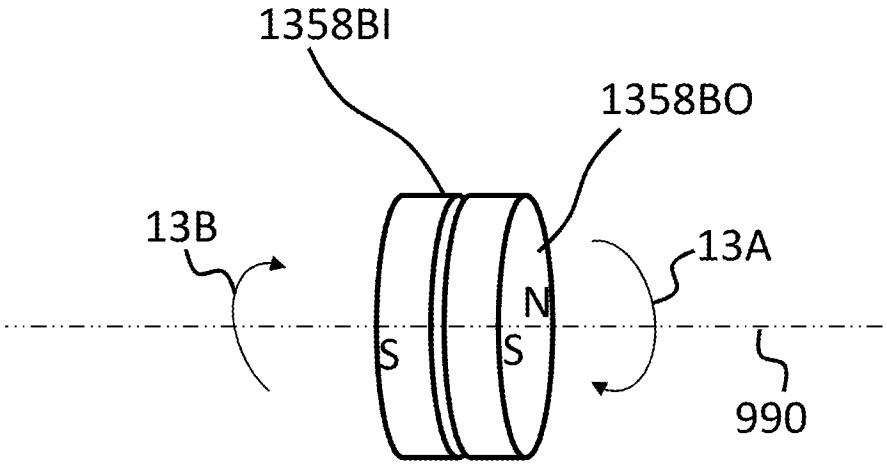

While the embodiment of FIGS. 13A and 13B depict the use of two magnets in a given set (two magnets on one side of the longitudinal axis 390 and two magnets on the other side of longitudinal axis 390), additional magnets can be used in a given set. Note further that it is not necessary for the magnets to be the same in number for every set. For example, the set of magnets on one side of the longitudinal axis 390 can contain 3 magnets, while another set only contains 2 magnets. Any arrangement of magnets that can enable the teachings detailed herein and/or variations thereof to be practiced can be utilized in at least some embodiments.

Figure 14:
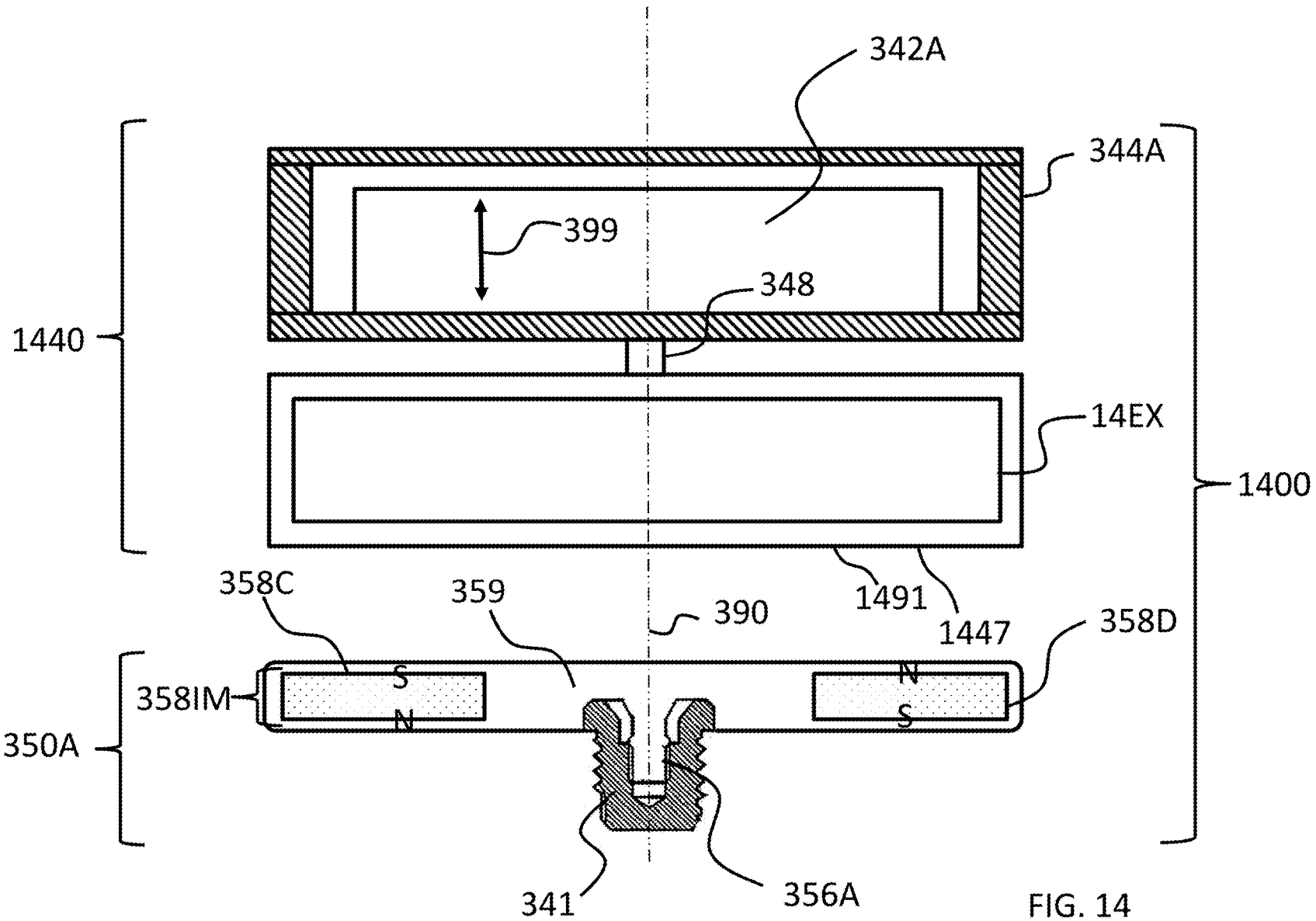
FIG. 14 depicts another exemplary embodiment.

FIG. 14 depicts a schematic of another exemplary bone conduction device 1400 corresponding to bone conduction device 300 of FIG. 2. In this exemplary embodiment, the implantable component 350A of bone conduction device 1400 is the same as that of the bone conduction device 300A. Conversely, the external component 1440 has a different configuration than that of external component 340A. Briefly, the permanent magnets that generate, at least in part, the magnetic flux that is utilized to retain the external component 1400 to the recipient are located within black box 14EX in a stacked manner (relative to the longitudinal axis 390). In an exemplary embodiment of this exemplary embodiment, at least some of the magnets are flipped and/or rotated to vary the attraction force. Additional details of this configuration will now be provided.

In an exemplary embodiment, external component 1440 has the functionality of a transducer/actuator, irrespective of whether it is used with implantable component 350A. The external component 1440 includes a vibrating actuator represented in black-box format by reference numeral 342A. Any type of an actuator that can enable the teachings detailed herein and/or variations thereof to be practiced can be utilized in at least some exemplary embodiments.

External component 1440 includes an external magnet assembly that includes permanent magnets having a North-South alignment. These magnets are locationally adjustable relative to one another, as will be detailed below.

Figure 15A:
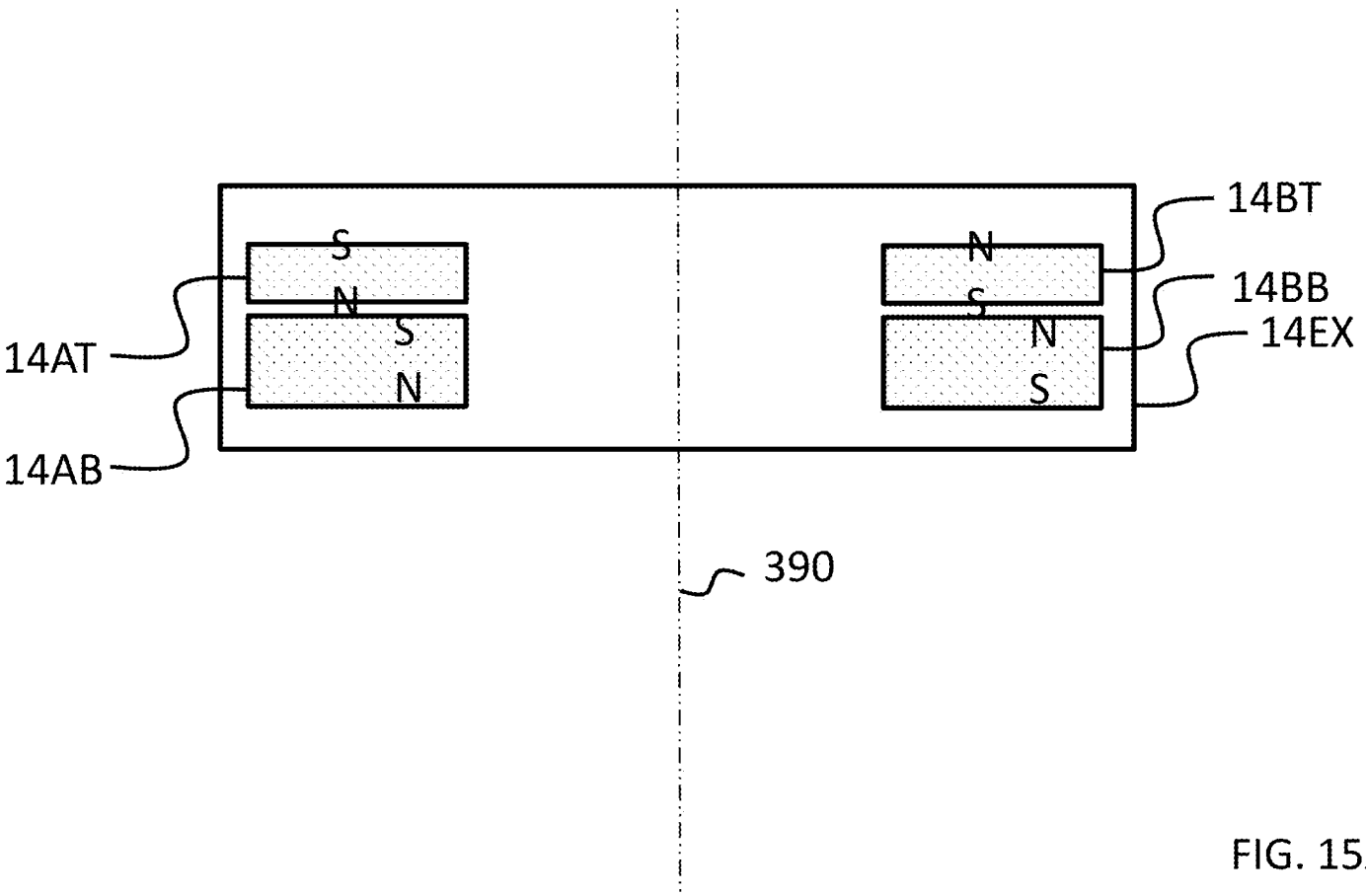
FIGS. 15A-17C depict exemplary magnet configurations of the exemplary embodiment of FIG. 14.

FIG. 15A depicts a cross-section of external black box 14EX and the magnets located therein. More specifically, as can be seen, 14EX includes four (4) magnets. It is noted that while FIG. 15A only depicts the cross-sections of the respective magnets, the magnets are half-washer shaped magnets corresponding to the configuration of the magnets used in the embodiment of FIG. 3 above. As can be seen, 14EX includes bottom magnets 14AB and 14BB and top magnets 14AT and 14BT, where the bottom magnets are thicker than the top magnets, and, in at least some embodiments, are thus stronger than the top magnets (their presence results in a stronger attraction force relative to that which would be the case if only the thinner magnets were utilized, all other variables held constant). In this regard, in an exemplary embodiment, the magnets can be substituted with different magnets of different thicknesses/different strengths, to obtain a desired magnetic flux between the external component and the implantable component, and thus obtain a desired retention force between those two components. By way of example only and not by way of limitation, magnets 14AT and 14BT can be replaced with magnets 14AB and 14BB respectively (meaning that 14EX will now include two magnets 14BB, one on top of the other, and will include two magnets 14AB, one on top of the other), or, alternatively, magnets 14AB and 14BB can be replaced with magnets 14AT and 14BT, respectively, etc.). In alternate embodiments, different magnets of different configurations can be utilized (i.e., magnets resulting in different strengths can be utilized so as to vary the resulting retention force between the external component and the implantable component).

Figure 15B:
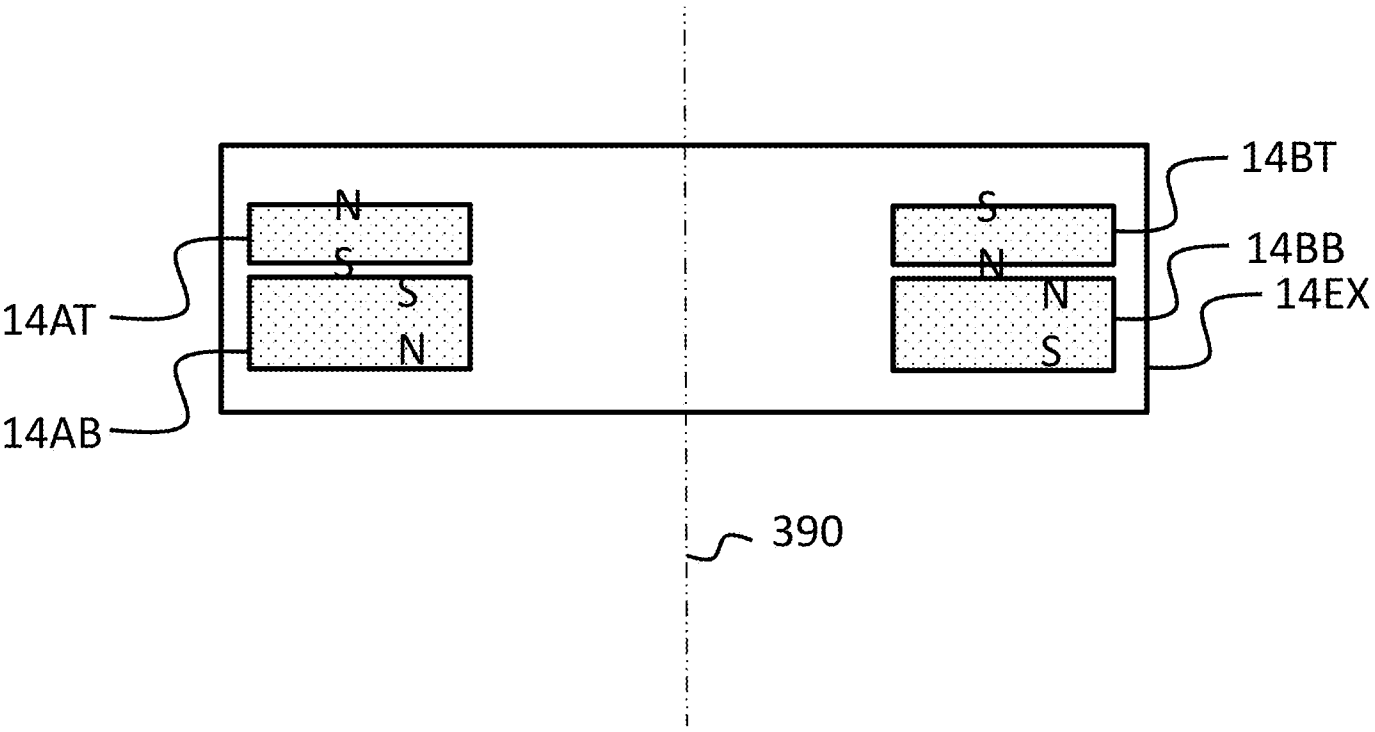
Figure 15C:
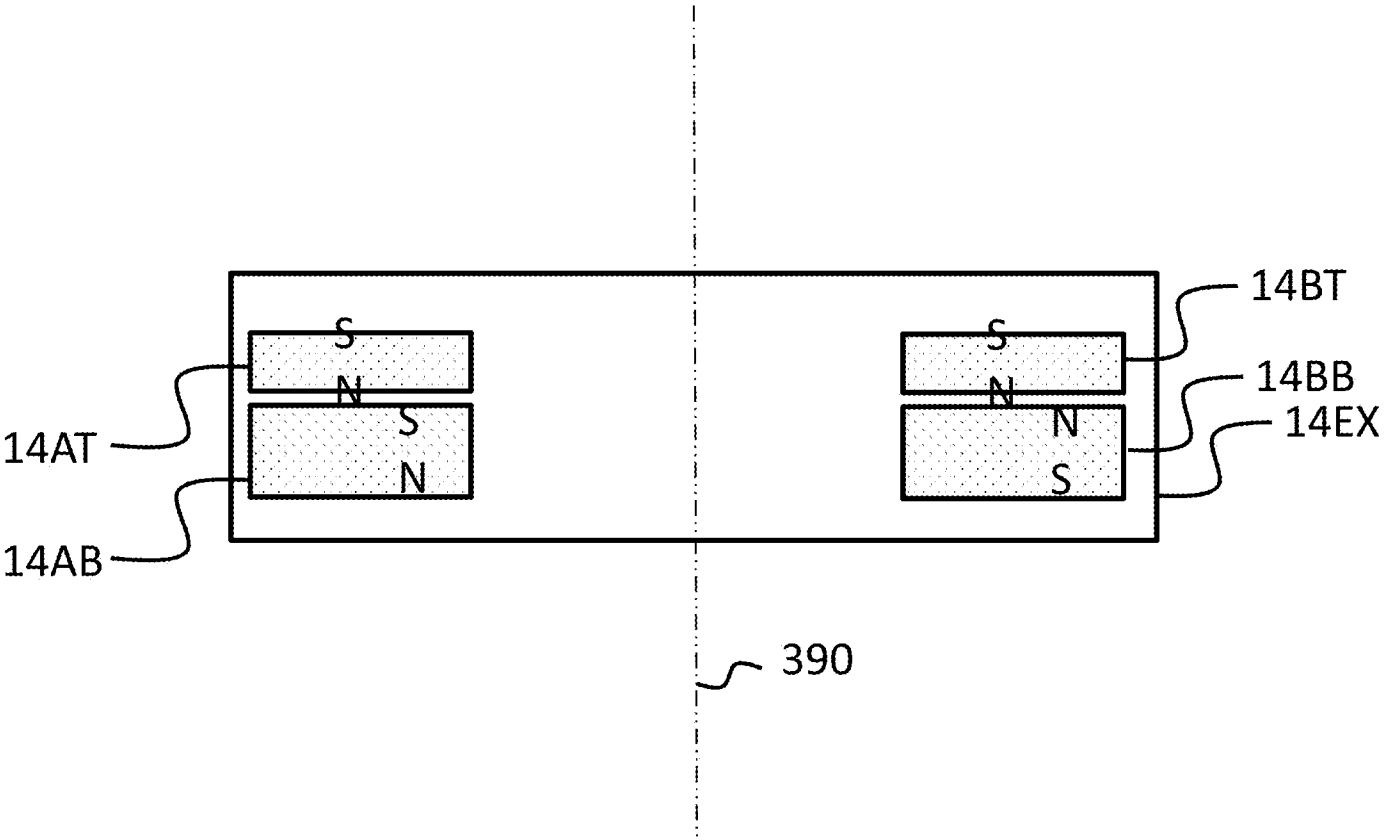

That said, in an alternate embodiment, one that reduces the number of "additional components" that would be provided with a given bone conduction device, one or more of the magnets within 14EX can be flipped over to vary the magnetic flux, and thus the force retaining the external component to the recipient. Accordingly, FIG. 15B depicts magnets 14BT and 14AT flipped over such that their poles are reversed with respect to the longitudinal axis 390 relative to that which was the case in FIG. 15A. (FIG. 15A depicts a cross-sectional view through half-ring magnets corresponding in shape to those of FIG. 4A detailed above. It is noted that in alternate embodiments, other configurations of the magnets can be used.) Here, the resulting retention force between the external component and the implantable component, all other variables being held constant, is lower than that which is the case in the configuration of FIG. 15A. Still further, FIG. 15C depicts magnet 14BT flipped over but not magnet 14AT such that the poles are reversed with respect to the longitudinal axis 390 relative to that which was the case in FIG. 15A. Here, the resulting retention force between the external component and the implantable component, all other variables being held constant, is lower than that which is the case in the configuration of FIG. 15A, but higher than that which is the case in the configuration of FIG. 15B.

Figure 16A:
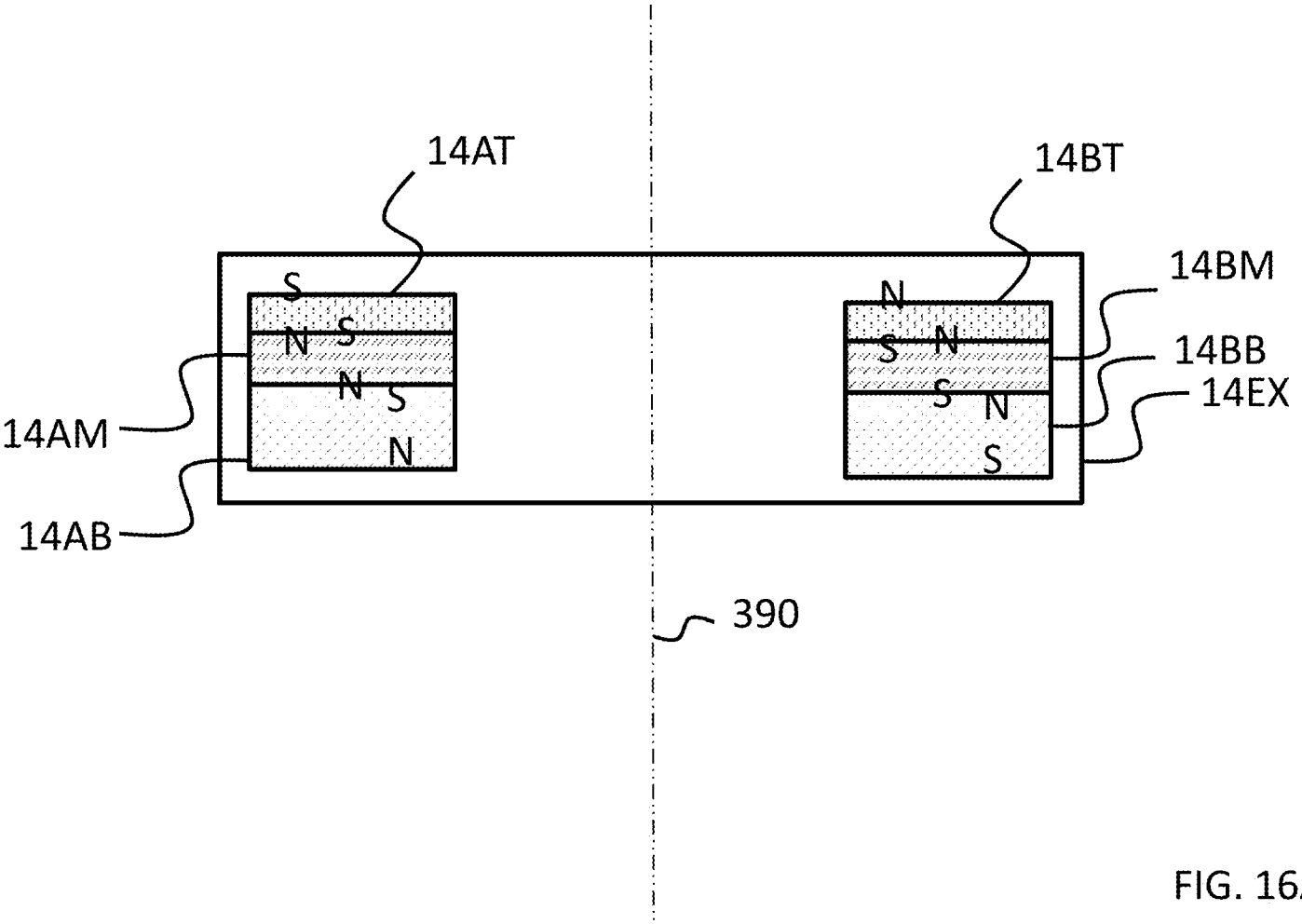
Figure 16B:
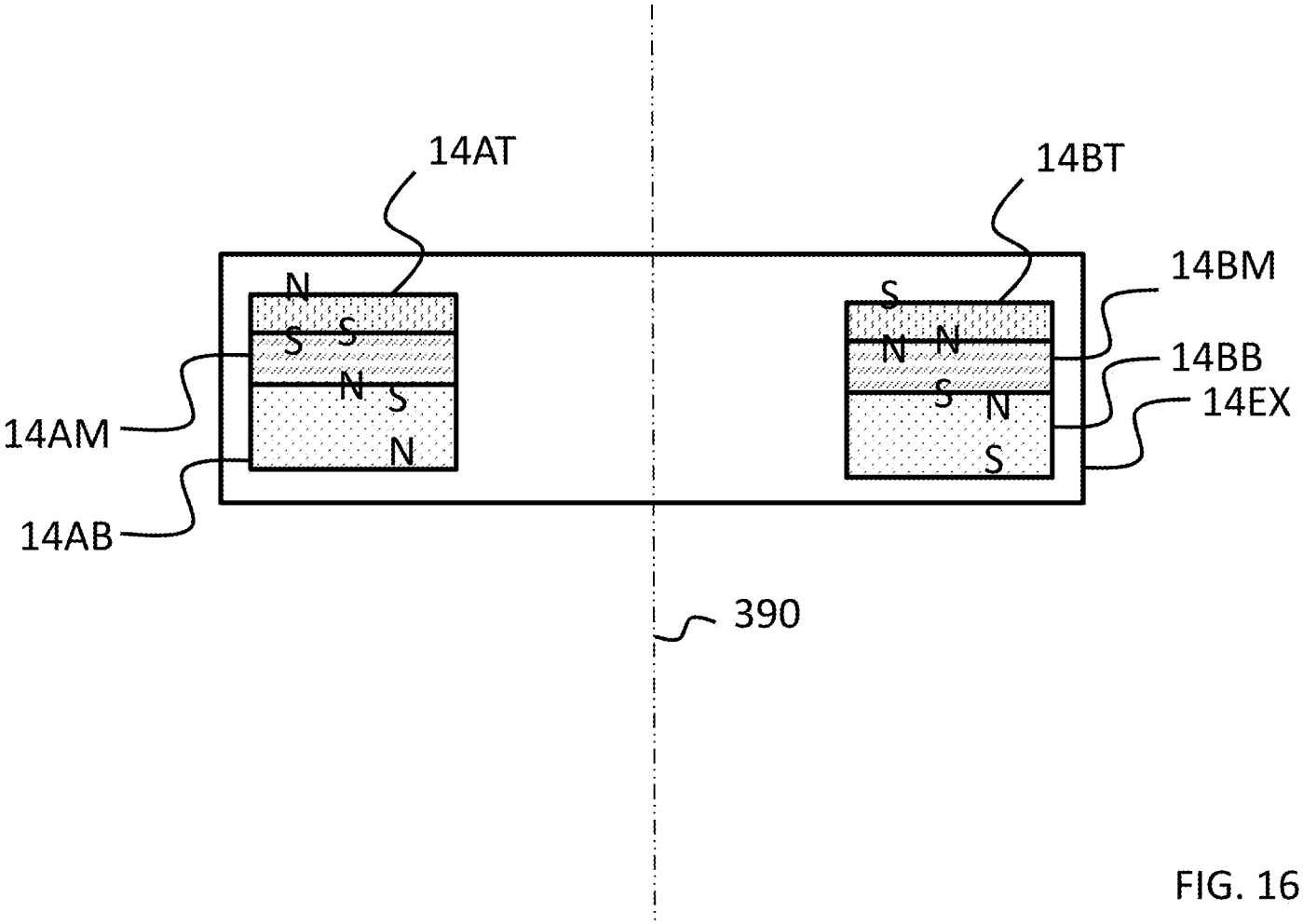

FIG. 16A depicts a variation of the embodiment of FIGS. 15A-C, where a fifth and sixth magnet, middle magnets 14AM and 14BM, are interposed between the magnets of the embodiment of FIGS. 15A-C. In the arrangement of FIG. 16A, all of the poles of the magnets are aligned so as to result in a maximum retention force between the external component of the bone conduction device 1440 and the implantable component. Conversely, FIG. 16B depicts an arrangement where the top magnets, magnets 14BT and 14AT, are flipped over relative to that which was the case for the configuration of FIG. 16A, thus resulting in a weaker retention force than that which is the case for the configuration 16A. Of course, other magnets can be flipped as well instead of and/or in addition to the top magnets. Any variety of arrangements in stacking and flipping that will enable the teachings detailed herein and/or variations thereof to be practiced can be utilized in at least some embodiments. Note further that in at least some embodiments, not only are the magnets flippable, as seen in the embodiments of FIGS. 15A-16B, but they can also be rotated and/or transversely moved as well. Indeed, it is noted that in at least some embodiments, there are some embodiments that combine one or more or all of the teachings detailed herein with one or more or all of the other teachings herein. Any combination of the teachings detailed herein that will enable the retention force between the external component and the implantable component to be varied in a utilitarian manner can be utilized in at least some embodiments.

Still with reference to FIGS. 15A-16B, it is noted that the embodiments of FIGS. 15A-15C have gaps between the magnets of a given set (e.g., magnet 14BT does not directly contact magnet 14BB). Conversely, as can be seen in FIGS. 16A-16B, the magnets contact each other. In this regard, in at least some embodiments, the magnetic flux generated at least in part by the external component can be varied, and thus the resulting retention force can be varied, by varying the distance in the longitudinal direction (i.e., along the length of the longitudinal axis 390) between one or more of the magnets. Accordingly, in an exemplary embodiment, the external component of the bone conduction device is configured such that the distance in the stack direction (along the longitudinal axis 390) between one or more of the magnets can be varied. This can be done using a mechanical device built into the bone conduction device and/or can be done by hand (e.g., shimming or the like). Again, any manner of moving the magnets relative to one another and/or relative to the overall geometry of the external component of the bone conduction device that will enable the magnetic flux to be varied, and thus the retention force to be varied, can be utilized providing the teachings detailed herein and/or variations thereof can be practiced.

Figure 17A:
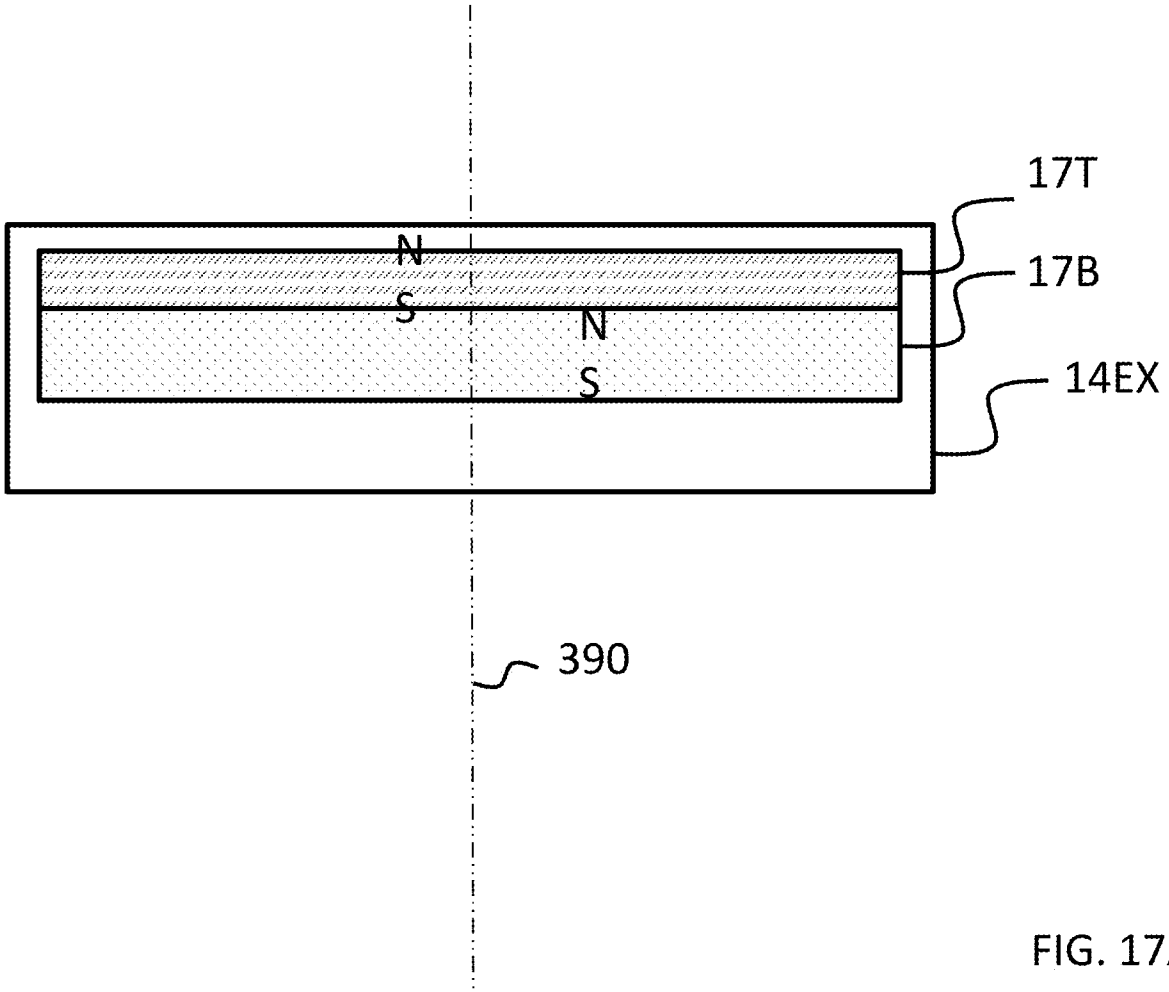
Figure 17B:
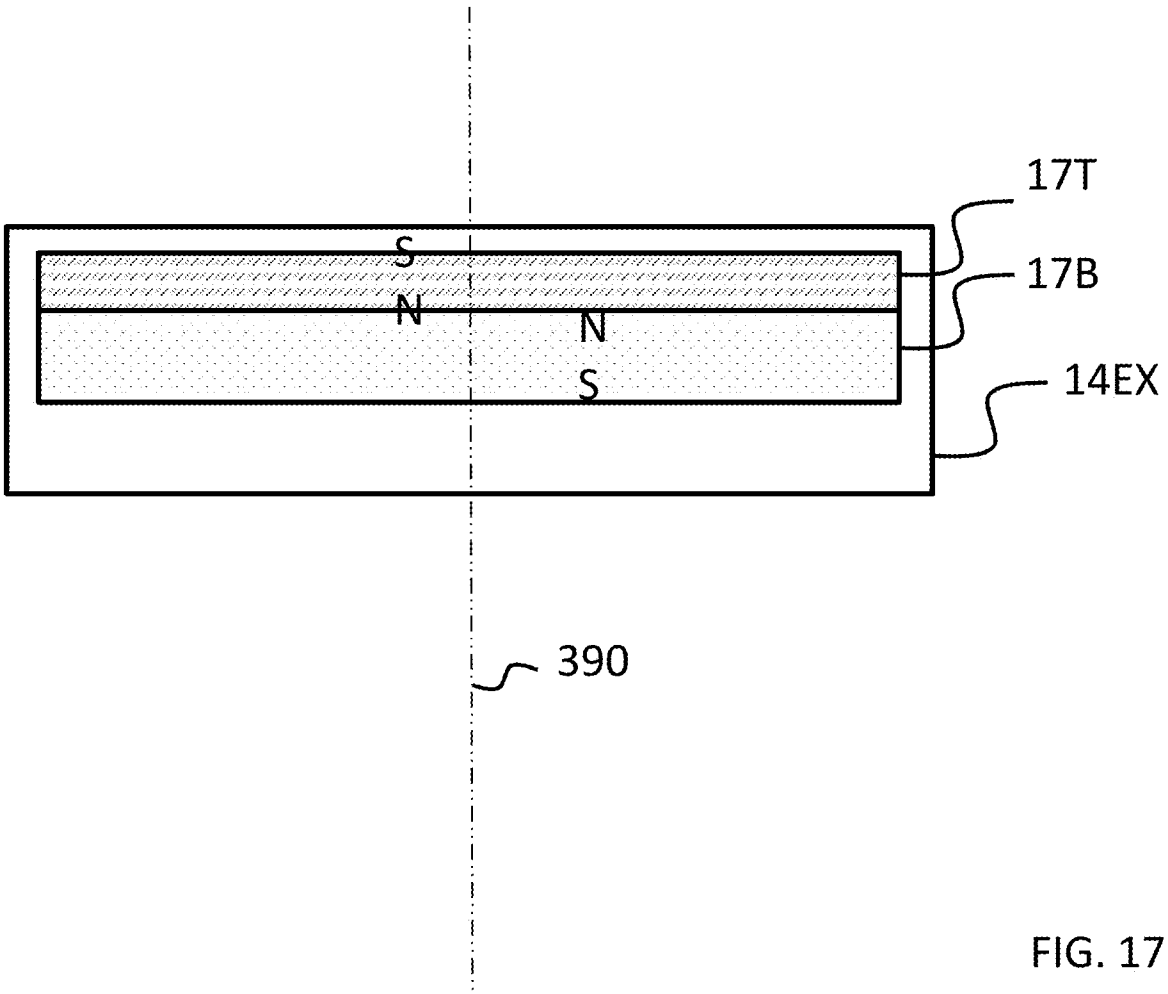

It is noted that the embodiments detailed herein up till now have focused on magnets in separate sets located on different sides of the longitudinal axis 390. There are alternate embodiments where the magnet(s) of the external component extends all the way from one side of the longitudinal axis 390, through the longitudinal axis 390, the other side of longitudinal axis 390. In an exemplary embodiment, the magnets are solid disks. FIG. 17A depicts a cross-sectional view of 14EX that utilizes one such embodiment. As can be seen, there are 2 separate magnets, top magnet 17T and bottom magnet 17B. Concomitant with the teachings detailed above, one or both of the magnets 17B and 17T can be flipped and/or moved relative to one another to vary the strength of the magnetic field. FIG. 17B depicts the top magnet 17T flipped relative to that which is the case in FIG. 17A, which results in a retention force that is different, all other factors being held constant.

Figure 17C:
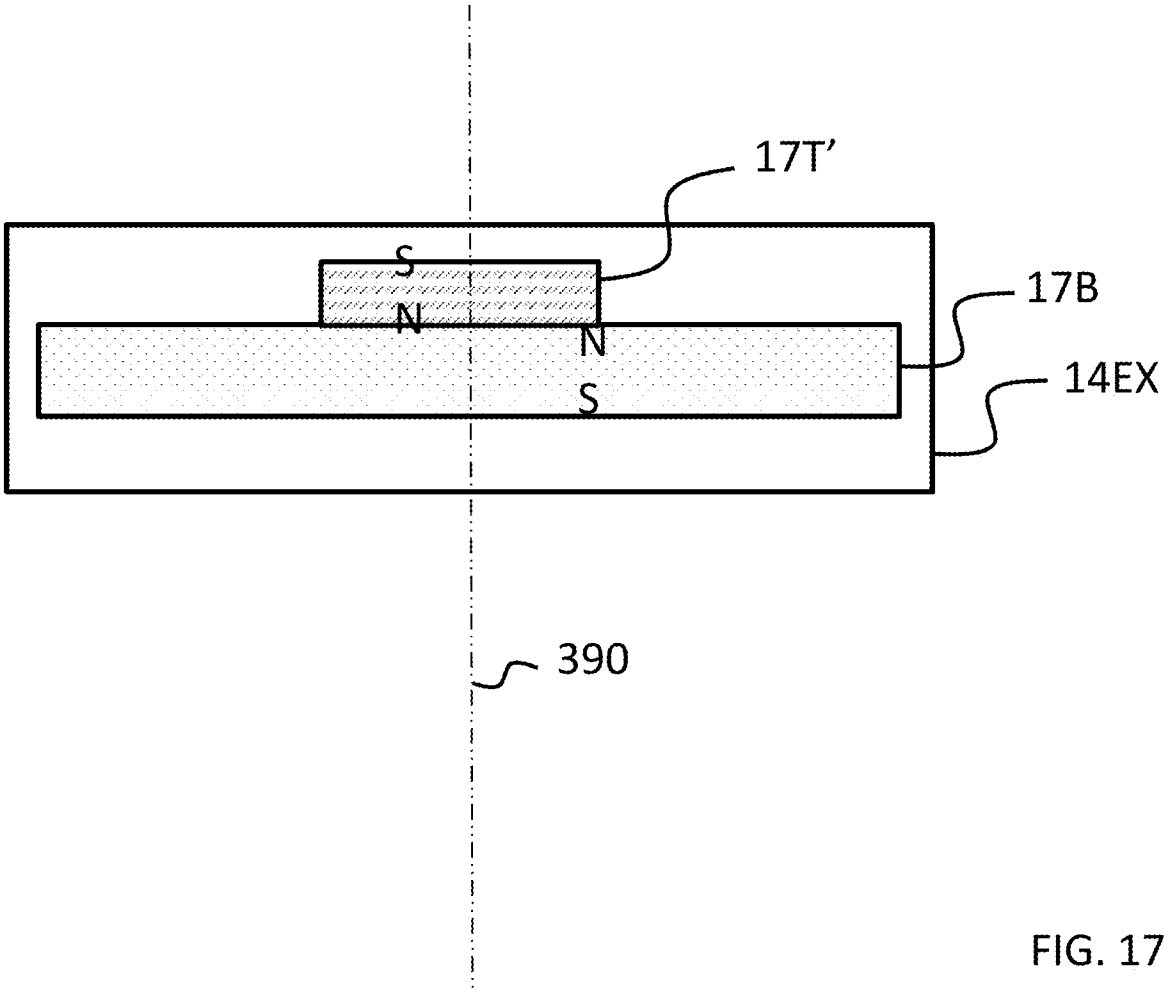

FIG. 17C depicts yet another alternate embodiment where a magnet 17T' is utilized having a different volume/outer diameter than that of magnet 17T. In at least some exemplary embodiments, because magnet 17T' is smaller than the magnet 17T, the resulting retention force should be less than that which is the case if magnet 17T' of FIG. 17C was replaced with magnet 17T, all other variables held constant.

It is noted that while not shown in the embodiments of FIGS. 17A-17D, the magnet of the implantable component can also be a single solid disk magnet (or a stack of such magnets).

Figure 18A:
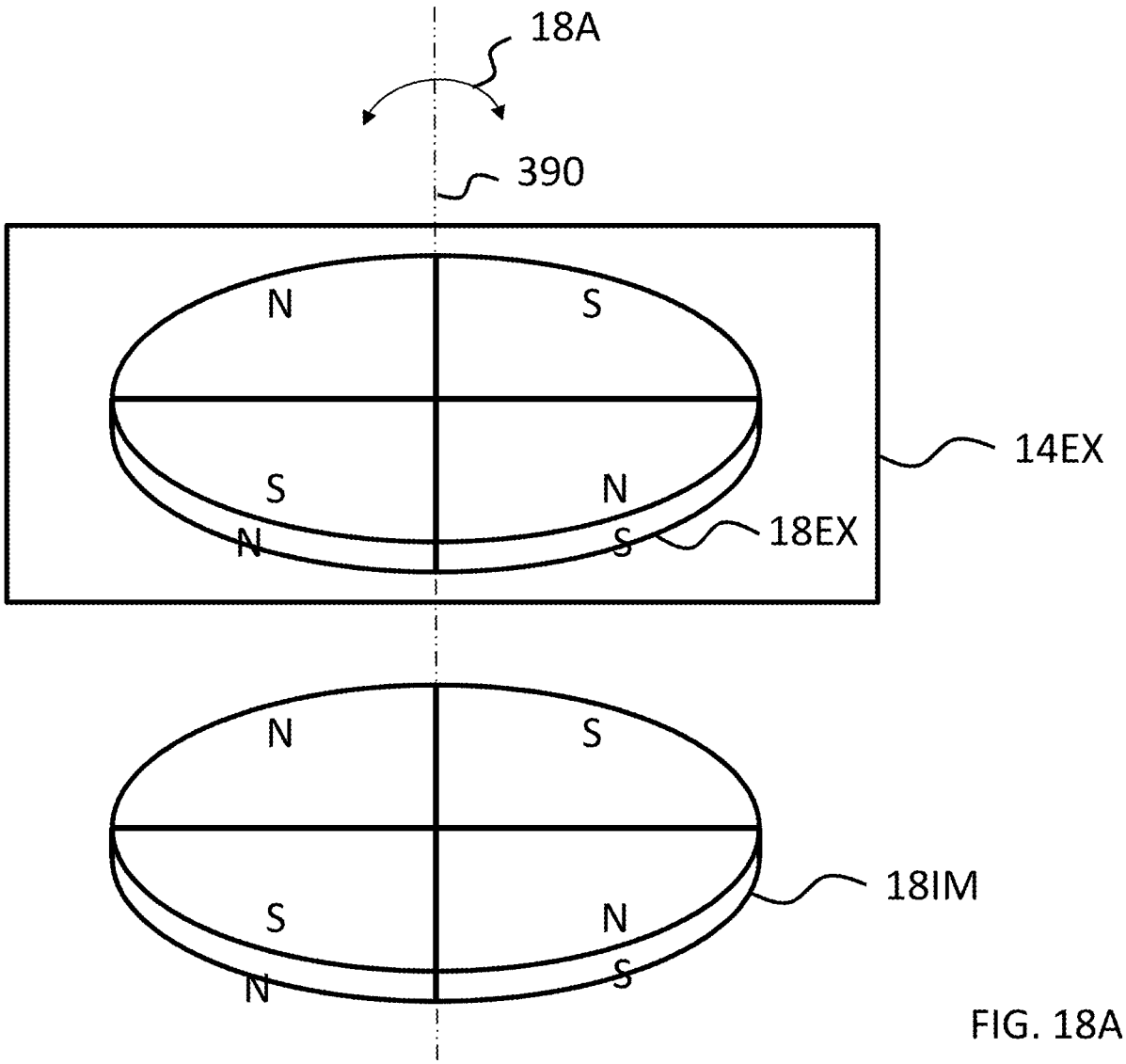
FIGS. 18A-20C depict other exemplary magnet configurations of the exemplary embodiment of FIG. 14.

FIG. 18A presents yet another embodiment, where a segmented disk magnet 18EX is located in 14EX of the external component 1400. As can be seen, segmented disk magnet 18EX includes four (4) quarter-pie shaped components of varying North-South polarity. The implantable component also includes a segmented disk 18IM that also includes four (4) quarter-pie shaped components of varying North-South polarity. In an exemplary embodiment, the external component is configured such that magnet 18EX can be rotated about axis 390 relative to the other components of the external component of the bone conduction device (e.g., the sound processor, etc.) as indicated by arrow 18A to vary the resulting magnetic field between magnet 18EX and magnet 18IM in the implantable component, and thus vary the resulting attraction force between those two components. In some embodiments, the surface of the external component that interfaces with the skin can be coated with a high friction material that will limit or otherwise reduce the tendency of the external component to rotate relative to the surface of the skin towards alignment of the magnetic poles/towards an orientation that has a higher attraction force. That is, in at least some embodiments, the surface is of a configuration that effectively prevents rotation of the external component beyond that which results from normal skin deformation due to torque applied by the magnetic field.

Figure 18B:
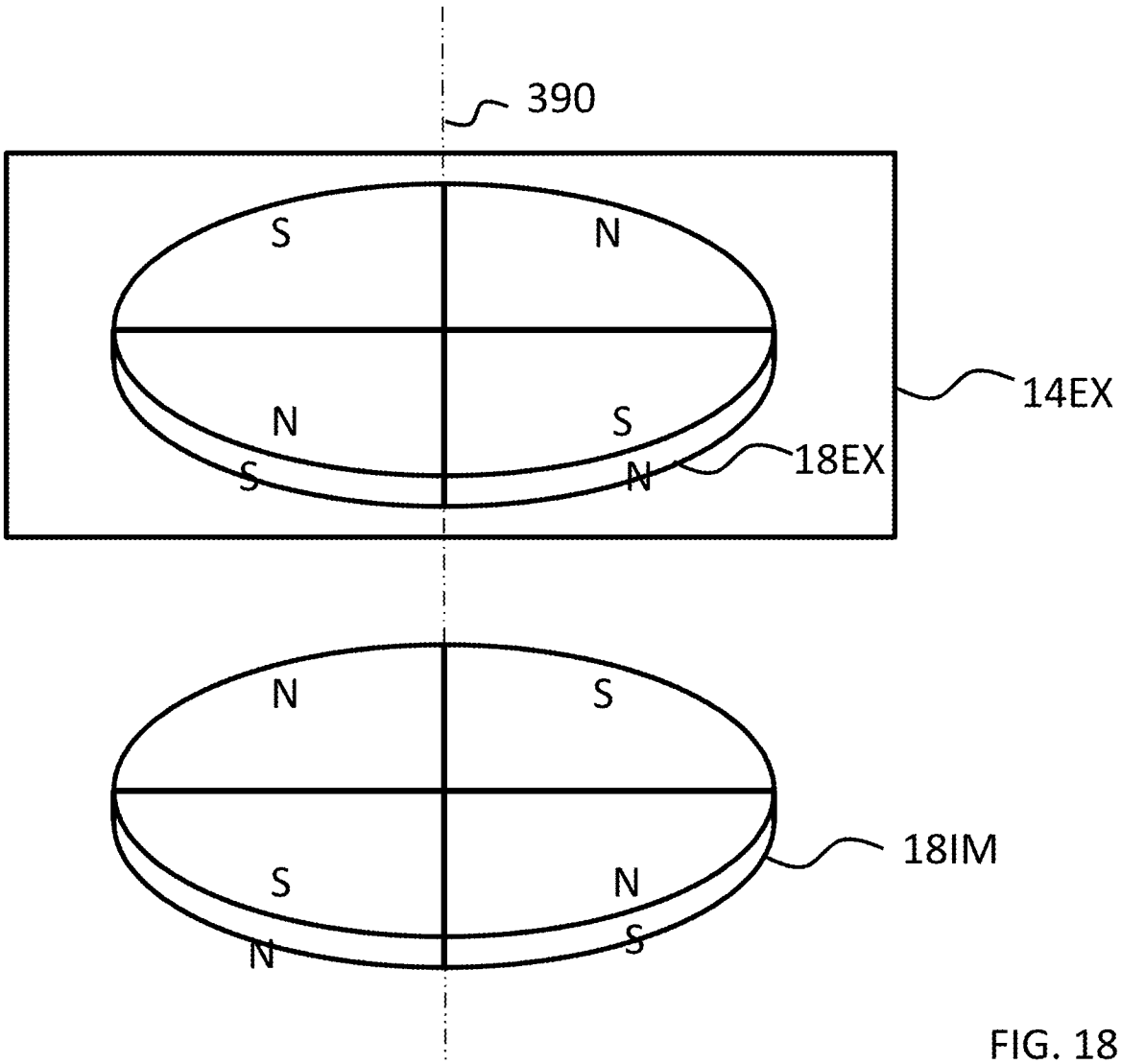

FIG. 18B depicts an alternate exemplary embodiment where the external bone conduction device is configured to enable magnet 18EX to be flipped relative to the configuration of FIG. 18A, and thus vary the resulting magnetic flux between 18EX and 18IM, and thus vary the resulting force of the magnetic retention between the two components. It is noted that embodiments can include both a rotatable magnet 18EX and a flippable magnet 18EX.

It is noted that the configuration of FIG. 18B could likely result in a net repulsive force between the external component and the implantable component, were these are the only two magnets present. Accordingly, in at least some exemplary embodiments, to maintain a net attractive force between the external component implantable component, and additional magnet/magnets can be utilized. Accordingly, in an exemplary embodiment, the adjustments of the magnets are utilized to vary the overall net magnetic attraction force. In this regard, each magnet applies a localized magnetic attractive or repulsive force, depending on its orientation with respect to the other magnets. Adjusting a given magnet adjusts the localized attraction and/or repulsive force resulting from that magnet, which adjusts the net attractive force between the external component and the implantable component. Again, as noted above, there is utilitarian value with respect to every maintaining a positive attraction force between the external component implantable component.

Also, in at least some exemplary embodiments, the distance between various magnets also impacts the resulting net magnetic force between the external components in the implantable components. In this regard, adjusting a magnet in the external component that is further away from a magnet in the implantable component as opposed to adjusting a magnet in the external component that is closer to the magnet and implantable component can result in a different net magnetic attraction for the same adjustment, all other things being equal. In this regard, a magnet closer to the implantable component could have a greater influence on the net retention force relative to a magnet further away from the implantable component, all other things being equal. That said, the size of the magnet may vary this equation. In this regard, even though a magnet might be further away from the implantable component in another magnet, varying the location of the magnet further away could have a greater impact on the overall net magnetic force if the magnet further away was stronger than the closer magnet. Accordingly, the resulting repulsive force would decrease with distance of the external magnet away from the implantable magnet. Thus, the local repulsive force can be utilized to vary the overall net magnetic attractive force between the external component and the implantable component. In an exemplary embodiment, magnet arrangements that results in a local repulsive force can be positioned at distances from the implantable component so as to not dominate the net attractive force, but to vary the net attractive force. That is, a magnet arrangement that might result in a given net attractive force can result in a different net attractive force (or a net repulsive force) depending on the distance from the implantable component.

Briefly, it is noted that in at least some exemplary embodiments, the adjustments of the magnets can result in the generation of a repulsive force that cancels some of the attractive force generated by other magnets. Corollary to this is that in at least some exemplary embodiments, the adjustments of the magnets can result in the generation of an attractive force that adds to the attractive force generated by other magnets. That is, in at least some exemplary embodiments, the net retention/attraction force can be described with respect to the superposition of attraction/repulsion forces at localized regions.

Figure 19A:
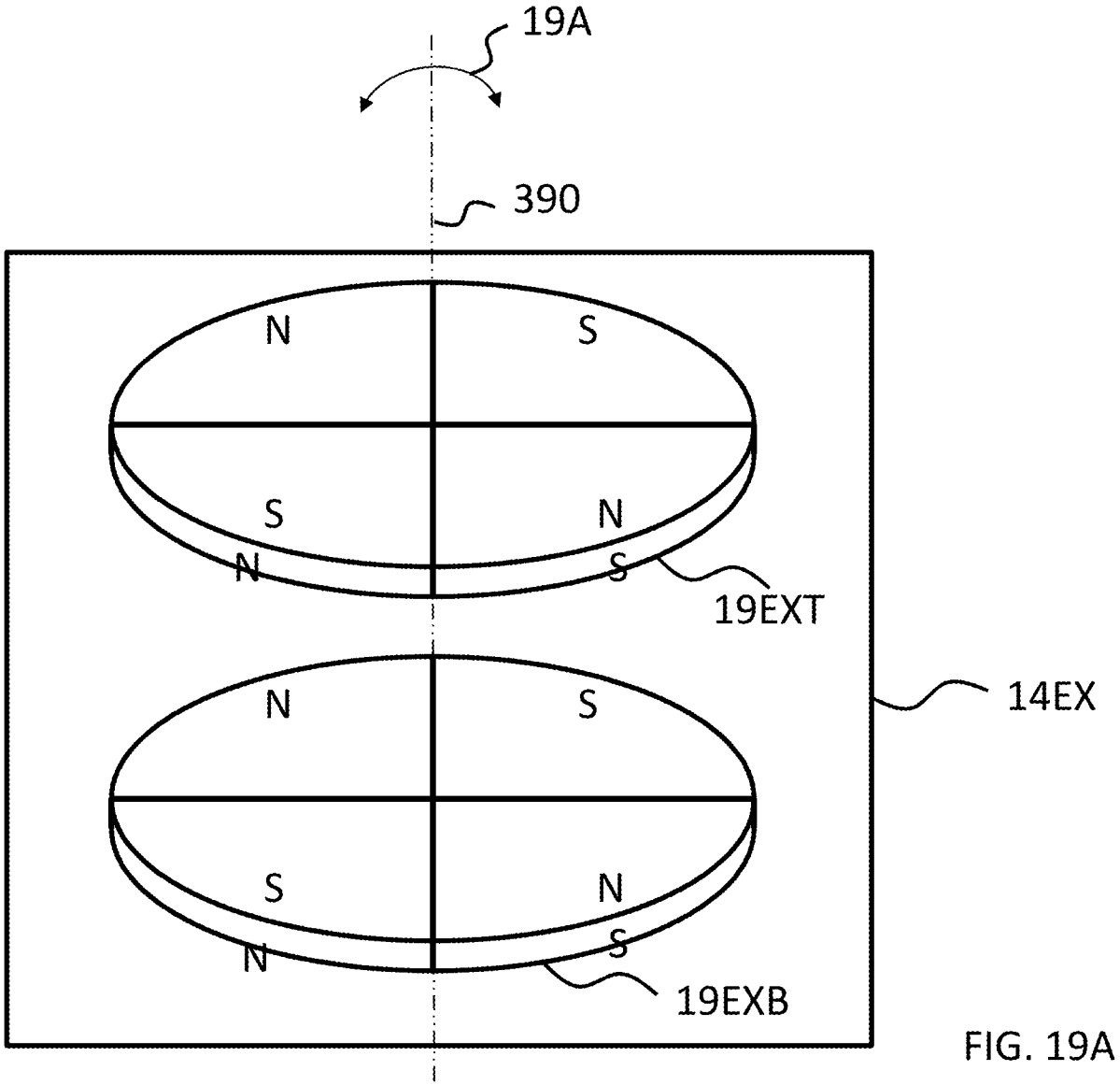
Figure 19B:
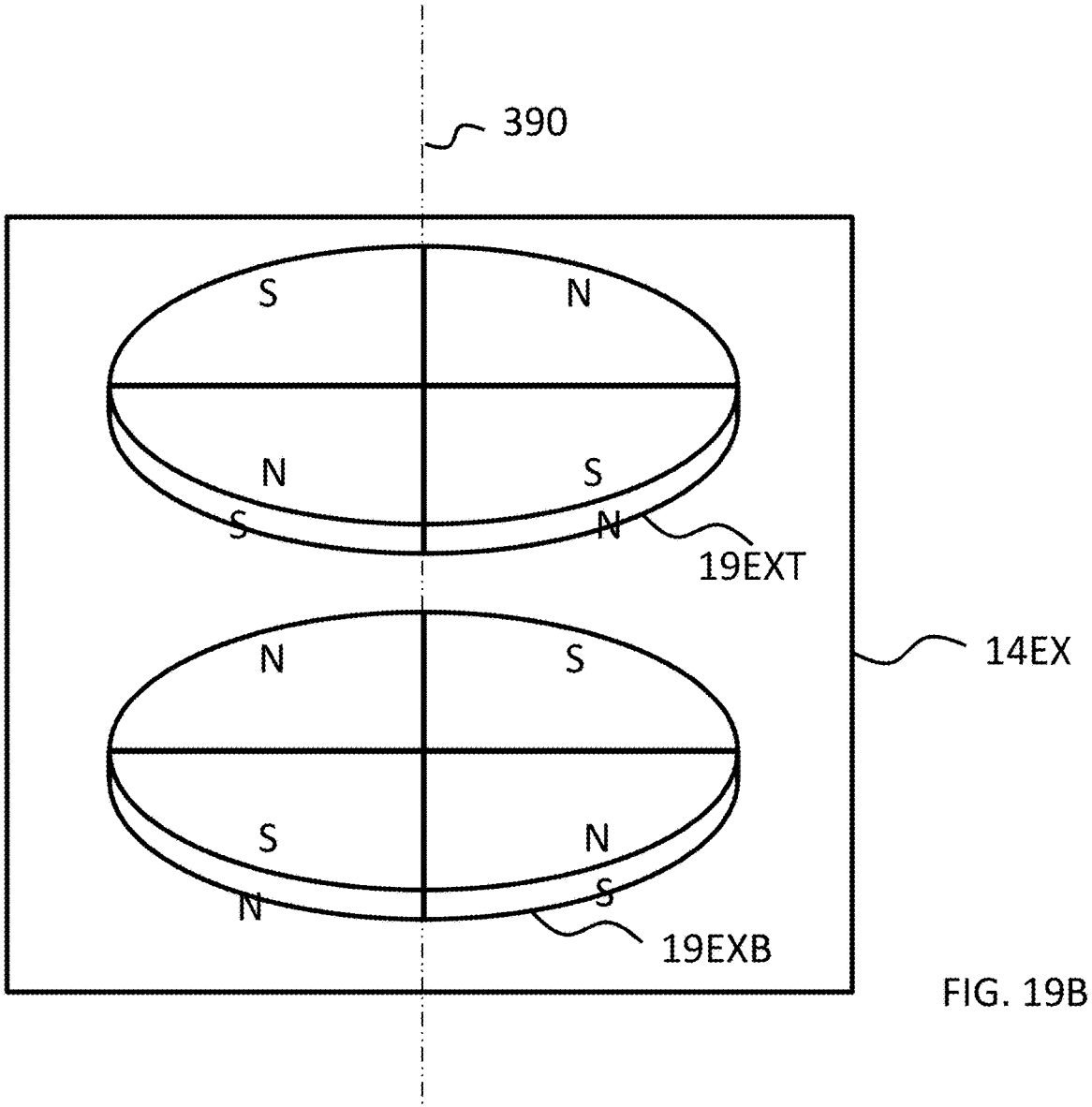

It is noted that while the embodiments of FIGS. 18A and 18B include one segmented magnet 18EX within 14EX, in some alternate embodiments, there are two or more segmented magnets within 14EX. For example, FIGS. 19A and 19B depict such a configuration, including top segmented magnet 19EXT and bottom segmented magnet 19EXB. In the embodiment of FIG. 19A, one or both of the magnets are rotatable relative to one another so as to vary the resulting magnetic field, and thus vary the strength of the resulting attraction force between the external component and the implantable component. In the embodiment of FIG. 19B, one or both of the magnets are flippable relative to one another (FIG. 19B depicts the top magnet, 18EXT, flipped relative to that which is depicted in FIG. 19A), so as to vary the resulting magnetic field, (here, cancel out the attractive forces with respect to these magnets, although some attraction to the implantable component still may remain due to the fact that the bottom magnet is closer to the external component than the top magnet) and thus vary the strength of the resulting attraction force between the external component and the implantable component.

In view of the above, in an exemplary embodiment, there is a bone conduction device, including a first permanent magnet, a second permanent magnet, a third permanent magnet and a fourth permanent magnet, wherein the first permanent magnet (any of the segments of magnet 19EXT) is movable relative to the second permanent magnet and the fourth permanent magnet (any of the segments of magnet 19EXB) so as to adjust a strength of a magnetic field resulting from the first and second permanent magnets, and the third permanent magnet (any of the segments of magnet 19EXT) is movable relative to the fourth permanent magnet and the second permanent magnet so as to adjust the strength of the magnetic field.

Figure 20A:
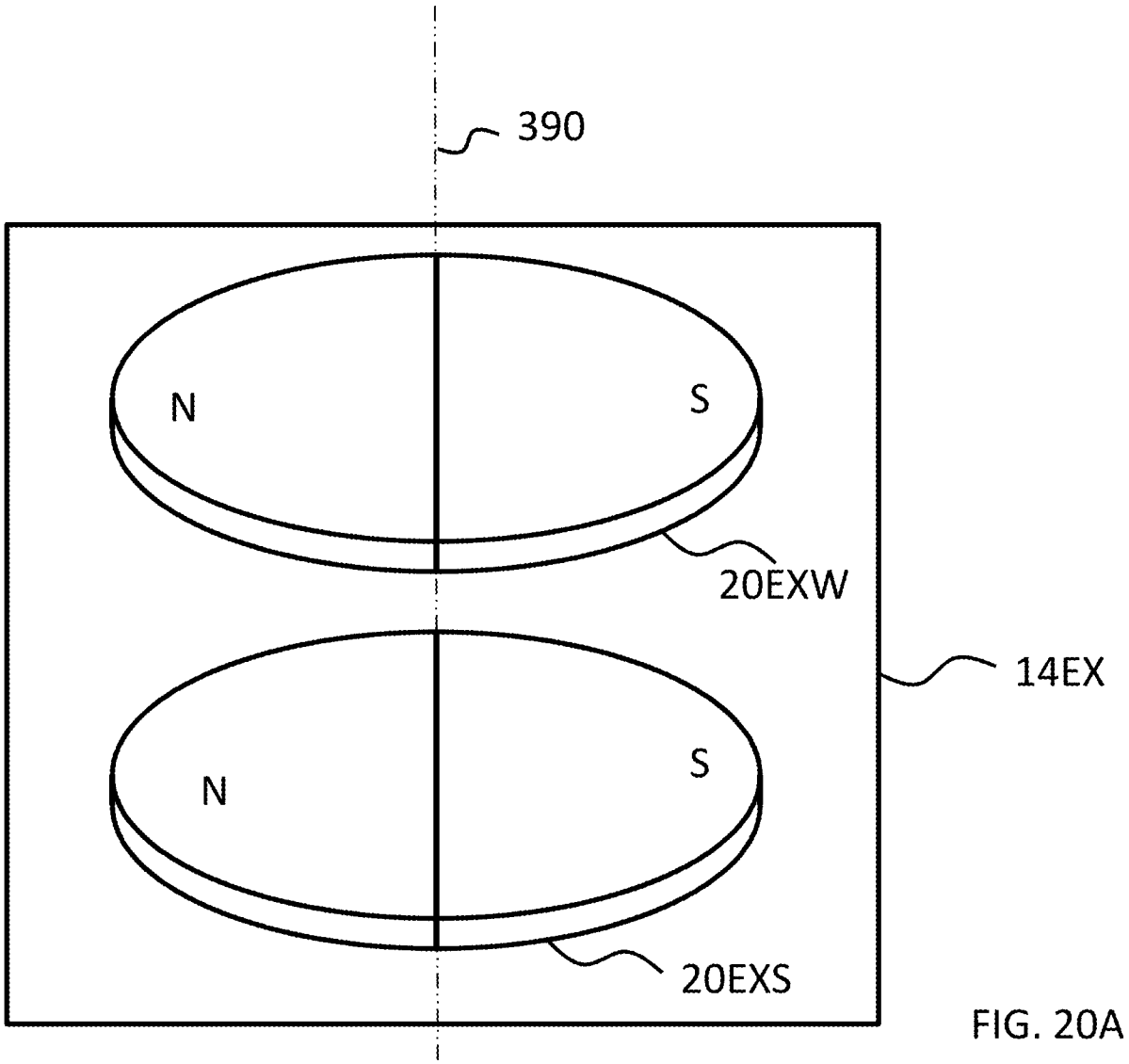
Figure 20B:
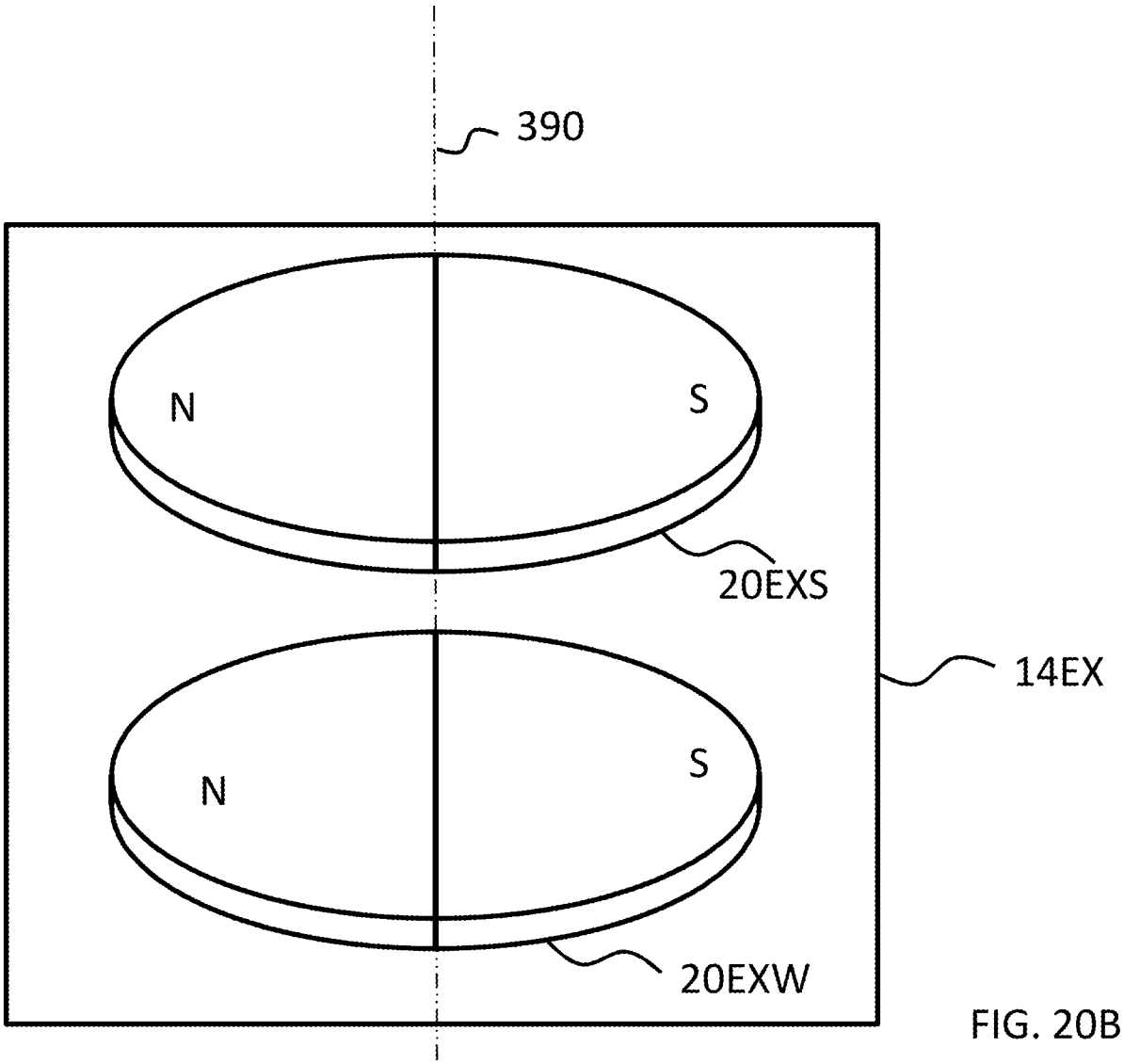

As detailed above, some embodiments utilize magnets that generate stronger magnetic fields relative to other magnets utilized in the external component of the bone conduction device. The embodiment of FIG. 17C was such an example, where a different volume of magnetic material/magnet size was utilized. FIG. 20 depicts an exemplary embodiment that utilizes magnets of the same size that generate magnetic fields of different strengths. This can be achieved through use of different magnetic materials, degree of magnetization etc. In this regard, 14EX includes a top magnet 20EXW and a bottom magnet 20EXS, both of which are segmented into half-moon segments having opposite polarities on the top and bottom surfaces. (It is noted that the concepts of this embodiment can be implemented utilizing at least some of the other magnet configurations detailed herein (e.g., a magnet segmented into 4 sections, such as those above and the embodiments of FIGS. 18A-19B, a single solid magnet, etc.)). The top magnet 20EW is a weak magnet, and the bottom magnet 12EXS is a strong magnet, relative to one another. In an exemplary embodiment, bone conduction device is configured such that the order of the magnets with respect to the stack direction can be varied, as can be seen by comparing FIG. 20A to FIG. 20B. By way of example only and not by way of limitation, by moving the strong magnet 20EXS further away from the implantable component and moving the weak magnet 20EW closer to the implantable component, the retention force between the external component and the implantable component is reduced relative to that which was the case with the magnets in the reversed order.

Figure 20C:
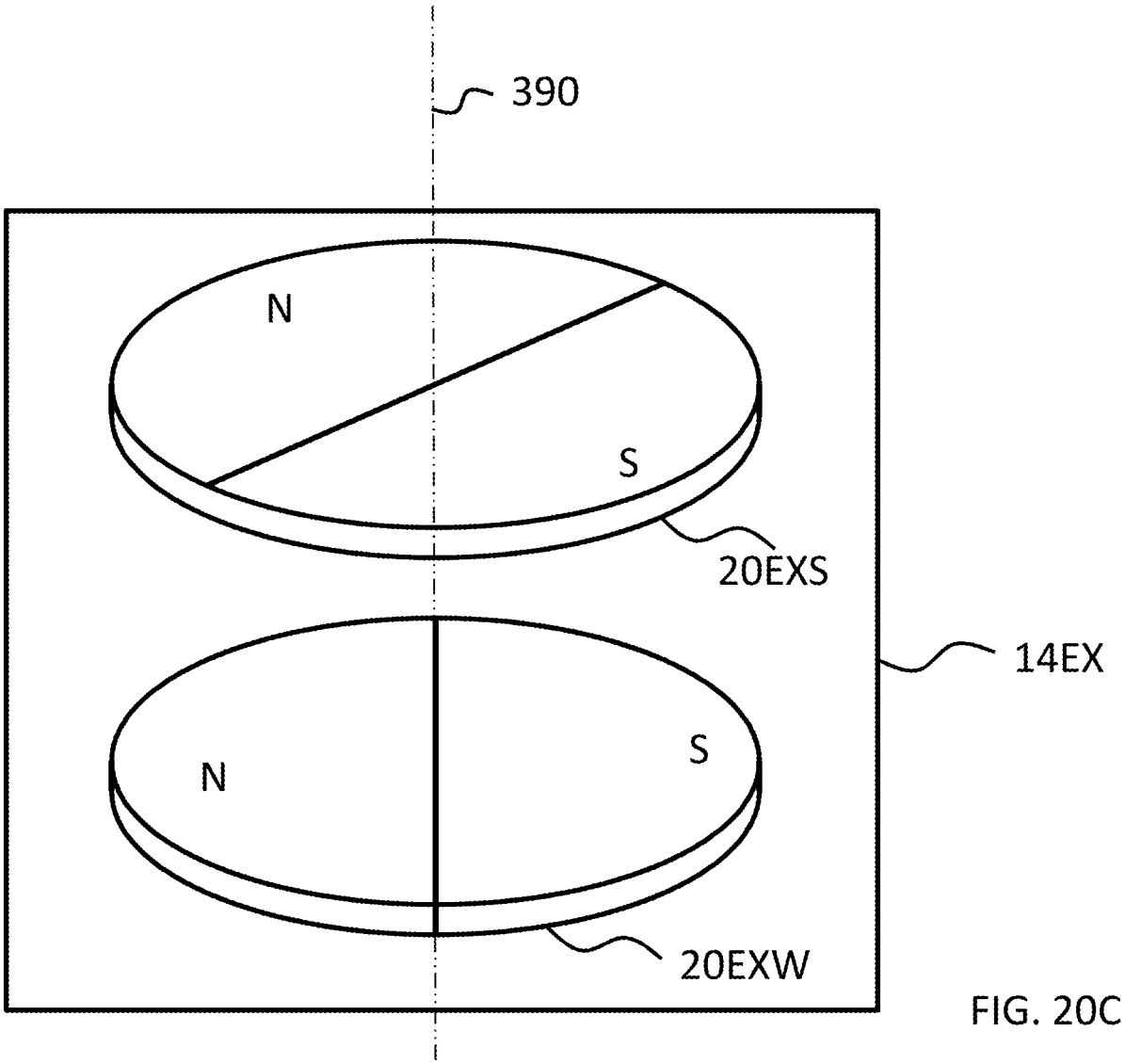

It is also noted that the embodiments of FIGS. 20A and 20B are such that the magnets can be replaced with different magnets having different strengths, and such that the magnets can be rotated relative to one another. With regard to this latter embodiment, FIG. 20C depicts the order in which the magnets in 14EX are stacked are both reversed relative to that which is the case in FIG. 20A and with one of the magnets, the strong magnet 20EXS, rotated about the longitudinal axis 390 relative to its orientation in the configuration of FIG. 20B. Alternatively and/or in addition to this, the weak magnet 20EW can be rotated relative to its orientation in the configuration of FIG. 20B. Note further that one or both of the magnets can be flipped over as well.

In view of the above, it can be seen that in an exemplary embodiment, permanent magnets can be utilized to allow for a range of adjustment of the retention force between the external component and the implantable component with little to no increase in the size of the external component for a given magnet configuration relative to that which would be the case if the magnets were not adjustable. This is as compared to an external component where open/unused space must be made available for a permanent magnet to be moved therein to vary the resulting retention force, wherein open space must be provided for the magnet to enter. While at least some embodiments vary the location of the permanent magnets by a translation, thus moving at least one of the magnets from one location to another, at least some embodiments are such that any magnet that is moved from one location to another is replaced by a magnet that is moved from another location to the location where the magnet was previously located.

It is noted that while the embodiments detailed herein are directed towards a passive transcutaneous bone conduction device in general, and providing a magnetic coupling for an external component of a passive transcutaneous bone conduction device in particular, other embodiments can utilize other types of prostheses, such as cochlear implants, active transcutaneous bone conduction devices and middle ear/DACI devices, at least with respect to the transcutaneous communication components thereof. The teachings detailed herein and/or variations thereof can be applicable, in at least some embodiments, to any type of medical device that is magnetically retained to a recipient. By way of example only and not by way of limitation, the teachings detailed herein can be applicable to a so-called "button sound processor." That is an exemplary embodiment includes an external component that includes microphone(s), a sound processor, and potentially other functional components, and that is held to a recipient via magnetic attraction with an implantable component according to the teachings detailed herein and/or variations thereof, where the button sound processor provides a signal to an implanted (implantable) component (e.g., a component including, for example, an implanted transducer (e.g., electromagnetic actuator), implanted cochlear stimulator, implanted middle-ear actuator, etc.), such signal being, for example, an electromagnetic signal (e.g., a signal provided by an inductance link) transmitted from the button sound processor to the implanted (implantable) component.

In view of the above, it can be seen that the teachings detailed herein and or variations thereof, in at least some embodiments, can be utilized to customize the retention force for a given recipient. This can be done with respect to the long-term (e.g., simply developing a retention force that is comfortable for the recipient for future use, where a "one size fits all" approach is achieved (or "two sizes fit all" or "one size fits many" approach is achieved)) and with respect to the short-term (e.g. permitting the retention force to be adjusted depending on a given circumstances, such as for example increasing the retention force when the recipient is jogging or otherwise engaging in an activity resulting in higher G forces than normal use, etc.). As can be seen, in at least some embodiments, this can enable the adjustment, in at least some embodiments, without the need for other extra components/extra parts to be placed into or added to the external component. That is, the retention force can be adjusted utilizing only the components that are provided with a given external component (albeit tools may be utilized to adjust the force—it is just that there are no extra and/or alternate parts of the hearing prosthesis that are needed to accomplish the adjustment).

In at least some embodiments, this can have utilitarian value with respect to avoiding necrosis and/or reducing the likelihood of necrosis. That said, it can be seen that in at least some embodiments, the range of adjustments of the resulting force can be over a range such that the high-end is about an order of magnitude stronger than the low-end. In this regard, in at least some embodiments, the adjustment mechanism could permit too strong of a force to be applied, if only by accident (this is as compared to a device where only one setting exists). Accordingly, in at least some embodiments, there can be utilitarian value in limiting the range of adjustments of the magnets, so as to limit the range of retention force that can result in the adjustment of the magnets. Such exemplary embodiments will be described in terms of the rotational magnet arrangement. That said, it is noted that the following concepts can be applied to other embodiments detailed herein and/or variations thereof.

Figure 21:
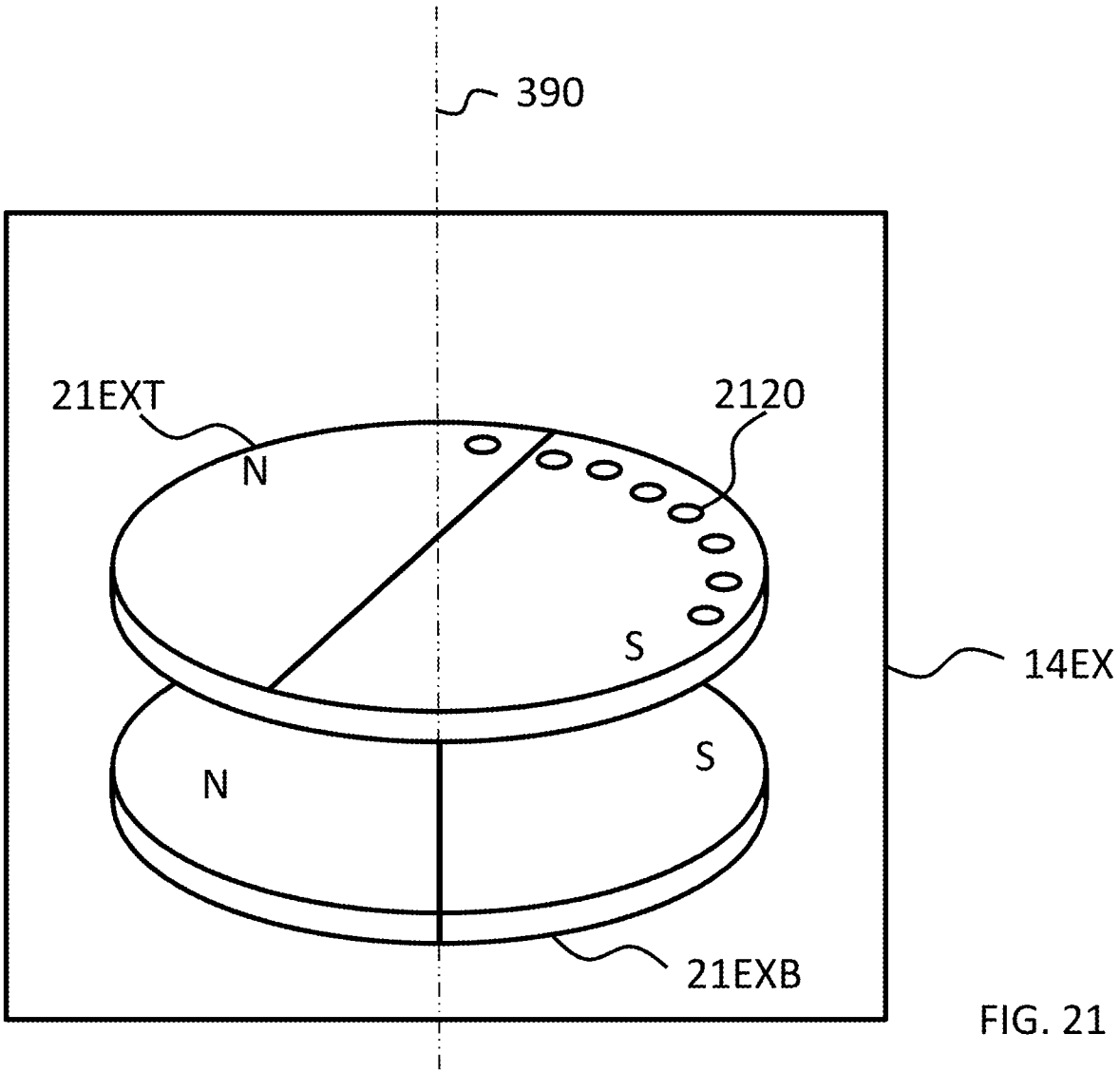
FIGS. 21-24 depict exemplary rotational locking concepts according to some exemplary embodiments.
Figure 22:
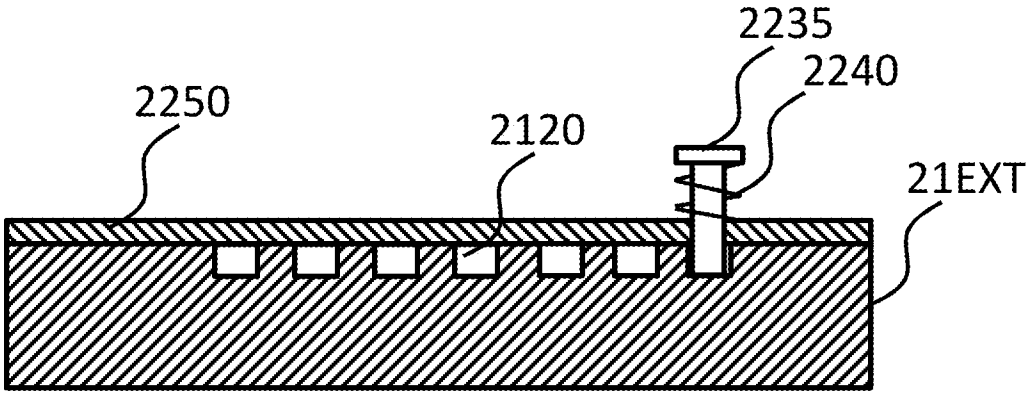

Referring now to FIG. 21, an arrangement can be seen where 14EX includes a top magnet 21EXT and a bottom magnet 21EXB, or at least the top magnet 21EXT is rotatable relative to the bottom magnet 21EXB. As can be seen, there is an array of holes 2120 located in the top surface of the top magnet 21EXT. In an exemplary embodiment of the external component 1440, a spring-loaded lock-pin 2235 interfaces with the holes 2120 on a selective basis so as to lock the location of the top magnet relative to the bottom magnet. This can be seen in FIG. 22, which is an extrapolated cross-sectional view through 14EX taken in a direction parallel to the longitudinal axis 390. As can be seen, a spring 2240 is connected to the lock-pin 2235. In an exemplary embodiment, the lock-pin 2235 is spring-loaded to be forced downward into a hole 2120 though the housing wall 2250. During use, a user pulls on the head of the pin 2235 to pull the pin out of the hole 2120 so that the magnet 20EXT can be rotated.

Because the holes are arrayed only in a limited pattern, the top magnet 21EXT can only be locked at certain angular locations relative to the bottom magnet 21EXB. In the locations where the holes are not present, the magnet 21EXT cannot be locked. Thus, this prevents the magnet from being locked at a location where the resulting retention force is too strong (or, alternatively, too weak, in some other embodiments). That is, while the 20EXT can be rotated to a location where the resulting attraction force may be too strong, it cannot be locked in place at that location. That said, in some alternative embodiments, the external component 1440 can be configured such that the external component cannot be used unless lock-pin 2235 is engaged in one of the holes 2120.

It is noted that this embodiment is applicable to any embodiment where it is desired to lock the movable magnet in place after the adjustment and not just those where the range of adjustment is desired to be limited.

Figure 23:
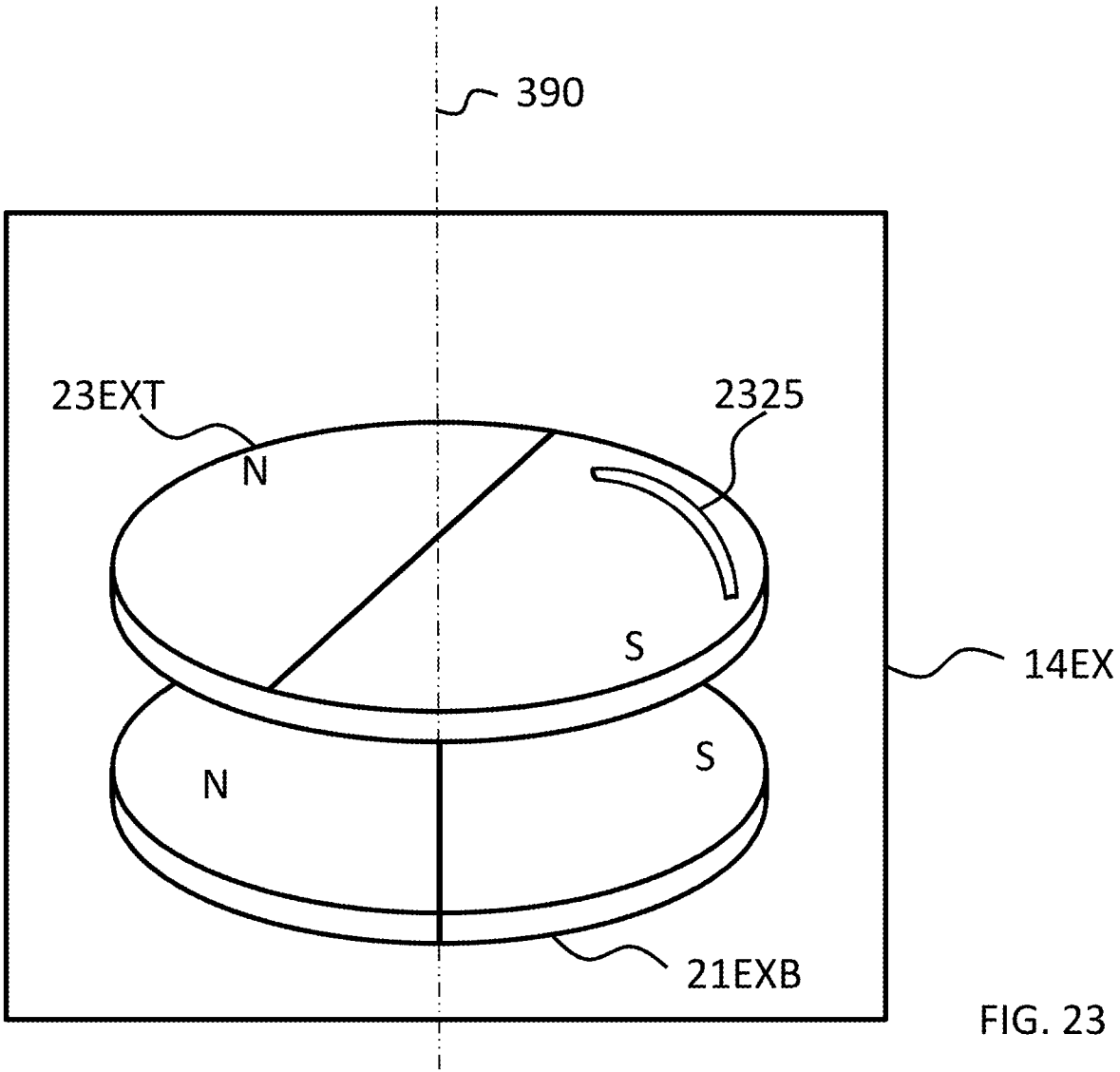
Figure 24:
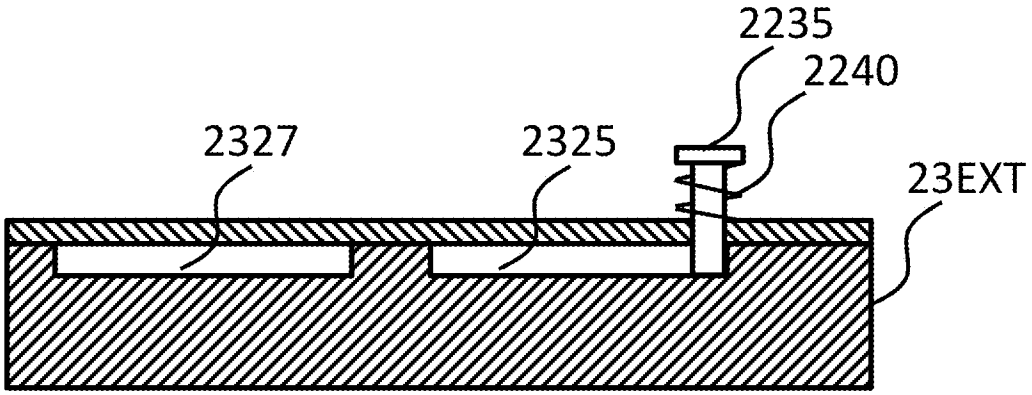

FIG. 23 provides an alternate embodiment of the concept of FIG. 21. Here, instead of separate holes, a slot 2325 is located in the top surface of the top magnet 23EXT. FIG. 24 provides a cross-sectional view of this concept, being taken in a plane that is parallel to the longitudinal axis 390. Here, two slots can be seen: slots 2325, and 2327. In an exemplary embodiment, the top magnet 23EXT can be rotated only over a range between the end walls of the slot 2325 (if the pin 2235 is located therein) or the slit 2327 (if the pin 2235 is located therein). This is because the end walls of the slots will hit pin 2235 unless the pin is withdrawn from the slot. This can enable the forced to be adjusted over the range of movements within a given slot, while requiring the pin to be affirmatively removed from a slot to adjust the magnet 23EXT outside the range of a given slot.

Any device, system, or method that will enable movement of an adjustable magnet to be limited to enable the teachings detailed herein and/or variations thereof to be practiced can be utilized in at least some embodiments.

As noted above, some and/or all of the teachings detailed herein can be used with a passive transcutaneous bone conduction device. Thus, in an exemplary embodiment, there is a passive transcutaneous bone conduction device including one or more or all of the teachings detailed herein that is configured to effectively evoke hearing percept. By "effectively evoke a hearing percept," it is meant that the vibrations are such that a typical human between 18 years old and 40 years old having a fully functioning cochlea receiving such vibrations, where the vibrations communicate speech, would be able to understand the speech communicated by those vibrations in a manner sufficient to carry on a conversation provided that those adult humans are fluent in the language forming the basis of the speech. In an exemplary embodiment, the vibrational communication effectively evokes a hearing percept, if not a functionally utilitarian hearing percept.

It is noted that any disclosure with respect to one or more embodiments detailed herein can be practiced in combination with any other disclosure with respect to one or more other embodiments detailed herein (e.g., any disclosures herein regarding the embodiment of FIG. 3 can be practiced with the embodiment of FIG. 8, etc.), at least unless specified herein to the contrary.

It is noted that some embodiments include a method of utilizing a bone conduction device including one or more or all of the teachings detailed herein and/or variations thereof. In this regard, it is noted that any disclosure of a device and/or system herein also corresponds to a disclosure of utilizing the device and/or system detailed herein, at least in a manner to exploit the functionality thereof. Further it is noted that any disclosure of a method of manufacturing corresponds to a disclosure of a device and/or system resulting from that method of manufacturing. It is also noted that any disclosure of a device and/or system herein corresponds to a disclosure of manufacturing that device and/or system.

With regard to methods, an exemplary method entails obtaining an external component of a medical device configured to be magnetically retained against outer skin of a recipient via a magnetic coupling between the external component and an implanted component in the recipient (e.g., the embodiment of FIGS. 3, 8, etc.) and adjusting an orientation of one or more magnets of the external component relative to at least one other magnet of the external component (e.g., moving the magnet as detailed with respect to the embodiment of FIG. 3, flipping one of two magnets over and/or rotating one magnet relative to the other as detailed with respect to the embodiment of FIG. 8, etc.), such that the resulting retention force of the magnetic retention for the recipient is varied from that which was the case prior to the adjustment. In an exemplary embodiment of this method, the action of adjusting the orientation of one or more magnets of the external component such that the resulting retention force is varied is executed in a manner such that the same magnets are part of the external component after the adjustment as before the adjustment and during the adjustment. Still further, in some embodiments, this method is executed such that the retention force is varied such that at least one of a 25% reduction in the force occurs or a 25% increase in the force occurs, for the recipient, and/or or that the action of adjusting a location of one or more magnets of the external component at least one of creates a short-circuit or varies an existing short-circuit of the magnetic flux between the external component and the implantable component, thereby varying the resulting retention force.

Still further, in at least some embodiments, the action of adjusting the orientation of one or more magnets of the external component such that the resulting retention force is varied is executed without changing a total magnetic density of permanent magnets of the external component and/or the action of adjusting a location of one or more magnets of the external component such that the resulting retention force is varied is executed without changing a total magnetic density of permanent magnets of the external component and/or the action of adjusting the location of one or more magnets of the external component such that the resulting retention force is varied is executed without changing a global position of a magnet of the external component. In at least some embodiments, the action of adjusting the orientation of one or more magnets of the external component such that the resulting retention force is varied is executed without removing or adding any magnets to the external component and/or the action of adjusting the orientation of one or more magnets of the external component is executed without directly accessing the one or more magnets from outside the external component.

Also, it is noted that while the embodiments detailed above are directed towards an arrangement where the external component includes the adjustable magnet arrangement, in at least some alternate embodiments, the implantable component can include the adjustable magnets. That is, in at least some embodiments, any one or more or all of the teachings detailed herein are applicable to the implantable component(s) detailed herein. It is further noted that in some embodiments, both the implantable component and the external component can utilize the adjustable features detailed herein.

In an exemplary embodiment, the implanted magnets can be hermetically sealed within an implantable housing. In some embodiments, a magnetic field can be utilized to adjust the location of the magnets. Alternatively and/or in addition to this, an invasive surgical procedure can be utilized, albeit a limited one. In an exemplary embodiment, the procedure can be of limited invasivity such that a local anesthesia need only be utilized (if at all). For example, a needle can be inserted through the skin to contact the implant and push and/or pull a portion of the implanted component thereby moving the magnet(s). Alternatively, a puncture can be made in the skin, and a thin rod or the like can be inserted through the puncture to apply the tensile and/or or compressive force to the implantable component so as to move the magnet(s). An exemplary embodiment can include a lock that can be disabled and enabled with the needle/rod, which permits and prevents, respectively, movement of the magnet(s).

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus, comprising:

an external component of a medical device configured to generate a permanent magnet magnetic flux via at least one permanent magnet that removably retains, via a resulting permanent magnet magnetic retention force, the external component to a recipient thereof, wherein the external component is configured to enable adjustment of the generated permanent magnet magnetic flux so as to vary the resulting magnetic retention force via adjustment of one part of the external component relative to another part of the external component.

2. The apparatus of claim 1, wherein:

the external component is configured to mechanically enable the adjustment of the generated magnetic flux via mechanically causing and/or changing at least one of additive or subtractive interaction of local permanent magnet magnetic flux resulting from one or more permanent magnets of the apparatus, which one or more permanent magnets include the at least one permanent magnet.

3. The apparatus of claim 1, wherein:

the at least one permanent magnet includes at least a first permanent magnet and a second permanent magnet, and wherein the external component is configured to enable the adjustment of the generated magnetic flux as a result of repositioning of the first permanent magnet of the external component relative to the second permanent magnet of the external component.

4. The apparatus of claim 3, wherein:

the repositioning of the first permanent magnet relative to the second permanent magnet is in a single plane and the external component is configured such that the repositioning of the first permanent magnet relative to the second permanent magnet occurs entirely within confines of the external component with the first permanent magnet and the second permanent magnet being located entirely within confines of the external component.

5. The apparatus of claim 3, wherein:

the repositioning of the first permanent magnet relative to the second permanent magnet is a rotational movement.

6. The apparatus of claim 2, wherein:

the at least one permanent magnet includes permanent magnets, and the external component is configured to enable the adjustment of the generated magnetic flux without varying a total magnetic density of the permanent magnets of the external component generating the magnetic flux.

7. The apparatus of claim 1, wherein:

the external component is configured to enable adjustment of the generated permanent magnet magnetic flux via mechanical adjustment of the at least one permanent magnet so as to vary the resulting magnetic retention force.

8. An apparatus, comprising:

an external component of a medical device, including:

a first permanent magnet; and a second permanent magnet, wherein the external component is configured to enable the first permanent magnet to be moved for purposes of adjustment relative to the second permanent magnet, which adjustment adjusts a strength of a magnetic field resulting from the first and second permanent magnets, and at least one of:

(i) the apparatus is configured such that the first permanent magnet can be moved from a location where the first permanent magnet is within the second permanent magnet to a location at least substantially outside the second permanent magnet so as to decrease the strength of the magnetic field; or (ii) the apparatus further comprises a third permanent magnet and a fourth permanent magnet, wherein the magnetic field also results from the third and fourth permanent magnets, the third permanent magnet is movable relative to the fourth permanent magnet and the second permanent magnet so as to adjust the strength of the magnetic field, the first permanent magnet is movable relative to the fourth permanent magnet so as to adjust the strength of the magnetic field resulting from the first, second, third and fourth permanent magnets, the first and third permanent magnets are arrayed in a first circular path, the second and fourth permanent magnets are arrayed in a second circular path encompassing or encompassed by the first circular path, and the first and third permanent magnets move along the first circular path and thus relative to the second and fourth permanent magnets so as to adjust the strength of the magnetic field resulting from the first, second, third and fourth permanent magnets.

9. The apparatus of claim 8, wherein:

the first permanent magnet is rotatable relative to the second permanent magnet so as to adjust the strength of the magnetic field.

10. The apparatus of claim 8, further comprising:

the third permanent magnet and the fourth permanent magnet, wherein the magnetic field also results from the third and fourth permanent magnets, the third permanent magnet is movable relative to the fourth permanent magnet and the second permanent magnet so as to adjust the strength of the magnetic field, and the first permanent magnet is movable relative to the fourth permanent magnet so as to adjust the strength of the magnetic field resulting from the first, second, third and fourth permanent magnets.

11. The apparatus of claim 10, wherein:

the first and third permanent magnets are arrayed in the first circular path;

the second and fourth permanent magnets are arrayed in the second circular path encompassing or encompassed by the first circular path, and the first and third permanent magnets move along the first circular path and thus relative to the second and fourth permanent magnets so as to adjust the strength of the magnetic field resulting from the first, second, third and fourth permanent magnets.

12. The apparatus of claim 11, wherein:

the first and second circular paths are arrayed about an axis of rotation, relative to a plane normal to the axis of rotation, the alignment of the poles of the first and second permanent magnets are the same and the alignment of the poles of the third and fourth permanent magnets are also the same and opposite of that of the first and second permanent magnets.

13. The apparatus of claim 8, wherein:

the apparatus is configured such that the first permanent magnet can be moved from the location where the first permanent magnet is within the second permanent magnet to the location at least substantially outside the second permanent magnet so as to decrease the strength of the magnetic field.

14. The apparatus of claim 8, wherein:

the first permanent magnet is movable relative to the second permanent magnet such that the alignment of poles of the first permanent magnet relative to those of the second permanent magnet are reversed so as to decrease the strength of the magnetic field resulting from the first and second permanent magnets.

15. The apparatus of claim 8, wherein:

the first permanent magnet is controllably rotatable relative to the second permanent magnet and configured to secure the first permanent magnet to a new rotated orientation relative to a prior orientation so as to adjust the strength of the magnetic field and maintain the adjusted strength when the first permanent magnet is secured in the new rotated orientation.

16. A method, comprising:

obtaining an external component of a medical device configured to be magnetically retained against outer skin of a recipient via a magnetic coupling between the external component and an implanted component in the recipient, which magnetic coupling produces a first resulting retention force; and adjusting an orientation of one or more magnets of the external component relative to at least one other magnet of the external component such that a second resulting retention force of the magnetic retention for the recipient is varied from that of the first resulting retention force.

17. The method of claim 16, wherein:

the action of adjusting the orientation of one or more magnets of the external component such that the resulting retention force is varied is executed in a manner such that the same one or more magnets are part of the external component after the adjustment as before the adjustment and during the adjustment.

18. The method of claim 16, wherein:

the retention force is varied such that at least one of a 25% reduction in the force occurs or a 25% increase in the force occurs, for the recipient.

19. The method of claim 16, wherein:

the action of adjusting the orientation of one or more magnets of the external component creates at least one of a short-circuit or varies an existing short-circuit of the magnetic flux between the external component and the implantable component, thereby varying the resulting retention force.

20. The method of claim 16, wherein:

the action of adjusting the orientation of one or more magnets of the external component such that the resulting retention force is varied is executed without changing a total magnetic density of permanent magnets of the external component.

21. The method of claim 16, wherein:

the action of adjusting the orientation of one or more magnets of the external component such that the resulting retention force is varied is executed without changing a total magnetic density of permanent magnets of the external component.

* * * * *